US008408673B2

(12) United States Patent
Aoki et al.

(10) Patent No.: US 8,408,673 B2
(45) Date of Patent: Apr. 2, 2013

(54) PRINTING APPARATUS AND INK DISCHARGE FAILURE DETECTION METHOD

(75) Inventors: Takatsuna Aoki, Yokohama (JP); Hiroshi Takabayashi, Atsugi (JP); Seiichiro Karita, Toda (JP); Isao Hayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/870,668

(22) Filed: Aug. 27, 2010

(65) Prior Publication Data

US 2010/0321441 A1 Dec. 23, 2010

Related U.S. Application Data

(63) Continuation of application No. 11/764,105, filed on Jun. 15, 2007, now Pat. No. 7,806,503.

(30) Foreign Application Priority Data

Jun. 19, 2006 (JP) ..... 2006-169382

(51) Int. Cl.
*B41J 2/165* (2006.01)

(52) U.S. Cl. ..... 347/23; 347/17

(58) Field of Classification Search ..... 347/14, 347/17, 23, 263
See application file for complete search history.

(56) References Cited

U.S. PATENT DOCUMENTS

| | | | | |
|---|---|---|---|---|
| 4,313,124 | A * | 1/1982 | Hara | 347/57 |
| 5,488,398 | A * | 1/1996 | Matsubara et al. | 347/43 |
| 5,576,745 | A * | 11/1996 | Matsubara | 347/14 |
| 7,341,324 | B2 * | 3/2008 | Juve et al. | 347/17 |
| 2001/0012031 | A1 * | 8/2001 | Miyake et al. | 347/40 |
| 2002/0027578 | A1 * | 3/2002 | Matsumoto et al. | 347/65 |
| 2003/0085938 | A1 * | 5/2003 | Imanaka et al. | 347/14 |
| 2006/0158472 | A1 * | 7/2006 | Endo | 347/14 |
| 2007/0291066 | A1 * | 12/2007 | Takabayashi et al. | 347/17 |

FOREIGN PATENT DOCUMENTS

| | | | |
|---|---|---|---|
| JP | 58-118267 | A | 7/1983 |
| JP | 06-336024 | A | 12/1994 |
| JP | 2000-343695 | A | 12/2000 |

* cited by examiner

*Primary Examiner* — Charlie Peng
(74) *Attorney, Agent, or Firm* — Canon USA Inc IP Division

(57) ABSTRACT

A printing apparatus and ink discharge failure detection method capable of precisely detecting temperature information corresponding to each nozzle are provided. Temperatures of respective electrothermal transducers (heaters) are measured on the basis of outputs from a plurality of sensors corresponding to the respective heaters. The temperatures of the heaters at a predetermined timing during a printing operation are predicted on the basis of the temperature change profiles of the respective heaters that are generated by energizing the heaters. A plurality of thresholds corresponding to nozzle states are generated on the basis of the predicted temperatures and the driving conditions of an inkjet printhead, and it is controlled to execute temperature measurement at the predetermined timing. A temperature measured under the control is compared with the respective generated thresholds, and the nozzle state is identified on the basis of the comparison results.

7 Claims, 59 Drawing Sheets

FIG. 18

| Tini [℃] | Tmax_cal [℃] | Tini [℃] | Tmax_cal [℃] | Tini [℃] | Tmax_cal [℃] |
|---|---|---|---|---|---|
| 10 | 156.2 | 31 | 172.4 | 52 | 190.3 |
| 11 | 157.0 | 32 | 173.2 | 53 | 191.2 |
| 12 | 157.7 | 33 | 174.1 | 54 | 192.1 |
| 13 | 158.4 | 34 | 174.9 | 55 | 193.0 |
| 14 | 159.2 | 35 | 175.7 | 56 | 193.9 |
| 15 | 159.9 | 36 | 176.5 | 57 | 194.8 |
| 16 | 160.7 | 37 | 177.4 | 58 | 195.8 |
| 17 | 161.4 | 38 | 178.2 | 59 | 196.7 |
| 18 | 162.2 | 39 | 179.0 | 60 | 197.6 |
| 19 | 163.0 | 40 | 179.9 | 61 | 198.5 |
| 20 | 163.7 | 41 | 180.7 | 62 | 199.5 |
| 21 | 164.5 | 42 | 181.6 | 63 | 200.4 |
| 22 | 165.3 | 43 | 182.4 | 64 | 201.4 |
| 23 | 166.1 | 44 | 183.3 | 65 | 202.3 |
| 24 | 166.8 | 45 | 184.2 | 66 | 203.3 |
| 25 | 167.6 | 46 | 185.0 | 67 | 204.2 |
| 26 | 168.4 | 47 | 185.9 | 68 | 205.2 |
| 27 | 169.2 | 48 | 186.8 | 69 | 206.1 |
| 28 | 170.0 | 49 | 187.7 | 70 | 207.1 |
| 29 | 170.8 | 50 | 188.5 | 71 | 208.1 |
| 30 | 171.6 | 51 | 189.4 | 72 | 209.1 |

FIG. 19

| Tini [℃] | Tmax_cal [℃] | THRESHOLD [℃] | Tini [℃] | Tmax_cal [℃] | THRESHOLD [℃] | Tini [℃] | Tmax_cal [℃] | THRESHOLD [℃] | Tini [℃] | Tmax_cal [℃] | THRESHOLD [℃] |
|---|---|---|---|---|---|---|---|---|---|---|---|
| 10 | 156.2 | 187.2 | 31 | 172.4 | 198.7 | 52 | 190.3 | 210.8 | 73 | 210.1 | 223.6 |
| 11 | 157.0 | 187.8 | 32 | 173.2 | 199.3 | 53 | 191.2 | 211.4 | 74 | 211.0 | 224.2 |
| 12 | 157.7 | 188.3 | 33 | 174.1 | 199.8 | 54 | 192.1 | 212.0 | 75 | 212.0 | 224.8 |
| 13 | 158.4 | 188.8 | 34 | 174.9 | 200.4 | 55 | 193.0 | 212.6 | 76 | 213.0 | 225.5 |
| 14 | 159.2 | 189.4 | 35 | 175.7 | 200.9 | 56 | 193.9 | 213.2 | 77 | 214.0 | 226.1 |
| 15 | 159.9 | 189.9 | 36 | 176.5 | 201.5 | 57 | 194.8 | 213.8 | 78 | 215.1 | 226.7 |
| 16 | 160.7 | 190.4 | 37 | 177.4 | 202.1 | 58 | 195.8 | 214.4 | 79 | 216.1 | 227.4 |
| 17 | 161.4 | 191.0 | 38 | 178.2 | 202.7 | 59 | 196.7 | 215.0 | 80 | 217.1 | 228.0 |
| 18 | 162.2 | 191.5 | 39 | 179.0 | 203.2 | 60 | 197.6 | 215.6 | 81 | 218.1 | 228.6 |
| 19 | 163.0 | 192.1 | 40 | 179.9 | 203.8 | 61 | 198.5 | 216.2 | 82 | 219.1 | 229.3 |
| 20 | 163.7 | 192.6 | 41 | 180.7 | 204.4 | 62 | 199.5 | 216.8 | 83 | 220.2 | 229.9 |
| 21 | 164.5 | 193.2 | 42 | 181.6 | 205.0 | 63 | 200.4 | 217.4 | 84 | 221.2 | 230.6 |
| 22 | 165.3 | 193.7 | 43 | 182.4 | 205.5 | 64 | 201.4 | 218.0 | 85 | 222.2 | 231.2 |
| 23 | 166.1 | 194.3 | 44 | 183.3 | 206.1 | 65 | 202.3 | 218.6 | 86 | 223.3 | 231.9 |
| 24 | 166.8 | 194.8 | 45 | 184.2 | 206.7 | 66 | 203.3 | 219.2 | 87 | 224.3 | 232.5 |
| 25 | 167.6 | 195.4 | 46 | 185.0 | 207.3 | 67 | 204.2 | 219.9 | 88 | 225.4 | 233.1 |
| 26 | 168.4 | 195.9 | 47 | 185.9 | 207.9 | 68 | 205.2 | 220.5 | 89 | 226.5 | 233.8 |
| 27 | 169.2 | 196.5 | 48 | 186.8 | 208.4 | 69 | 206.1 | 221.1 | 90 | 227.5 | 234.5 |
| 28 | 170.0 | 197.0 | 49 | 187.7 | 209.0 | 70 | 207.1 | 221.7 | | | |
| 29 | 170.8 | 197.6 | 50 | 188.5 | 209.6 | 71 | 208.1 | 222.3 | | | |
| 30 | 171.6 | 198.1 | 51 | 189.4 | 210.2 | 72 | 209.1 | 223.0 | | | |

FIG. 28

| Tini [°C] | Tmax_cal [°C] | Tini [°C] | Tmax_cal [°C] |
|---|---|---|---|
| 10 | 130.4 | 42 | 189.7 |
| 12 | 136.7 | 44 | 192.0 |
| 14 | 142.4 | 46 | 194.3 |
| 16 | 147.4 | 48 | 196.4 |
| 18 | 152.0 | 50 | 198.6 |
| 20 | 156.3 | 52 | 200.6 |
| 22 | 160.2 | 54 | 202.6 |
| 24 | 163.9 | 56 | 204.5 |
| 26 | 167.4 | 58 | 206.4 |
| 28 | 170.6 | 60 | 208.2 |
| 30 | 173.7 | 62 | 210.0 |
| 32 | 176.7 | 64 | 211.8 |
| 34 | 179.5 | 66 | 213.5 |
| 36 | 182.2 | 68 | 215.2 |
| 38 | 184.8 | 70 | 216.8 |
| 40 | 187.3 | 71 | 217.6 |

FIG. 29

| Tini [℃] | Tmax UPON APPLICA-TION OF DOUBLE PULSES 1 [℃] | Tth UPON APPLICA-TION OF DOUBLE PULSES 1 [℃] | Tmax UPON APPLICA-TION OF SINGLE PULSE 1 [℃] | Tth UPON APPLICA-TION OF SINGLE PULSE 1 [℃] | Tmax UPON APPLICA-TION OF DOUBLE PULSES 2 [℃] | Tth UP APPLIC TION OF DOUBLE PULSES [℃] |
|---|---|---|---|---|---|---|
| 10 | 130.4 | 145.4 | 117.6 | 132.6 | 123.4 | 138 |
| 12 | 136.7 | 151.7 | 124.2 | 139.2 | 130.1 | 145. |
| 14 | 142.4 | 157.4 | 130.0 | 145.0 | 136.1 | 151.1 |
| 16 | 147.4 | 162.4 | 135.3 | 150.3 | 141.4 | 156.4 |
| 18 | 152.0 | 167.0 | 140.2 | 155.2 | 146.3 | 161.3 |
| 20 | 156.3 | 171.3 | 144.7 | 159.7 | 150.8 | 165 |
| 22 | 160.2 | 175.2 | 148.9 | 163.9 | 155.0 | 170 |
| 24 | 163.9 | 178.9 | 152.8 | 167.8 | 159.0 | 174. |
| 26 | 167.4 | 182.4 | 156.5 | 171.5 | 162.7 | 177.7 |
| 28 | 170.6 | 185.6 | 160.0 | 175.0 | 166.2 | 181.2 |
| 30 | 173.7 | 188.7 | 163.4 | 178.4 | 169.6 | 184.6 |
| 32 | 176.7 | 191.7 | 166.5 | 181.5 | 172.8 | 187 |
| 34 | 179.5 | 194.5 | 169.6 | 184.6 | 175.8 | 190 |
| 36 | 182.2 | 197.2 | 172.5 | 187.5 | 178.8 | 193. |
| 38 | 184.8 | 199.8 | 175.3 | 190.3 | 181.6 | 196.6 |
| 40 | 187.3 | 202.3 | 178.0 | 193.0 | 184.3 | 199.3 |
| 42 | 189.7 | 204.7 | 180.7 | 195.7 | 186.9 | 201.9 |
| 44 | 192.0 | 207.0 | 183.2 | 198.2 | 189.4 | 204 |
| 46 | 194.3 | 209.3 | 185.7 | 200.7 | 191.9 | 206 |
| 48 | 196.4 | 211.4 | 188.0 | 203.0 | 194.3 | 209. |
| 50 | 198.6 | 213.6 | 190.3 | 205.3 | 196.6 | 211.6 |
| 52 | 200.6 | 215.6 | 192.6 | 207.6 | 198.8 | 213.8 |
| 54 | 202.6 | 217.6 | 194.8 | 209.8 | 201.0 | 216.0 |
| 56 | 204.5 | 219.5 | 196.9 | 211.9 | 203.1 | 218 |
| 58 | 206.4 | 221.4 | 199.0 | 214.0 | 205.2 | 220 |
| 60 | 208.2 | 223.2 | 201.0 | 216.0 | 207.2 | 222 |
| 62 | 210.0 | 225.0 | 203.0 | 218.0 | 209.2 | 224.2 |
| 64 | 211.8 | 226.8 | 204.9 | 219.9 | 211.1 | 226.1 |
| 66 | 213.5 | 228.5 | 206.8 | 221.8 | 213.0 | 228.0 |
| 68 | 215.2 | 230.2 | 208.7 | 223.7 | 214.9 | 229. |
| 70 | 216.8 | 231.8 | 210.5 | 225.5 | 216.7 | 231 |
| 71 | 217.6 | 232.6 | 211.4 | 226.4 | 217.6 | 232 |

FIG. 36

| Tini [°C] | Tmax_cal UPON APPLICATION OF DOUBLE PULSES 1 [°C] | Tth UPON APPLICATION OF DOUBLE PULSES 1 [°C] | Tmax_cal UPON APPLICATION OF SINGLE PULSE 1 [°C] | Tth UPON APPLICATION OF SINGLE PULSE 1 [°C] | Tmax_c UPON APPLICAT OF DOUB PULSES [°C] |
|---|---|---|---|---|---|
| 10 | 130.4 | 159.3 | 117.6 | 146.5 | 12 |
| 12 | 136.7 | 163.8 | 124.2 | 151.2 | 130 |
| 14 | 142.4 | 167.9 | 130.0 | 155.6 | 136.1 |
| 16 | 147.4 | 171.8 | 135.3 | 159.7 | 141.4 |
| 18 | 152.0 | 175.3 | 140.2 | 163.5 | 146.7 |
| 20 | 156.3 | 178.7 | 144.7 | 167.1 | 150 |
| 22 | 160.2 | 181.9 | 148.9 | 170.5 | 15 |
| 24 | 163.9 | 184.9 | 152.8 | 173.8 | 159 |
| 26 | 167.4 | 187.7 | 156.5 | 176.9 | 162.7 |
| 28 | 170.6 | 190.5 | 160.0 | 179.9 | 166.2 |
| 30 | 173.7 | 193.1 | 163.4 | 182.7 | 169.6 |
| 32 | 176.7 | 195.6 | 166.5 | 185.4 | 172 |
| 34 | 179.5 | 198.0 | 169.6 | 188.1 | 17 |
| 36 | 182.2 | 200.3 | 172.5 | 190.6 | 178 |
| 38 | 184.8 | 202.6 | 175.3 | 193.1 | 181.6 |
| 40 | 187.3 | 204.7 | 178.0 | 195.5 | 184.3 |
| 42 | 189.7 | 206.8 | 180.7 | 197.8 | 186.9 |
| 44 | 192.0 | 208.8 | 183.2 | 200.0 | 189 |
| 46 | 194.3 | 210.8 | 185.7 | 202.2 | 19 |
| 48 | 196.4 | 212.7 | 188.0 | 204.3 | 194 |
| 50 | 198.6 | 214.6 | 190.3 | 206.4 | 196.6 |
| 52 | 200.6 | 216.4 | 192.6 | 208.4 | 198.8 |
| 54 | 202.6 | 218.2 | 194.8 | 210.4 | 201.0 |
| 56 | 204.5 | 219.9 | 196.9 | 212.3 | 203 |
| 58 | 206.4 | 221.6 | 199.0 | 214.2 | 20 |
| 60 | 208.2 | 223.2 | 201.0 | 216.0 | 207 |
| 62 | 210.0 | 224.9 | 203.0 | 217.8 | 209.2 |
| 64 | 211.8 | 226.4 | 204.9 | 219.6 | 211.1 |
| 66 | 213.5 | 228.0 | 206.8 | 221.3 | 213.0 |
| 68 | 215.2 | 229.5 | 208.7 | 223.0 | 214 |
| 70 | 216.8 | 231.0 | 210.5 | 224.7 | 21 |
| 71 | 217.6 | 231.7 | 211.4 | 225.5 | 21 |

....

PRINTING APPARATUS AND INK DISCHARGE FAILURE DETECTION METHOD

CROSS REFERENCE TO RELATED APPLICATIONS

The present application is a continuation of U.S. patent application Ser. No. 11/764,105, filed on Jun. 15, 2007, entitled "PRINTING APPARATUS AND INK DISCHARGE FAILURE DETECTION METHOD", the content of which is expressly incorporated by reference herein in its entirety. This application also claims priority from Japanese Patent Application No. 2006-169382 filed Jun. 19, 2006, which is hereby incorporated by reference herein in its entirety.

BACKGROUND OF THE INVENTION

1. Field of the Invention

The present invention relates to a printing apparatus and ink discharge failure detection method. Particularly, the present invention relates to a printing apparatus which prints by causing film boiling in ink by an electrothermal transducer and discharging ink by the bubbling force, and an ink discharge failure detection method.

2. Description of the Related Art

An inkjet printing apparatus (to be referred to as a printing apparatus hereinafter) prints various kinds of information by discharging ink from the discharge orifices of a printhead onto a printing medium such as paper. This printing apparatus has many advantages such as noise reduction, high-speed printing, and a wide selection of printing media. A type of printhead in which thermal energy acts on ink to discharge ink from the discharge orifices can quickly respond to a printing signal and easily increase both the number of discharge orifices and their integration density.

In a printing apparatus using such a printhead, a discharge failure occurs in the entire printhead or some discharge nozzles due to clogging of a discharge orifice with a foreign substance, bubbles trapped in the ink supply channel, and/or change of the wet condition of the nozzle surface. A discharge failure may also occur owing to disconnection of an electrothermal transducer (heater) or the like upon long-term use.

A full-line printing apparatus in which a number of printing elements are linearly arrayed, corresponding to the overall width of a printing medium can print at high speed. However, it is a key issue to identify a discharge nozzle suffering a discharge failure at high speed and reflect the identification result in image complement and the printhead recovery procedure. A printing apparatus using such a printhead may impair the image stability owing to change of the ink discharge amount upon temperature change of the printhead. Especially, it is very important for the full-line printing apparatus to obtain a high-quality image by suppressing image deterioration upon change of the ink discharge amount.

In consideration of the above importance, there have conventionally been proposed various ink discharge failure detection methods, ink discharge failure complement methods, discharge amount control methods, and apparatuses adopting these methods.

For example, Japanese Patent Laid-Open No. 6-079956 discloses a configuration of detecting a printed image to obtain a faultless image. For this purpose, a predetermined pattern is printed on a detection sheet and read by a reader to detect an abnormal printing element. Japanese Patent Laid-Open No. 6-079956 also discloses a configuration of moving image data assigned to an abnormal printing element, superposing it on image data assigned to another printing element, and thereby complementing printing.

Japanese Patent Laid-Open No. 3-234636 discloses a configuration of making ink discharge states from a full-line inkjet printhead uniform. This configuration employs a detection feature (read head) serving as a photosensor (e.g., an amorphous silicon hydride sensor or CCD), and a setting feature. The detection feature detects whether or not ink was discharged, and the setting feature sets the head on the basis of driving conditions when the detection feature detects ink discharge.

As a method of detecting discharging of ink droplets, Japanese Patent Laid-Open No. 2-194967 discloses a configuration of determining the printing liquid discharge state of each discharge orifice by using a feature for detecting a discharged printing liquid. In this configuration, pairs of light-emitting elements and light-receiving elements are arranged near the two ends of the discharge orifice array of a printhead. Japanese Patent Laid-Open No. 58-118267 discloses a method of detecting an ink discharge state at an ink discharge source. According to this method, conductors are arrayed at positions where the resistance value changes due to heat generated by electrothermal transducers. The change amount of the resistance value depending on the temperature of each conductor is detected, and applying a discharge signal to the electrothermal transducer stops in accordance with the temperature change.

Japanese Patent Laid-Open No. 2-289354 discloses a configuration of detecting ink droplets at the discharge source. For this purpose, electrothermal transducers and temperature sensors are formed on the same base such as a Si substrate, and the film temperature sensors overlap the array area of the electrothermal transducers. Japanese Patent Laid-Open No. 2-289354 also discloses a configuration of determining a discharge failure from change of the resistance value of the temperature sensor depending on temperature change. Further, Japanese Patent Laid-Open No. 2-289354 further discloses a configuration in which film temperature sensors are formed on a heater board by the film forming process, and connected to the outside via terminals by a method such as wire bonding.

However, the method disclosed in Japanese Patent Laid-Open No. 6-079956 cannot detect a discharge failure at high response speed. Moreover, it requires paper for test printing and a reader, raising the apparatus cost and running cost.

In the apparatus disclosed in Japanese Patent Laid-Open No. 3-234636, the detection feature serving as a photosensor (e.g., an amorphous silicon hydride sensor or CCD) must be arranged outside the printhead. The printing apparatus disclosed in Japanese Patent Laid-Open No. 2-194967 requires pairs of light-emitting elements and printing elements arranged near the two ends of the discharge orifice array of a printhead. For this reason, these two prior arts can hardly reduce the apparatus size and cost.

Furthermore, Japanese Patent Laid-Open No. 58-118267 does not explicitly disclose a detection circuit which detects an optimal position where the resistance value changes due to heat generated from an electrothermal transducer, and detects the change amount of the resistance value that depends on the temperature of each conductor. Hence, a specific configuration of identifying a nozzle suffering a discharge failure at high speed is unknown. At a position adjacent to an electrothermal transducer disclosed in this conventional art, it is difficult to detect a nozzle suffering a discharge failure at high speed. This will be described in detail later.

In the printhead disclosed in Japanese Patent Laid-Open No. 2-289354, electrothermal transducers and temperature sensors are formed on the same base such as a Si substrate, and the film temperature sensors overlap the array area of the electrothermal transducers. Thus, a discharge failure is detectable at high speed, but the position of each faulty nozzle cannot be identified.

In the configuration disclosed in Japanese Patent Laid-Open No. 2-289354, the memory stores an enormous amount of resistance value data because all resistance values are stored at each heating time regardless of the presence/absence of heating data. In the analysis, all the resistance value data must be checked to identify heated nozzles from the presence/absence of temperature rise. Then, discharge failure determination starts. If the temperature does not rise, "no heating data" is determined. Even in the presence of heating data, however, if the heater fails due to disconnection or the like, "no heating data" is also determined, and "heater failure" cannot be identified.

SUMMARY OF THE INVENTION

Accordingly, an aspect of the present invention is to overcome the above-described disadvantages of the conventional art. For example, a printing apparatus and ink discharge failure detection method according to this invention are capable of detecting temperature information corresponding to each nozzle at high precision.

According to one aspect of the present invention there is provided a printing apparatus adapted to print on a printing medium by discharging ink from a plurality of nozzles using an inkjet printhead having the plurality of nozzles for discharging ink, a plurality of electrothermal transducers arranged in correspondence with the respective nozzles, and a plurality of sensors for detecting temperatures in correspondence with the respective electrothermal transducers. The printing apparatus includes a measurement unit configured to measure temperatures of the respective electrothermal transducers on the basis of outputs from the plurality of sensors; a prediction unit configured to predict temperatures of the sensors at a predetermined timing during a printing operation on the basis of temperature change profiles of the sensors that are generated by energizing the respective electrothermal transducers; a generation unit configured to generate a plurality of thresholds corresponding to states of the nozzles on the basis of the temperatures predicted by the prediction unit and a driving condition of the inkjet printhead; a measurement control unit configured to control and to execute temperature measurement by the measurement unit at the predetermined timing; a comparison unit configured to compare a temperature measured by the measurement unit under the control of the measurement control unit with the respective thresholds generated by the generation unit; and an identifying unit configured to identify the states of the nozzles on the basis of comparison results by the comparison unit.

According to another aspect of the present invention there is provided an ink discharge failure detection method for an inkjet printhead configured to print on a printing medium by discharging ink from a plurality of nozzles, the inkjet printhead including the plurality of nozzles for discharging ink, a plurality of electrothermal transducers arranged in correspondence with the respective nozzles, and a plurality of sensors for detecting temperatures in correspondence with the respective electrothermal transducers. Here, the method includes measuring temperatures of the respective electrothermal transducers on the basis of outputs from the plurality of sensors; predicting temperatures of the electrothermal transducers at a predetermined timing during a printing operation on the basis of temperature change profiles of the respective electrothermal transducers that are generated by energizing the respective electrothermal transducers; generating a plurality of thresholds corresponding to states of the nozzles on the basis of the predicted temperatures and a driving condition of the inkjet printhead; controlling the measuring of the temperatures of the respective electrothermal transducers to be executed at the predetermined timing; comparing the measured temperatures of the respective electrothermal transducers, which were executed at the predetermined timing, with the respectively generated thresholds; and identifying the states of the nozzles on the basis of comparison results.

The invention is particularly advantageous since the state of each nozzle of an inkjet printhead can be identified accurately. For example, a state in which ink attaches to the nozzle surface, a state in which a bubble remains in a nozzle, a state in which a nozzle is clogged with a foreign substance, and a state in which a nozzle orifice is clogged with a foreign substance can be identified accurately. The user can take a proper measure such as the recovery procedure in accordance with these states.

Further features and aspects of the present invention will become apparent from the following description of exemplary embodiments (with reference to the attached drawings).

BRIEF DESCRIPTION OF THE DRAWINGS

FIG. 18 is a lookup table of the initial nozzle temperature and expected highest nozzle temperature in nozzle temperature estimation calculation;

FIG. 19 is a lookup table of the initial nozzle temperature, expected highest nozzle temperature, and discharge failure determination threshold in nozzle discharge failure determination calculation;

FIG. 28 is a lookup table of the initial nozzle temperature and expected highest nozzle temperature in nozzle temperature estimation calculation used in the fifth embodiment of the present invention;

FIG. 29 is a lookup table of the initial nozzle temperature, expected highest nozzle temperature, and discharge failure determination threshold in nozzle discharge failure determination calculation used in the fifth embodiment of the present invention;

FIG. 36 is a lookup table of the initial nozzle temperature, expected highest nozzle temperature, and discharge failure determination threshold in nozzle discharge failure determination calculation according to the sixth embodiment of the present invention;

DESCRIPTION OF THE EMBODIMENTS

Various embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally may be construed as a set of a discharge orifice, a liquid channel connected to the orifice and an element to generate energy utilized for ink discharge.

An example of an inkjet printing apparatus commonly adopted in several embodiments to be described below will be first explained.

Figure 1:
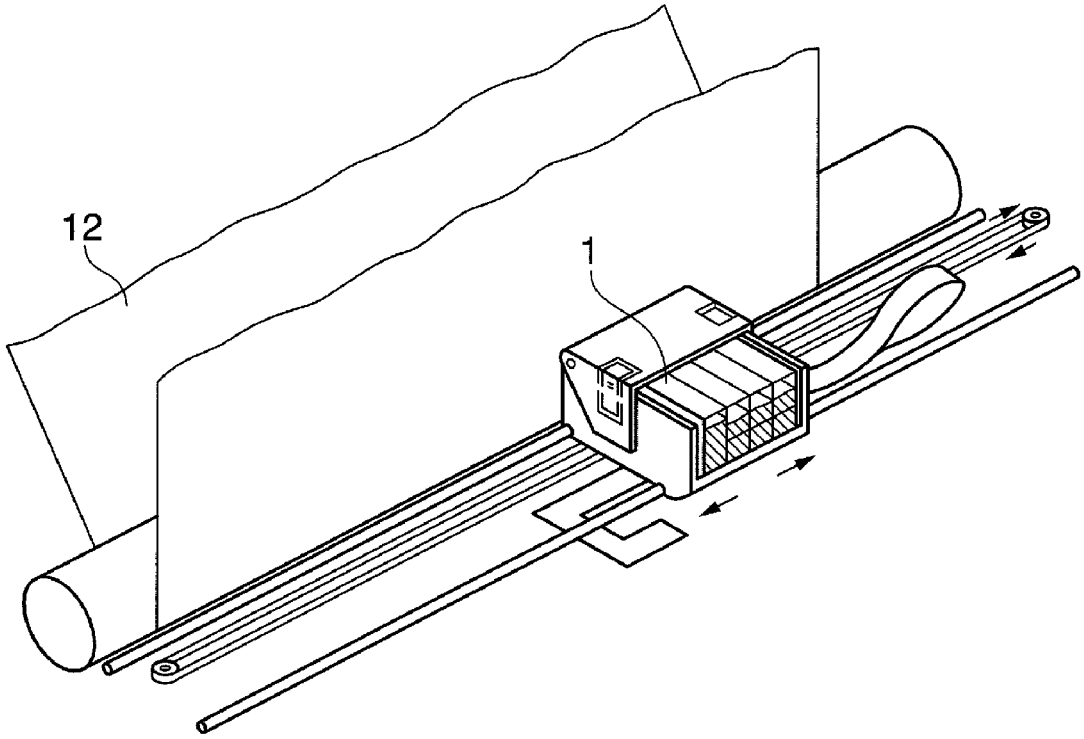
FIG. 1 is a schematic perspective view showing the outer appearance of an inkjet printing apparatus as a typical embodiment of the present invention.

FIG. 1 is a schematic perspective view showing the appearance of a serial inkjet printing apparatus capable of color printing as a typical embodiment of the present invention. A printhead 1 has a plurality of nozzle arrays. The printhead 1 prints an image by discharging ink droplets and forming dots by them on a printing medium 12.

Figure 2A:
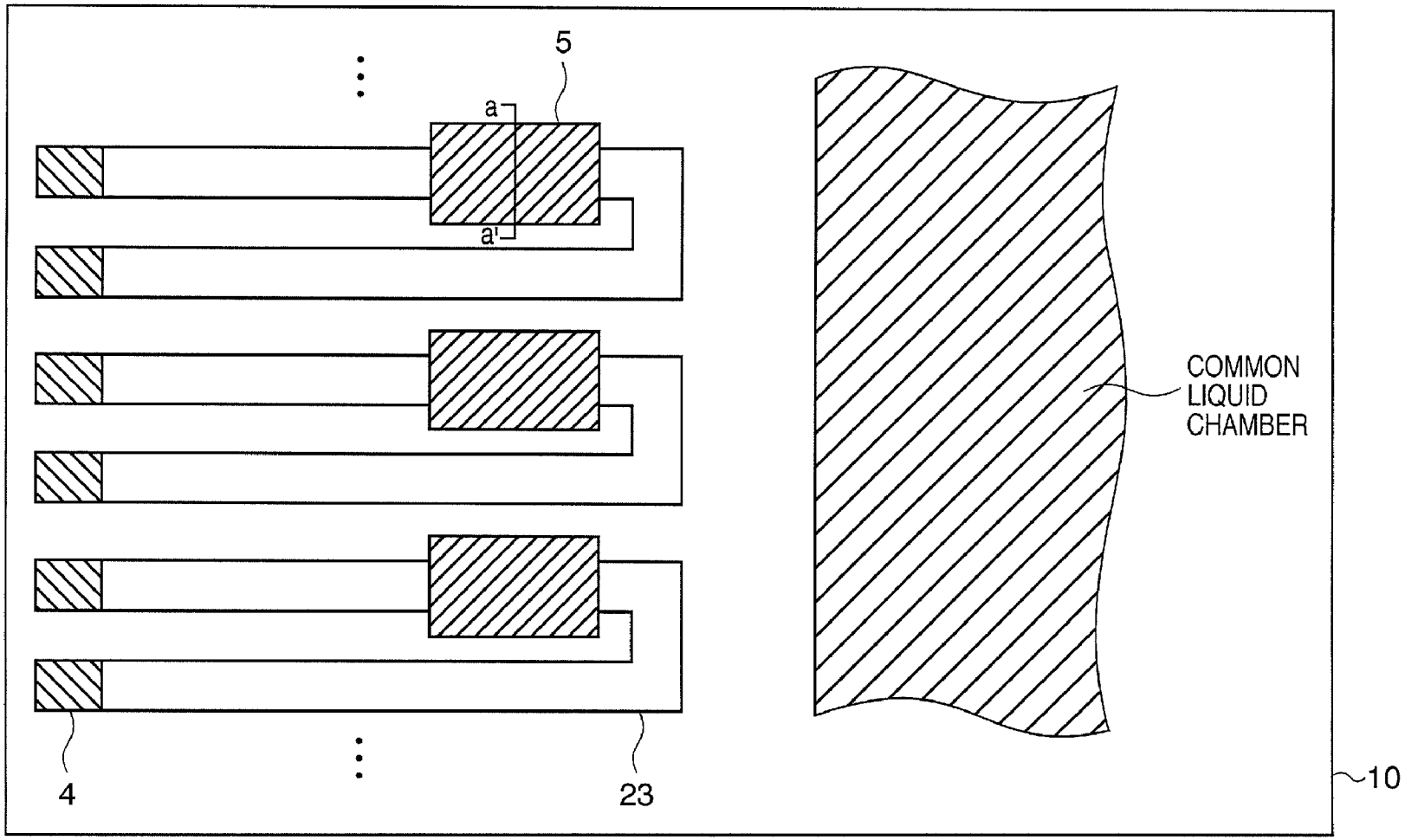
FIG. 2A is a partial plan view schematically showing the head substrate of an inkjet printhead having a temperature sensor.
Figure 2B:
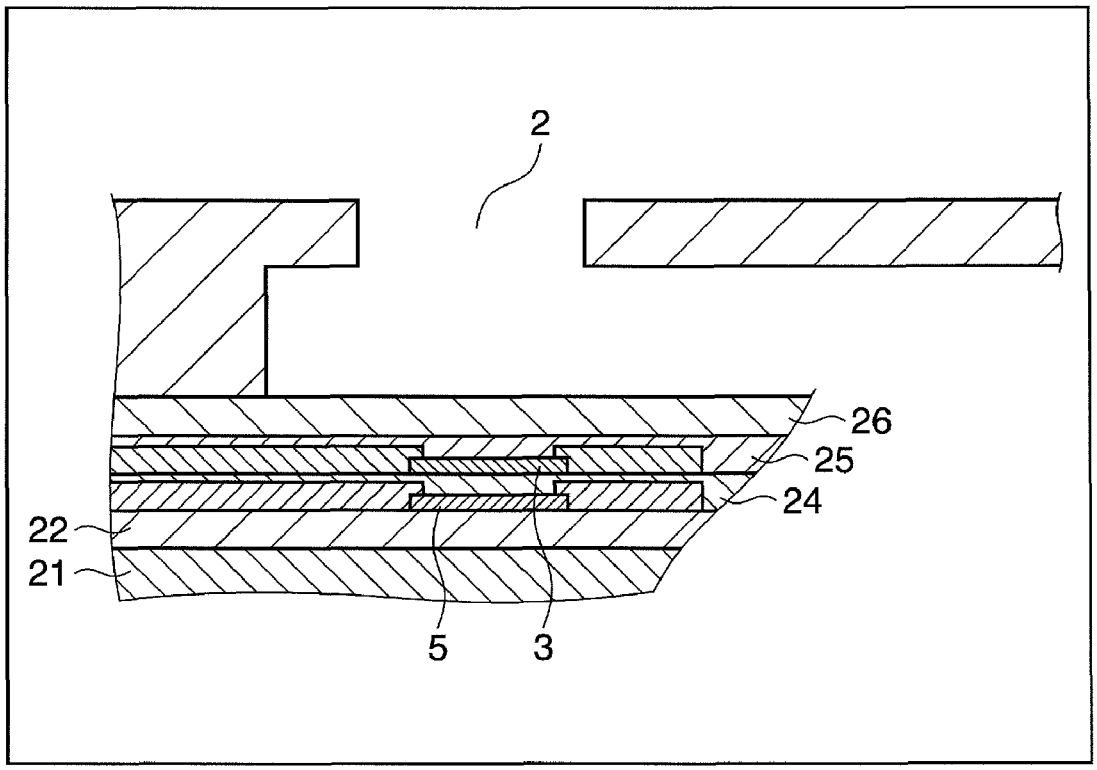
FIG. 2B is a partial sectional view schematically showing the head substrate of the inkjet printhead having the temperature sensor.

FIGS. 2A and 2B are a partial plan view and sectional view, respectively, schematically showing the head substrate of an inkjet printhead 1 (to be referred to as a printhead hereinafter) having temperature sensors. This printhead substrate is applicable as a substrate of a printhead mounted in the printing apparatus shown in FIG. 1.

More details of the printhead 1 will now be explained. Electrothermal transducers (to be referred to as heaters 3 hereinafter) which generate thermal energy upon application of a voltage are arranged on a heater board 10 for respective discharge orifices in order to discharge ink droplets from an array of discharge orifices 2. A driving signal is supplied to heat the heaters 3 and discharge ink droplets. The heater board 10 has an array of the heaters 3, and a dummy resistor (not shown) not used to discharge an ink droplet is arranged near the heater array.

In FIG. 2A, terminals 4 are connected to the outside by wire bonding. Temperature sensors (to be referred to as sensors) 5 are formed on the heater board 10 by the same film forming process as that of the heaters 3 and the like.

FIG. 2B is a partial sectional view of a section a-a' including the sensor 5 in FIG. 2A. Individual interconnections 23 of Al or the like for interconnection with the sensors 5, and an Al interconnection are formed on a heat reservoir layer 22 of an $SiO_2$ thermal oxide film or the like on an Si substrate 21. Each sensor 5 is formed from a thin film resistor whose resistance value changes depending on the temperature. The Al interconnection connects the heaters 3 to a control circuit formed on the Si substrate 21. The thin film resistor is made of Al, Pt, Ti, TiN, TiSi, Ta, TaN, TaSiN, TaCr, Cr, CrSi, CrSiN, W, $WSi_2$, WN, poly-Si, α-Si, Mo, MoSi, Nb, Ru, or the like. Further, the electrothermal transducers (heaters 3), a passivation film 25 of SiN or the like, and an anticavitation film 26 of Ta or the like are stacked on an interlayer insulation film 24 on the Si substrate 21 at high density by a semiconductor process. The anticavitation film 26 enhances the anticavitation property on the heater 3.

The sensors 5 each formed as a thin film resistor are individually arranged immediately below corresponding heaters 3. The individual interconnections 23 connected to the respective sensors are formed as part of a detection circuit which detects sensor information.

According to the embodiment, the Al interconnection which connects the heaters 3 to the control circuit formed on the Si substrate 21 is formed on the heat reservoir layer 22 of an $SiO_2$ thermal oxide film or the like on the Si substrate 21. The sensors 5 and individual interconnections 23 are film-formed by patterning on the heat reservoir layer 22 on which the heaters 3, the passivation film 25 of SiN or the like, and the anticavitation film 26 of Ta or the like for enhancing the anticavitation property on the heater are formed on the interlayer insulation film 24. This structure has a significant advantage to production because the printhead according to the embodiment can be manufactured without changing a conventional printhead structure.

In the embodiment, the planar shape of the sensor 5 is a square. Alternatively, the sensor 5 may be formed into a serpentine shape to set a high resistance value in order to output a high voltage value even upon a small temperature change.

Figure 3:
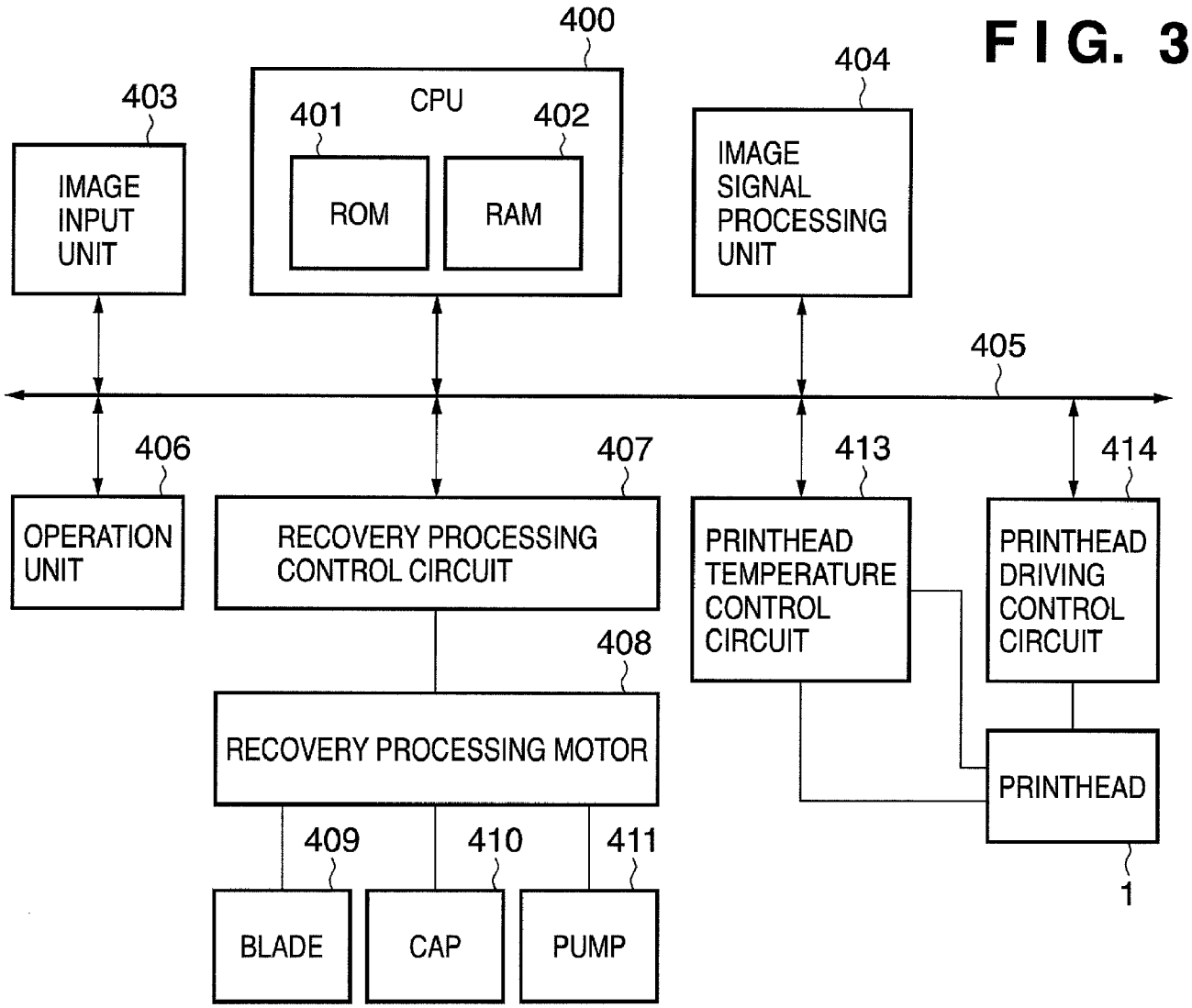
FIG. 3 is a block diagram showing the control configuration of the printing apparatus shown in FIG. 1.

FIG. 3 is a block diagram showing the control circuit of the printing apparatus. The control circuit is roughly divided into a circuit group which functions by executing software, and a circuit which activates a mechanical operation. The circuit group includes an image input unit 403, corresponding image signal processing unit 404, and CPU 400 which respectively access a main bus 405.

The CPU 400 generally has a ROM 401 and RAM 402. The CPU 400 executes control to drive the printhead 1 and print by giving proper printing conditions in accordance with input information. The ROM 401 pre-stores a program to execute a printhead recovery procedure, and if necessary, supplies recovery conditions such as preliminary discharge conditions to a recovery processing control circuit 407, the printhead 1, and the like. A recovery processing motor 408 drives the printhead 1, and a (cleaning) blade 409, cap 410, and suction pump 411 which face the printhead 1. Also, an operation unit 406 is in communication with the main bus 405.

A printhead driving control circuit 414 drives the heater 3 of the printhead 1 under driving conditions given by the CPU 400, and causes the printhead 1 to perform preliminary discharge and discharge of printing ink. A printhead temperature control circuit 413 is in communication with the printhead 1 and the main bus 405.

Figure 4A:
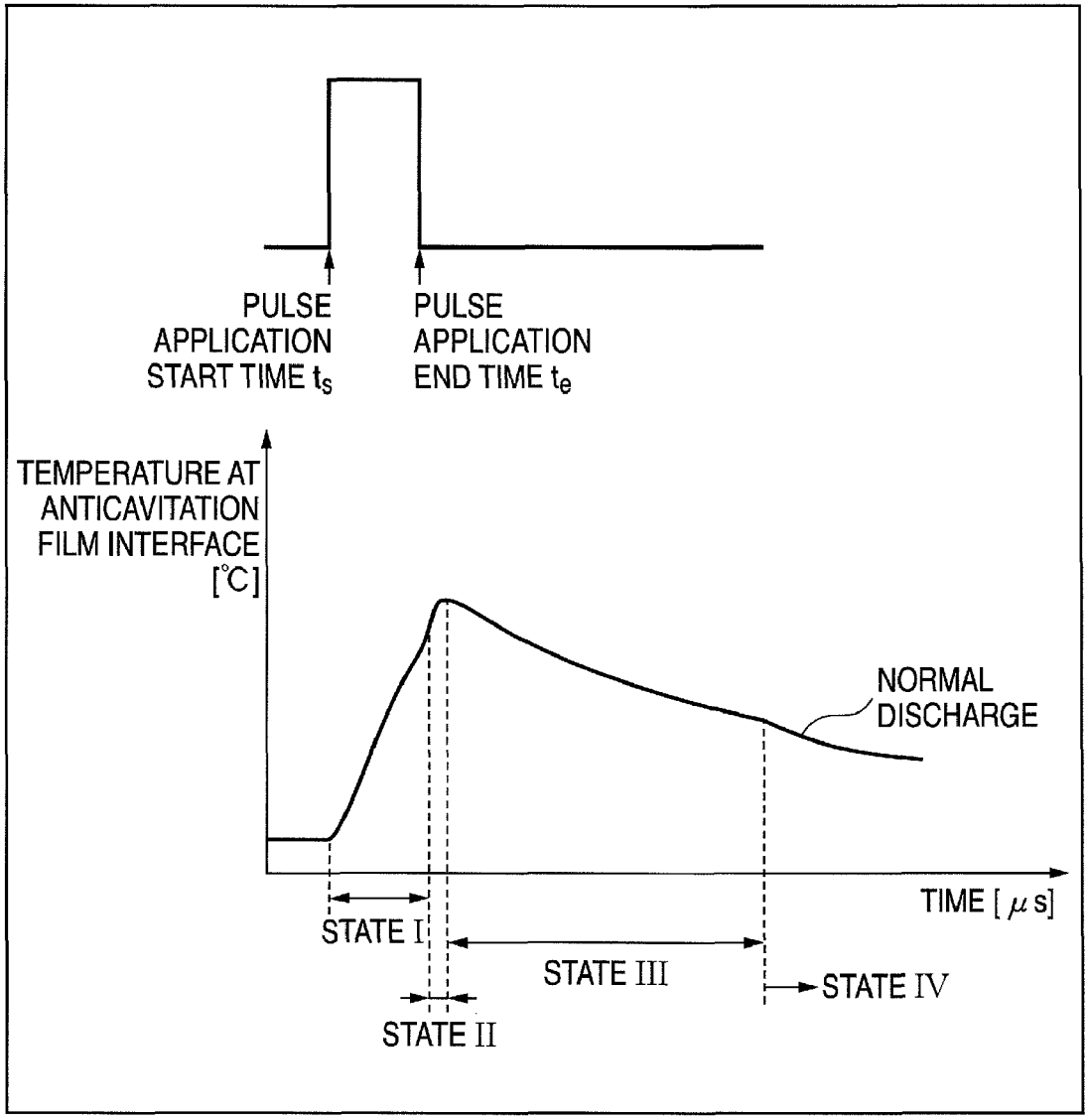
FIG. 4A is a graph showing a temperature profile at the ink-anticavitation film interface when ink is discharged normally.
Figure 4B:
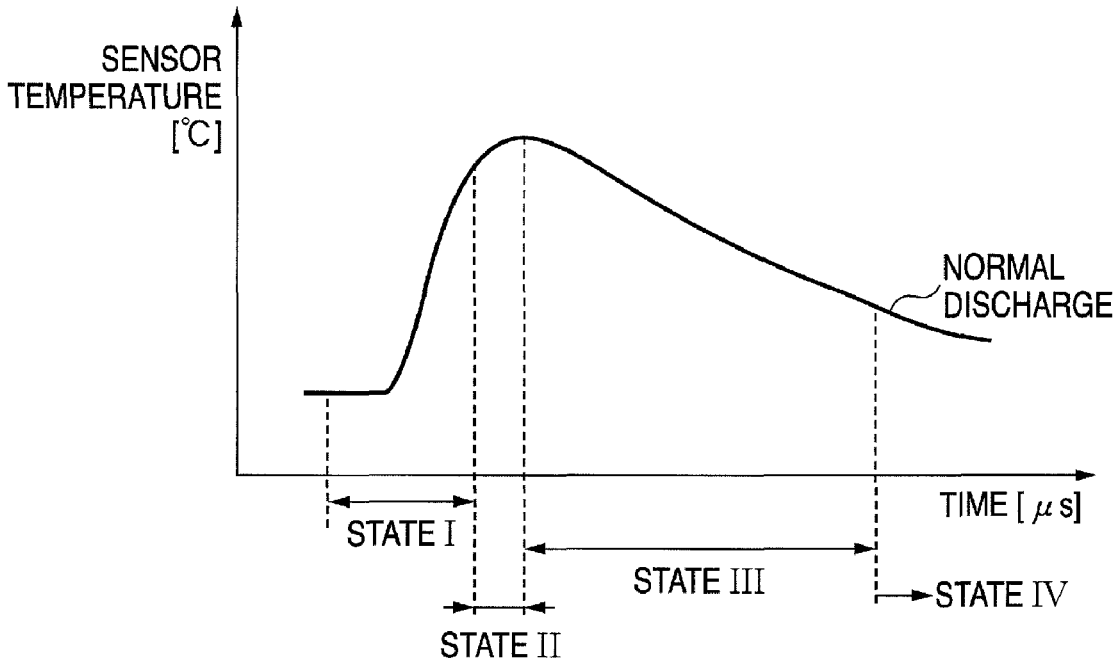
FIG. 4B is a graph showing a temperature profile at the temperature sensor when ink is discharged normally.

FIG. 4A is a graph showing a temperature profile at the ink-anticavitation film interface when ink is discharged normally. FIG. 4B is a graph showing a temperature profile at the temperature sensor.

In normal discharge, the temperature of the heater 3 rises abruptly upon application of a pulse to the heater 3. With a small time difference after the temperature rise, the temperature at the ink-anticavitation film interface also rises (state I).

When the temperature at the ink-anticavitation film interface reaches the ink bubbling temperature, bubbles are generated and grow. Generated bubbles prevent the anticavitation film 26 from contacting ink. The thermal conductivity ($\lambda_{gas}$) of bubbles is smaller by one order of magnitude than the thermal conductivity ($\lambda_{liquid}$) of ink. While bubbles exist between ink and the anticavitation film, almost all heat generated by the heater 3 is accumulated in the heater board.

As a result, the temperature at the gas-anticavitation film interface rises abruptly. The temperature rise of the heater 3 stops at the stop of pulse application, and then the temperature rise at the gas-anticavitation film interface also stops (state II). After that, both the temperatures at the heater and gas-anticavitation film interface decrease (state III). Upon the lapse of a predetermined time, the anticavitation film 26 contacts ink again along with bubble shrinkage, and the temperature drops at higher speed to the initial state (state IV).

Since the interlayer insulation film 24 is interposed between the heater and the temperature sensor, heat transfers from the heater with a delay. For this reason, the periods of states I to IV shown in FIG. 4A are different from those of states I to IV shown in FIG. 4B.

According to the embodiment, the simulation and experiment reveal that the internal nozzle temperature can be detected at high speed and high precision when the sensor 5 is formed immediately below the heater 3 through the interlayer insulation film 24.

Processing to detect the discharge failure of a printhead will be explained using the printing apparatus with the above-described structure as a common embodiment.

First Exemplary Embodiment

Figure 5:
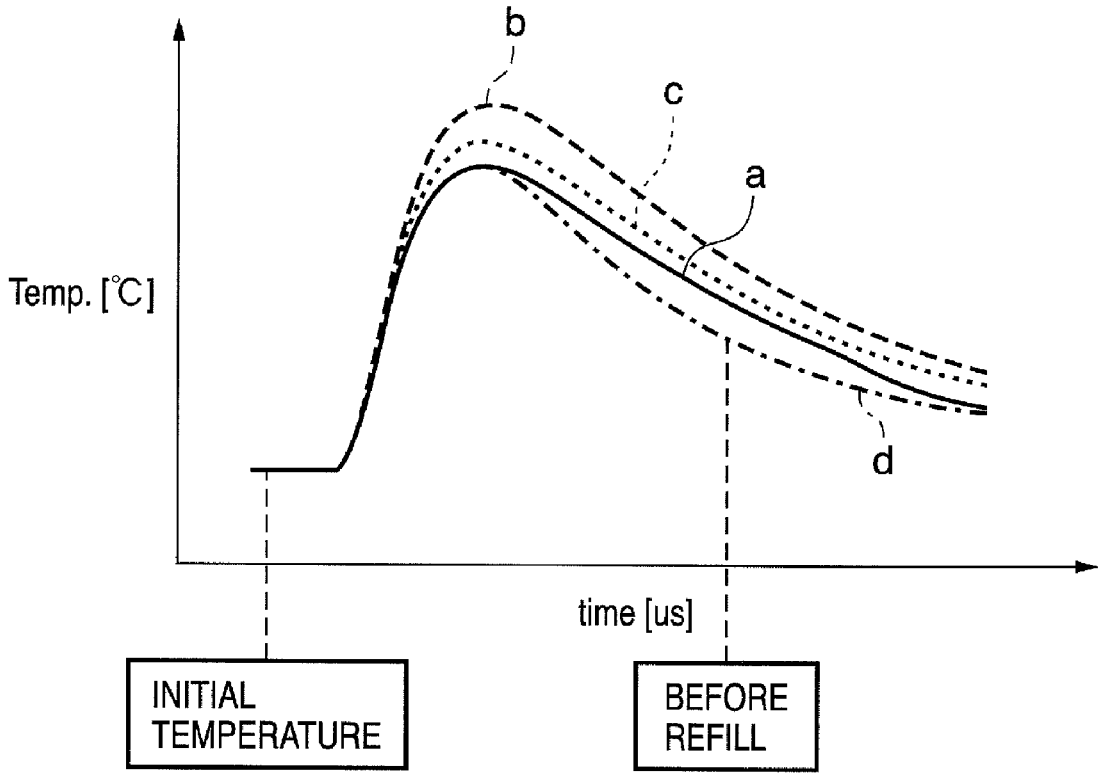
FIG. 5 is a graph showing temperature changes of the sensor temperature in respective discharge abnormality states.

FIG. 5 is a graph showing the temperature profile of a sensor 5 when a 20-V pulse is applied to a 360-Ω heater at the initial temperature ($T_{ini}$) of the nozzle=25° C. for 0.80 μsec [pulse application time (from $t_s$ to $t_e$)]. Further, FIG. 5 shows sensor temperature profiles in a normal ink discharge state and respective abnormal discharge states. Note that FIG. 5 shows a temperature change upon performing the discharge operation once.

In FIG. 5, "a" represents a temperature profile in normal discharge; b represents a temperature profile upon occurrence of a discharge abnormality by a residual bubble in the nozzle; c represents a temperature profile upon occurrence of a discharge abnormality by an ink refill failure due to impurities deposited in the liquid channel; and d represents a temperature profile upon occurrence of a discharge abnormality by ink attached to the nozzle surface.

Figure 6:
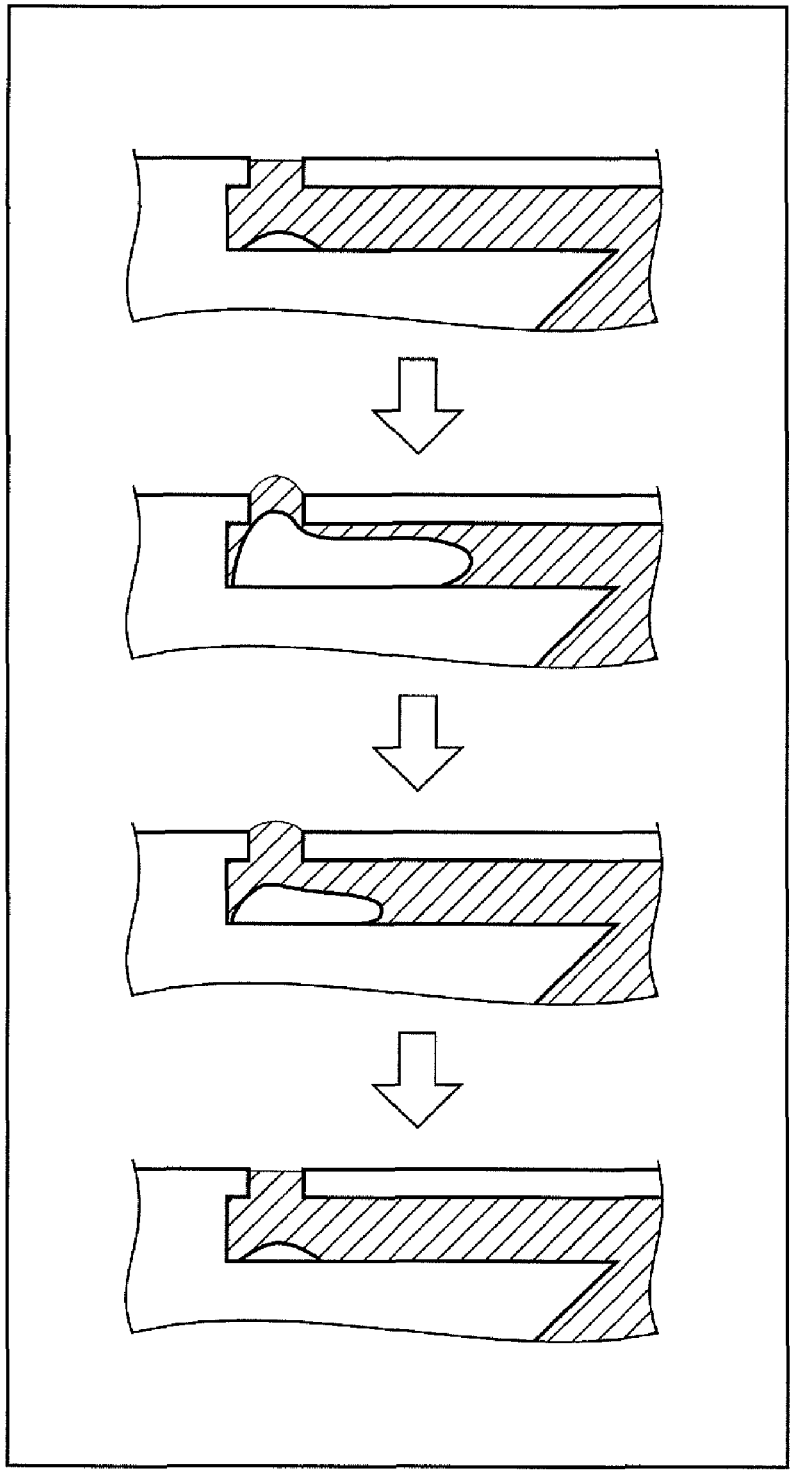
FIG. 6 is a schematic view showing the internal state of a nozzle upon occurrence of a discharge abnormality caused by a residual bubble in a nozzle.

FIG. 6 is a sectional view showing the internal state of the nozzle in the case of temperature profile b of FIG. 5. In this state, small bubbles aggregate into a large bubble due to various causes, and the large bubble above the anticavitation film causes a discharge abnormality. In this state, heat hardly transfers from the anticavitation film to gas and is accumulated in the heater board. Hence, the temperature detected by the sensor is higher than that in normal discharge.

Figure 7:
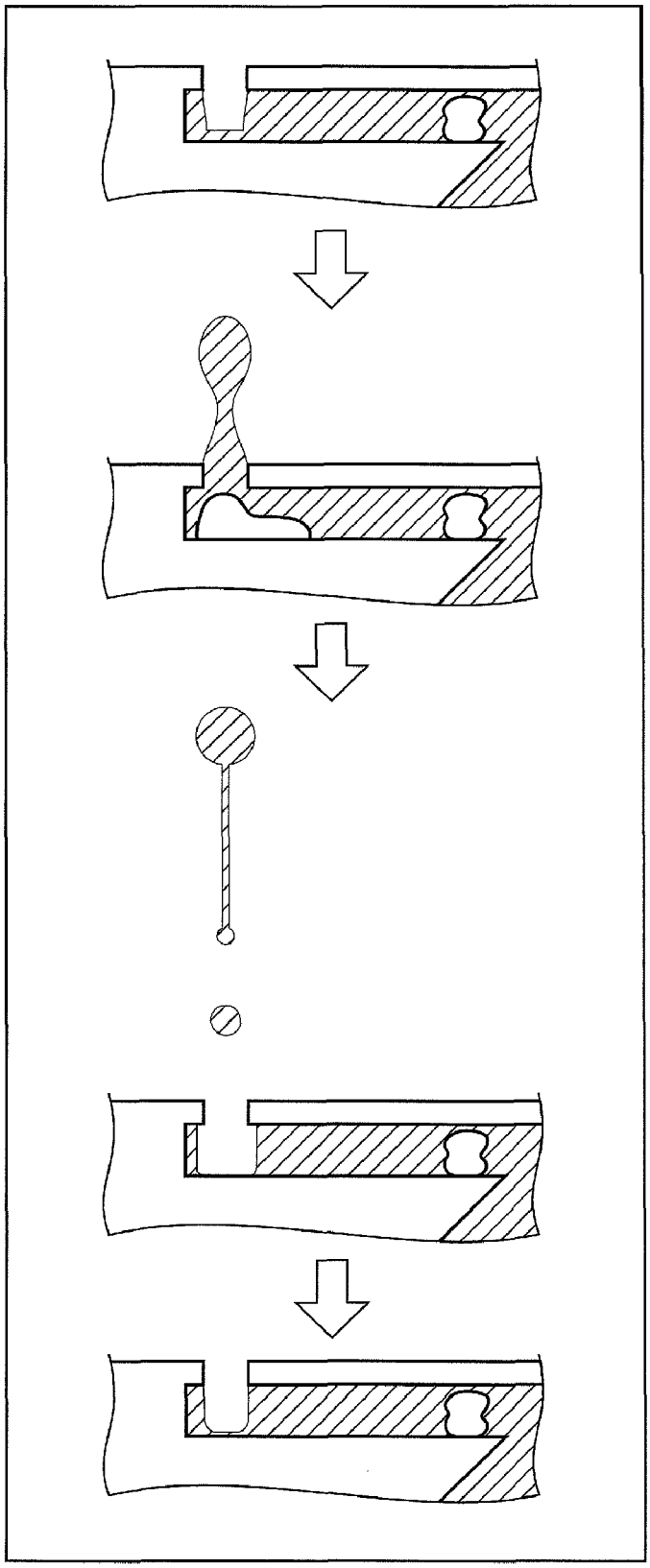
FIG. 7 is a schematic view showing the internal state of a nozzle upon occurrence of a discharge abnormality caused by an ink refill failure due to impurities deposited in the liquid channel.

FIG. 7 is a sectional view showing the internal state of the nozzle in the case of temperature profile c of FIG. 5. In this state, impurities deposit in the liquid channel, and no ink can be refilled till application of the next driving signal, causing a discharge abnormality. In this case, heat transfers to ink more than in the state shown in FIG. 6 because an small amount of ink exists on the anticavitation film. The temperature detected by the temperature sensor is higher than that in normal discharge, but lower than that in the abnormal discharge state in which a bubble exists above the anticavitation film.

Figure 8:
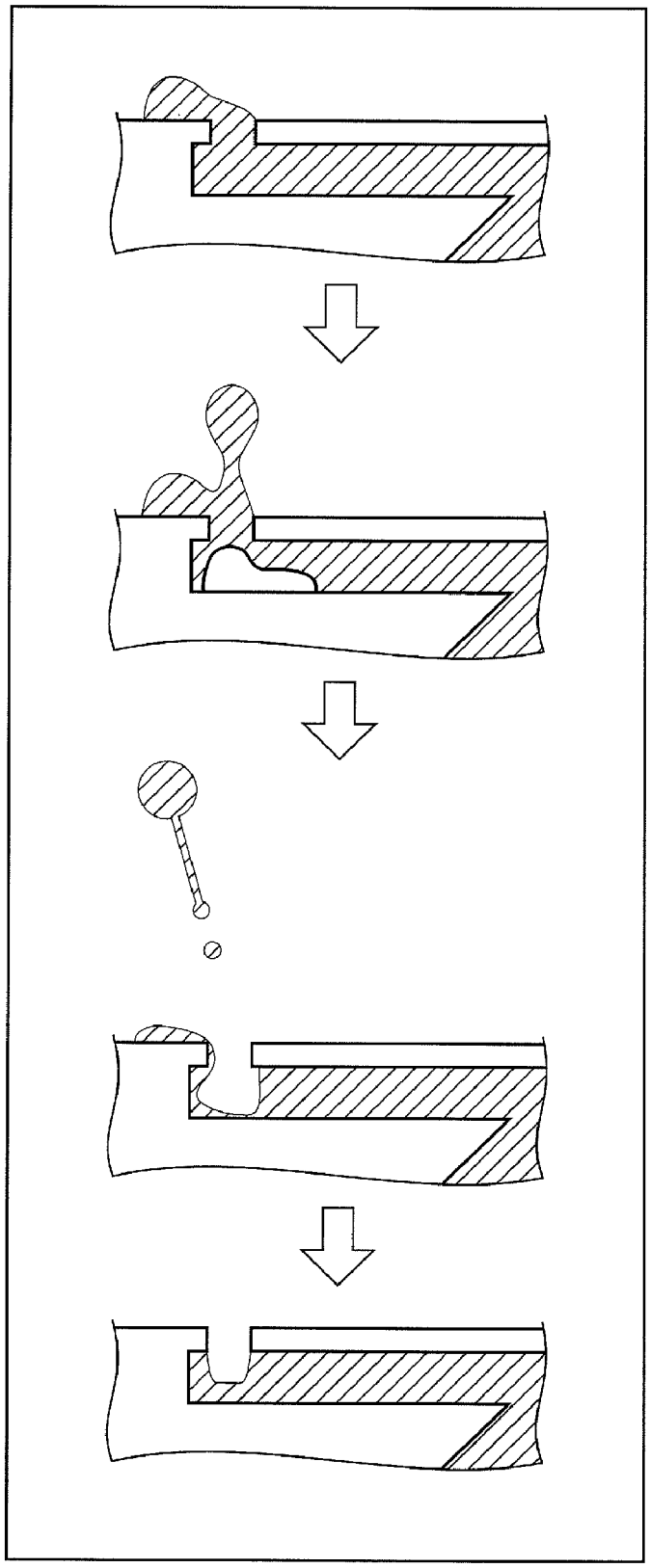
FIG. 8 is a schematic view showing the internal state of a nozzle upon occurrence of a discharge abnormality caused by ink attached to the nozzle surface.

FIG. 8 is a sectional view showing the internal state of the nozzle in the case of temperature profile d of FIG. 5. Upon discharging an ink droplet, its tail is transformed into a tiny droplet because of the surface tension of ink itself, generating a secondary ink droplet (to be referred to as a satellite hereinafter) or a misty ink droplet (to be referred to as mist hereinafter) in addition to an original droplet necessary for printing. The satellite or mist attaches to the periphery of the discharge orifice of the printhead, inhibits ink discharge, and causes a discharge abnormality such as deviation of the discharged position. Ink attached to the nozzle surface is drawn into the discharge orifice along with the retraction of the meniscus. Consequently, ink contacts the anticavitation film earlier than the ink refill timing in the normal discharge state.

Until ink attached to the nozzle surface contacts the anticavitation film, the sensor detection temperature exhibits the same temperature profile as that in normal discharge. After ink attached to the nozzle surface contacts the anticavitation film, the sensor detection temperature drops faster than that in normal discharge.

Sensor detection temperatures in the respective discharge states are compared during the period (defined as "before refill") until the sensor shows a temperature change upon contact between ink and the anticavitation film in normal discharge after the sensor detection temperature reaches a maximum value, as shown in FIG. 5.

More specifically, the temperature T(br_normal) in normal discharge is 85° C., and the temperature T(br_residual bubble) upon occurrence of a discharge abnormality by the residual bubble in the nozzle is 105° C. The temperature T(br_liquid channel clogging) upon occurrence of a discharge abnormality by an ink refill failure due to impurities deposited in the liquid channel is 95° C. The temperature T(br_surface attachment) upon occurrence of a discharge abnormality by ink attached to the nozzle surface is 70° C. From these results, a temperature T(br_cal) to be detected by the sensor at the timing before refill in normal discharge is predicted to set T(br_cal)+Tα (arbitrary value)=Tth(br). This setting facilitates discrimination between normal discharge and abnormal discharge. In addition, each discharge abnormality can be identified in detail, so a recovery operation suitable to each abnormal discharge state can be executed.

Figure 9A:
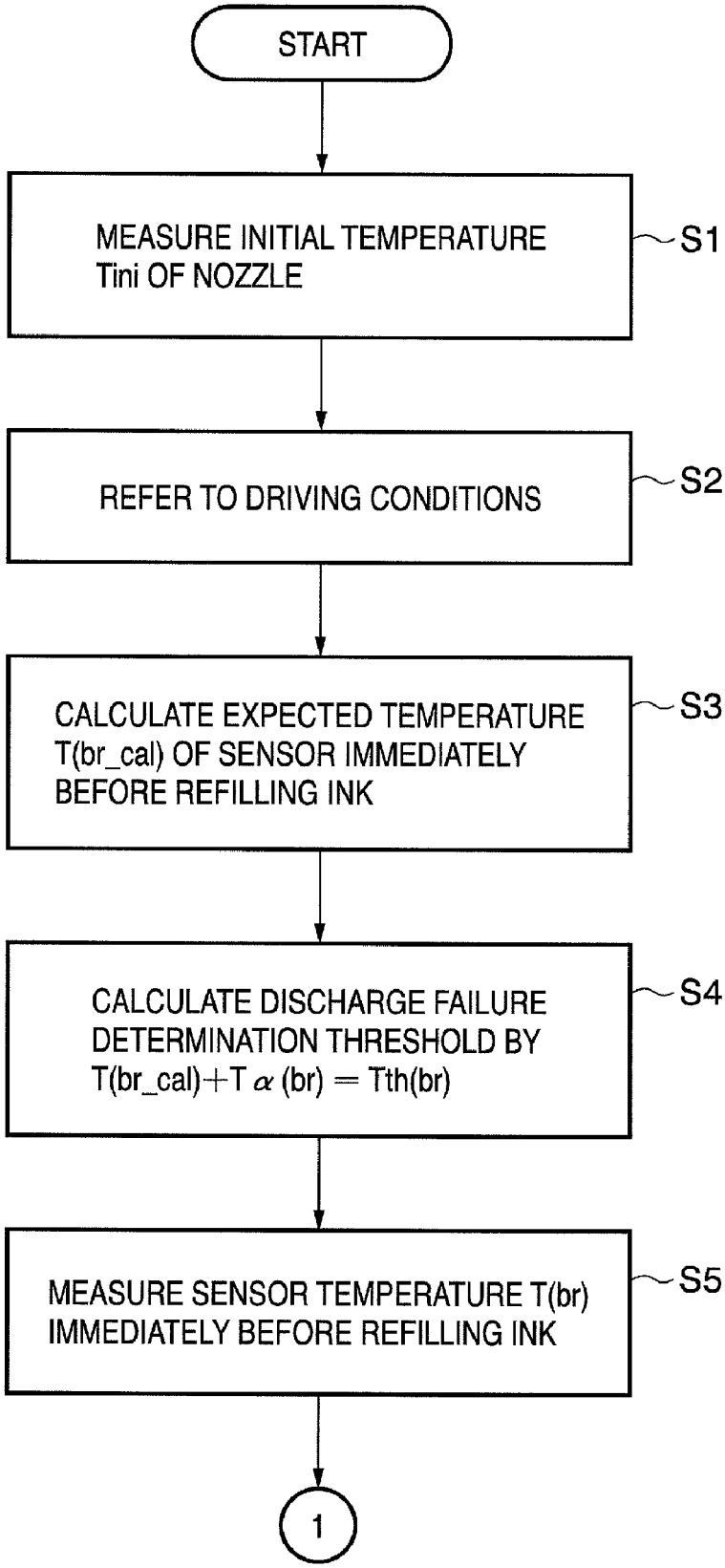
FIGS. 9A and 9B are flowcharts showing nozzle discharge failure determination processing according to the first embodiment of the present invention.
Figure 9B:
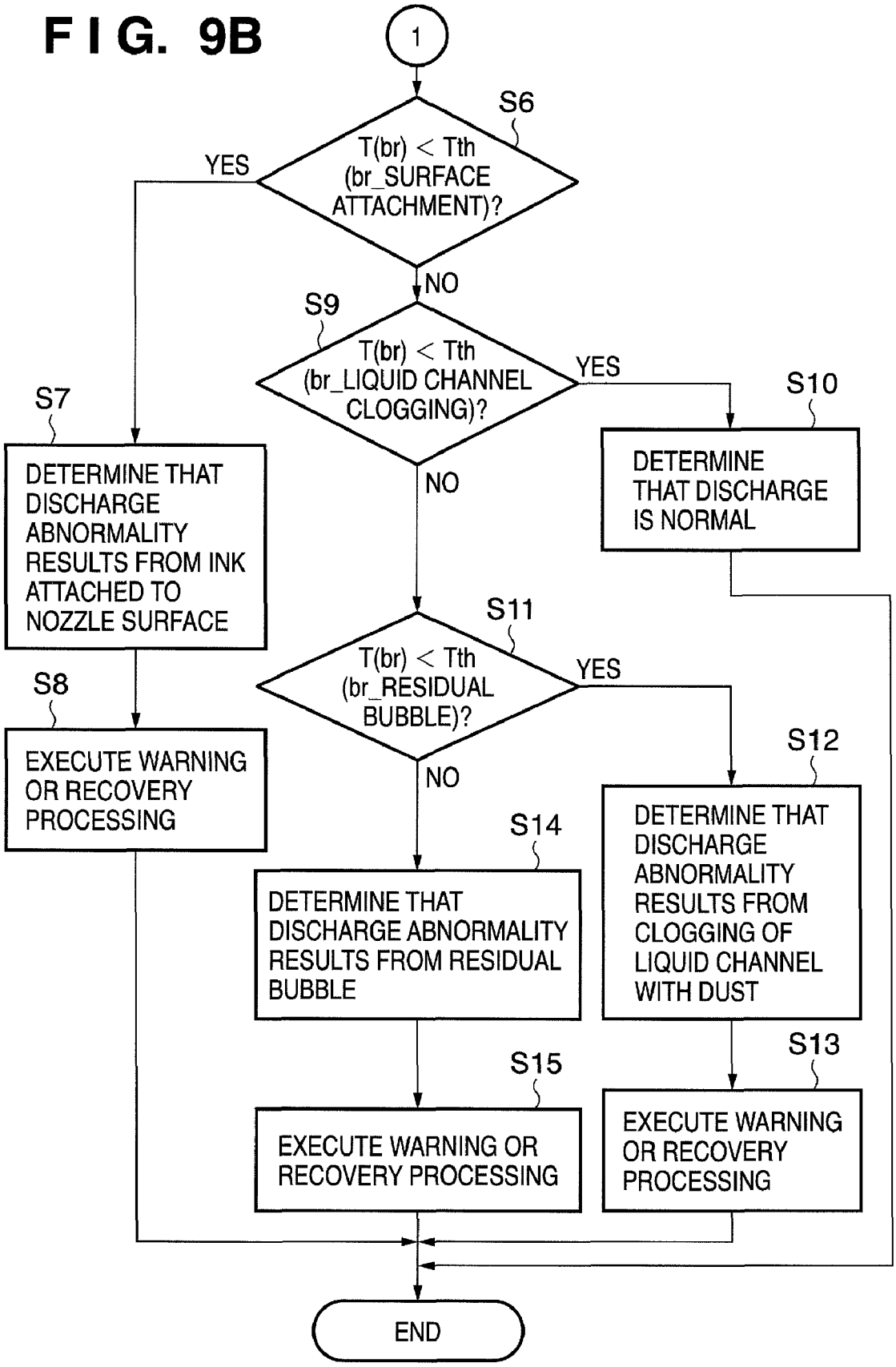

FIGS. 9A and 9B are flowcharts showing nozzle discharge failure determination processing according to the first embodiment. Discharge failure determination processing will be explained with reference to FIGS. 5, 9A and 9B.

In step S1, the initial temperature ($T_{ini}$) of the nozzle immediately before applying a driving signal is measured. In step S2, driving conditions (application pulse width, type of application pulse, and application voltage value) set to the nozzle are referred to.

In step S3, the expected temperature T(br_cal) of the sensor before refill is calculated using the initial temperature ($T_{ini}$) of the nozzle measured in step S1 and information on the driving conditions referred to in step S2. In step S4, the threshold adjustment factor Tα is added to the expected temperature T(br_cal) of the sensor before refill calculated from the initial temperature ($T_{ini}$) of the nozzle and the driving conditions. The threshold adjustment factor Tα is derived from the initial nozzle temperature and the information on the driving conditions, and used to make different discharge failure determinations depending on each discharge state.

Using the sum, discharge failure determination thresholds before refill are calculated by equation (1). These thresholds are the threshold Tth(br_residual bubble) to determine a discharge failure caused by the residual bubble, the threshold Tth(br_liquid channel clogging) to determine a discharge failure caused by clogging of the liquid channel with dust, and the threshold Tth(br_surface attachment) to determine a discharge abnormality caused by ink attached to the nozzle surface.

$$Tth(br_\text{residual bubble})=T(br_cal)+T\alpha(br_\text{residual bubble})$$

$$Tth(br_\text{liquid channel clogging})=T(br_cal)+T\alpha(br_\text{liquid channel clogging})$$

$$Tth(br_\text{surface attachment})=T(br_cal)+T\alpha(br_\text{surface attachment}) \quad (1)$$

In step S5, the sensor temperature T(br) before refill is measured. In step S6, the sensor temperature T(br) before refill measured in step S5 is compared with the threshold Tth(br_surface attachment) calculated in step S4 to determine a discharge abnormality caused by ink attached to the nozzle surface.

If T(br)<Tth(br_surface attachment) holds, the process advances to step S7 to determine that the discharge abnormality results from ink attached to the nozzle surface. In step S8, warning or recovery processing corresponding to the abnormal discharge state is executed. To the contrary, if T(br)≧Tth (br_surface attachment) holds, the process advances to step S9 to compare the sensor temperature T(br) before refill with the threshold Tth(br_liquid channel clogging) calculated in step S4 to determine a discharge failure caused by clogging of the liquid channel with dust. If T(br)<Tth(br_liquid channel clogging) holds, the process advances to step S10 to determine that the discharge is normal.

If T(br)≧Tth(br_liquid channel clogging) holds, the process advances to step S11 to compare the sensor temperature T(br) before refill with the threshold Tth(br_residual bubble) calculated in step S4 to determine a discharge failure caused by the residual bubble. If T(br)<Tth(br_residual bubble) holds, the process advances to step S12 to determine that the discharge abnormality results from clogging of the liquid channel with dust. The process advances to step S13 to execute warning or recovery processing corresponding to the abnormal discharge state. If T(br)≧Tth(br_residual bubble) holds, the process advances to step S14 to determine that the discharge abnormality results from the residual bubble. The process advances to step S15 to execute warning or recovery processing corresponding to the abnormal discharge state.

According to the above-described first embodiment, the sensor detection temperature immediately before refilling ink is compared with a plurality of thresholds. As a result, the cause of an ink discharge abnormality can be identified to execute warning or recovery processing suitable to the cause.

Second Exemplary Embodiment

Figure 10:
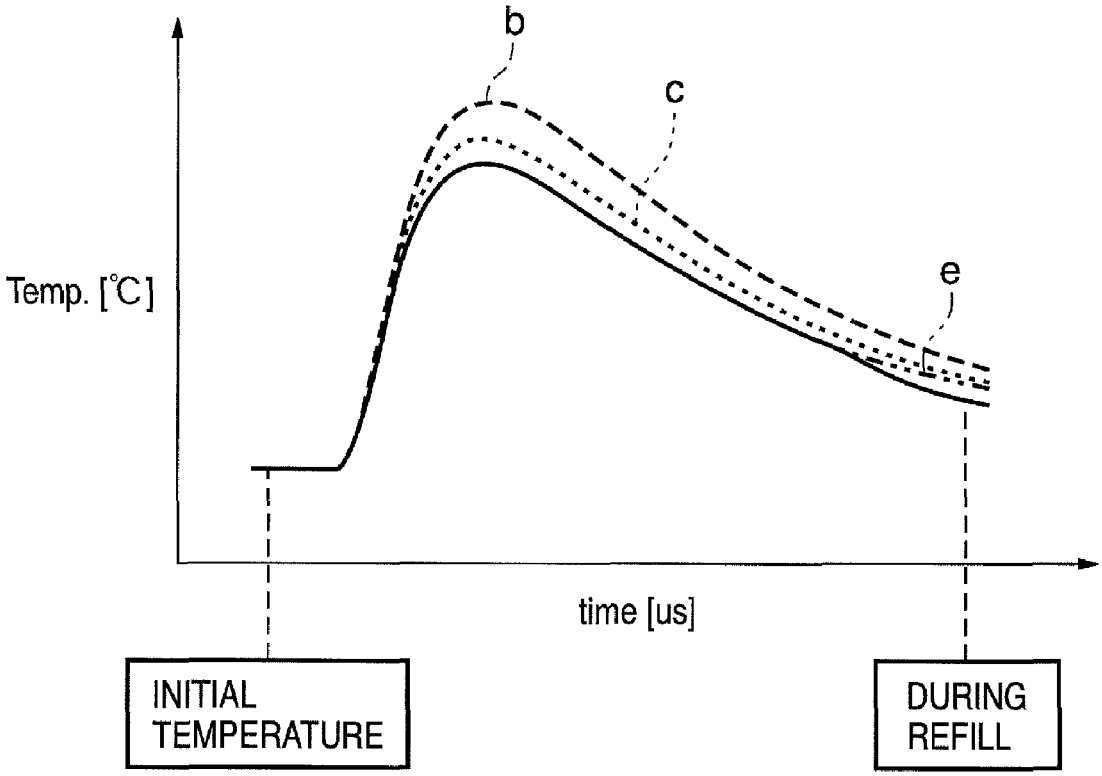
FIG. 10 is a graph showing temperature changes of the sensor temperature in respective discharge abnormality states.

FIG. 10 is a graph showing the temperature profile to explain the second embodiment, and is a graph showing sensor temperature profiles in a normal ink discharge state and respective abnormal discharge states. Note that FIG. 10 shows a temperature change upon performing the discharge operation once.

In FIG. 10, b represents a temperature profile upon occurrence of a discharge abnormality by the residual bubble in the nozzle; c represents a temperature profile upon occurrence of a discharge abnormality by an ink refill failure due to impurities deposited in the liquid channel; and e represents a temperature profile upon occurrence of a discharge abnormality by clogging of a discharge orifice with impurities.

Figure 11:
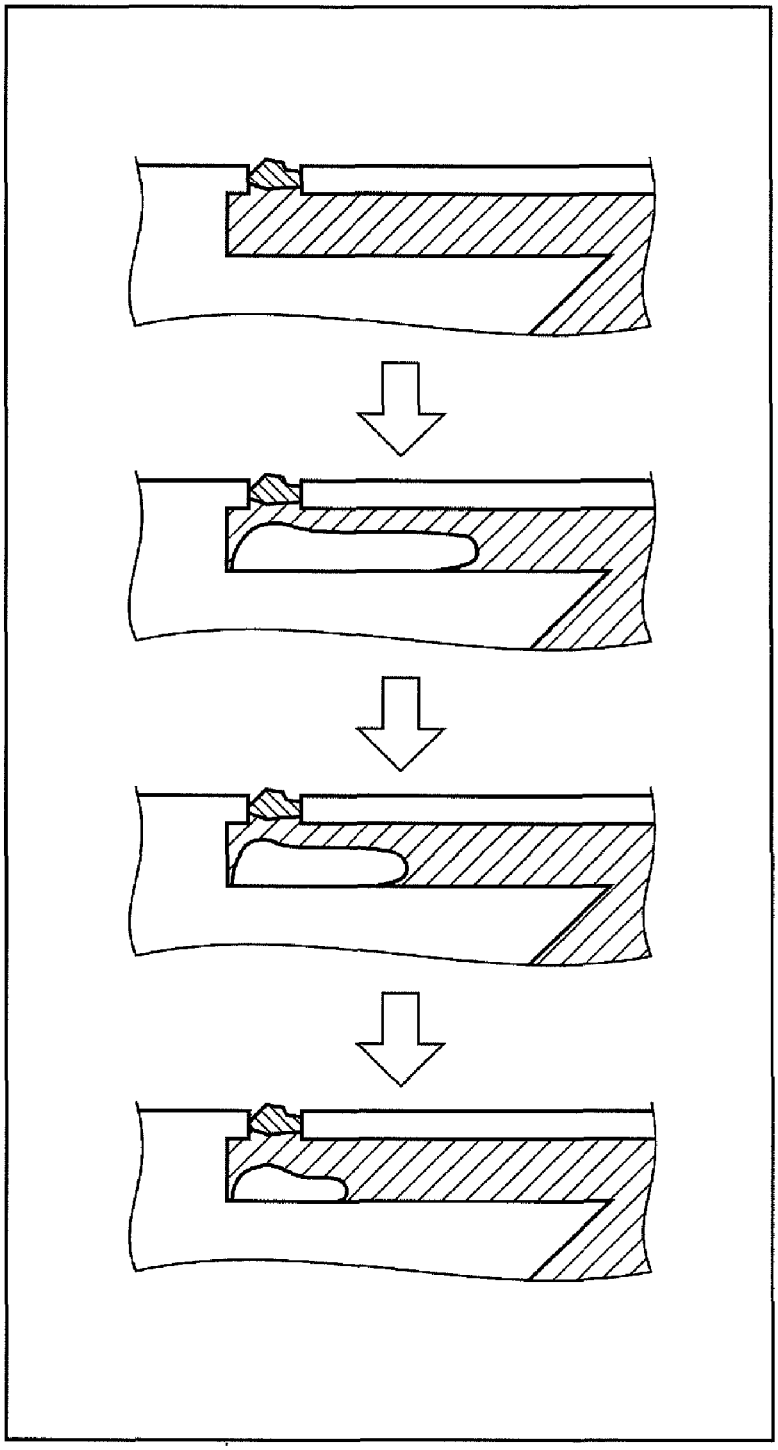
FIG. 11 is a schematic view showing the internal state of a nozzle upon occurrence of a discharge abnormality caused by clogging of the discharge orifice with impurities.

FIG. 11 is a sectional view showing the internal state of the nozzle in the case of temperature profile e of FIG. 10. As is apparent from FIG. 11, the discharge orifice is clogged with impurities in the liquid channel to obstruct ink discharge along with the generation and growth of a bubble. In this case, the bubble expands and shrinks, unlike discharge failures caused by the residual bubble and insufficient ink refill. The bubble expands toward the common liquid chamber because the discharge orifice is clogged partially or entirely. For this reason, the timing when ink contacts an anticavitation film 26 upon ink refill delays from that in normal discharge. In other words, the timing of cooling by contact of ink with the anticavitation film after bubbling becomes different from that in normal discharge.

In this embodiment, sensor detection temperatures in the respective discharge states are compared at timings ("during refill") 0 to 2 μsec after the sensor shows a temperature change caused by contact of ink with the anticavitation film, like normal discharge, as shown in FIG. 10.

More specifically, the temperature T(ir_normal) in normal discharge is 43° C., and the temperature T(ir_residual bubble) upon occurrence of a discharge abnormality by the residual bubble in the nozzle is 52° C. The temperature T(ir_liquid channel clogging) upon occurrence of a discharge abnormality by an ink refill failure due to impurities deposited in the liquid channel is 50° C. The temperature T(ir_discharge orifice clogging) upon occurrence of a discharge abnormality by an ink discharge failure due to clogging of the discharge orifice with impurities is 50° C. From these results, a temperature T(ir_cal) to be detected by the sensor at the timing during refill in normal discharge is predicted to set T(ir_cal)+Tβ (arbitrary value)=Tth(ir). This setting facilitates discrimination between normal discharge and discharge abnormality. In addition, each discharge abnormality can be identified in detail, so a recovery operation suitable to each abnormal discharge state can be executed.

Figure 12A:
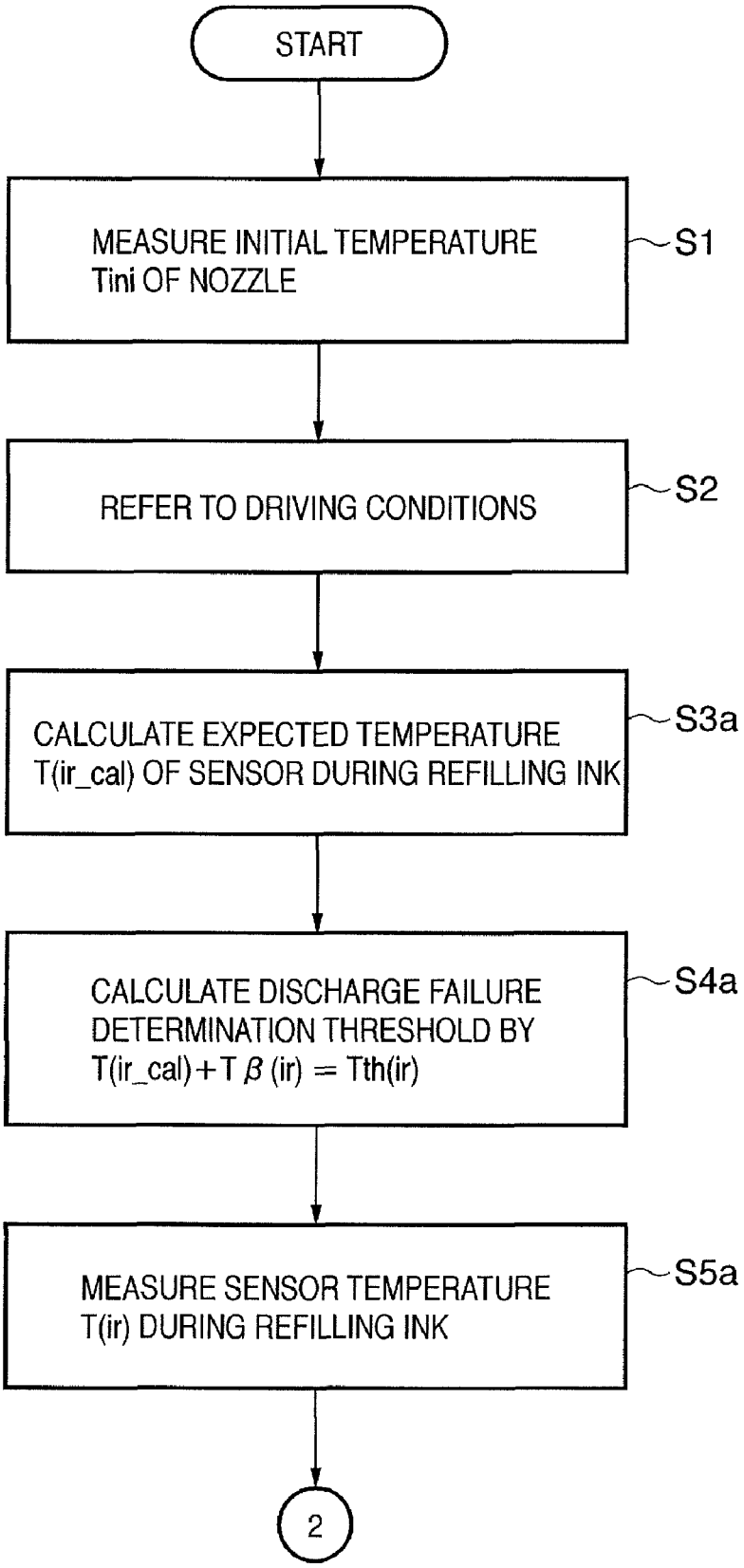
FIGS. 12A and 12B are flowcharts showing nozzle discharge failure determination processing according to the second embodiment of the present invention.
Figure 12B:
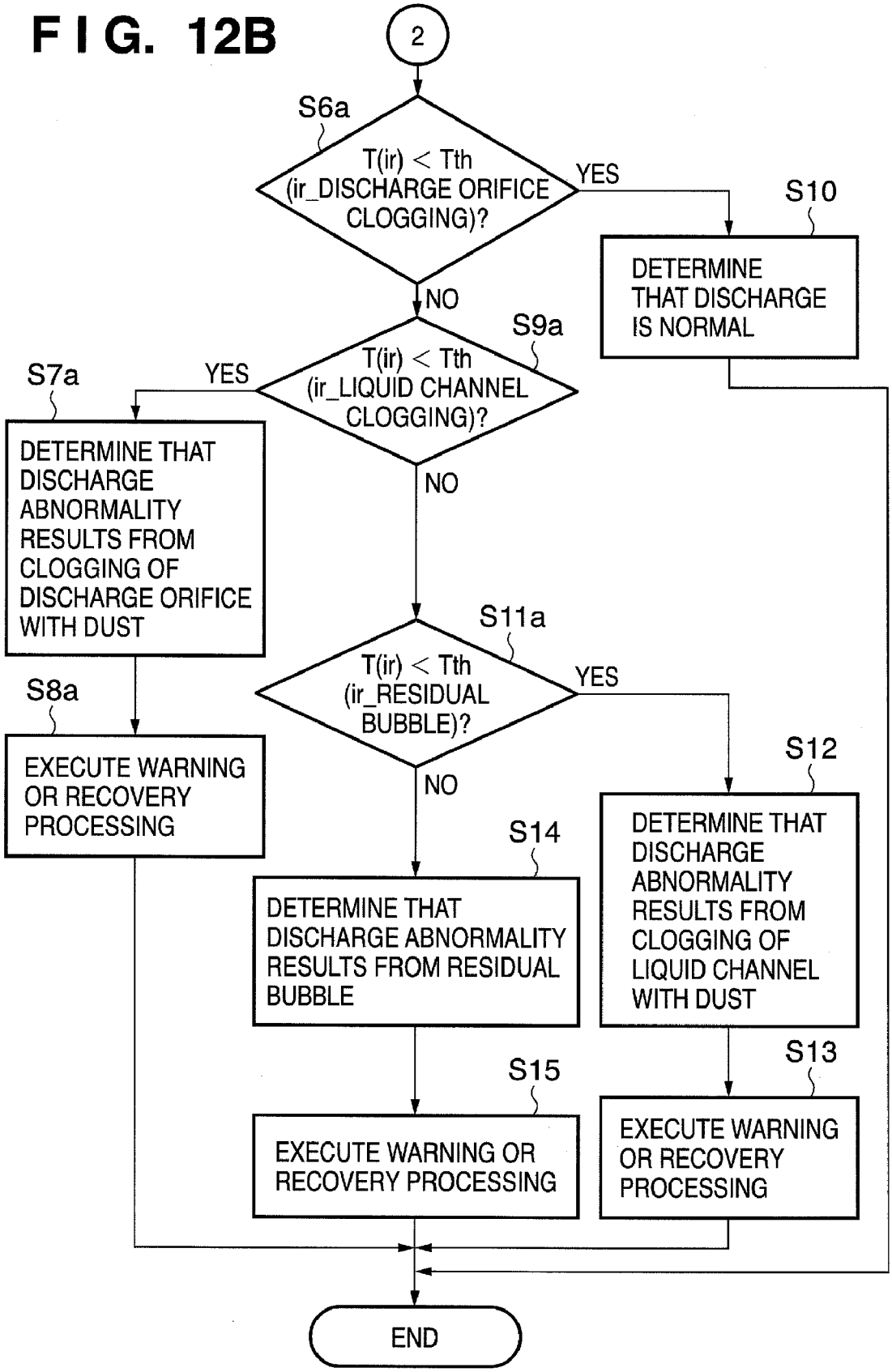

FIGS. 12A and 12B are flowcharts showing nozzle discharge failure determination processing according to the second embodiment. In FIGS. 12A and 12B, the same step reference numerals as those described in the first embodiment denote the same steps, and a description thereof will not be repeated.

Discharge failure determination processing will be explained with reference to FIGS. 10 and 12. In step S3*a* after the processes in steps S1 and S2, the expected temperature T(ir_cal) of the sensor during refill is calculated using the initial temperature ($T_{ini}$) of the nozzle measured in step S1 and information on the driving conditions referred to in step S2. In step S4*a*, the threshold adjustment factor Tβ is added to the expected temperature T(ir_cal) of the sensor during refill calculated from the initial temperature ($T_{ini}$) of the nozzle and the driving conditions. The threshold adjustment factor Tβ is derived from the initial nozzle temperature and the information on the driving conditions, and used to make different discharge failure determinations depending on each discharge state.

Using the sum, discharge failure determination thresholds during refill are calculated by equation (2). These thresholds are the threshold Tth(ir_residual bubble) to determine a discharge failure caused by the residual bubble, the threshold Tth(ir_liquid channel clogging) to determine a discharge failure caused by clogging of the liquid channel with dust, and the threshold Tth(ir_discharge orifice clogging) to determine a discharge failure caused by clogging of the discharge orifice with dust.

$$Tth(ir_\text{residual bubble})=T(ir_cal)+T\beta(ir_\text{residual bubble})$$

$$Tth(ir_\text{liquid channel clogging})=T(ir_cal)+T\beta(ir_\text{liquid channel clogging})$$

$$Tth(ir_\text{discharge orifice clogging})=T(ir_cal)+T\beta(ir_\text{discharge orifice clogging}) \quad (2)$$

In step S5*a*, the sensor temperature T(ir) during refill is measured. In step S6*a*, the sensor temperature T(ir) during refill measured in step S5 is compared with the threshold Tth(ir_discharge orifice clogging) calculated in step S4*a* to determine a discharge failure caused by clogging of the discharge orifice with dust.

If T(ir)<Tth(ir_discharge orifice clogging) holds, the process advances to step S10 to determine that the discharge is normal. If T(ir)≧Tth(ir_discharge orifice clogging) holds, the process advances to step S9*a* to compare the sensor temperature T(ir) during refill with the threshold Tth(ir_liquid channel clogging) calculated in step S4*a* to determine a discharge failure caused by clogging of the liquid channel with dust.

If T(ir)<Tth(ir_liquid channel clogging) holds, the process advances to step S7*a* to determine that the discharge abnormality results from clogging of the discharge orifice with dust. The process advances to step S8*a* to execute warning or recovery processing corresponding to the abnormal discharge state. If T(ir)≧Tth(ir_liquid channel clogging) holds, the process advances to step S11*a* to compare the sensor temperature T(ir) during refill with the threshold Tth(ir_residual bubble) calculated in step S4*a* to determine a discharge failure caused by the residual bubble.

If T(ir)<Tth(ir_residual bubble) holds, the process advances to step S12 to determine that the discharge abnormality results from clogging of the liquid channel with dust. In step S13, warning or recovery processing corresponding to the abnormal discharge state is executed. If T(ir)≧Tth(ir_residual bubble) holds, the process advances to step S14 to determine that the discharge abnormality results from the residual bubble. In step S15, warning or recovery processing corresponding to the abnormal discharge state is executed.

According to the above-described second embodiment, the expected temperature of the sensor during ink refill is compared with a plurality of thresholds. The cause of an ink discharge abnormality can be identified to execute warning or recovery processing suitable to the cause.

Third Exemplary Embodiment

Figure 13:
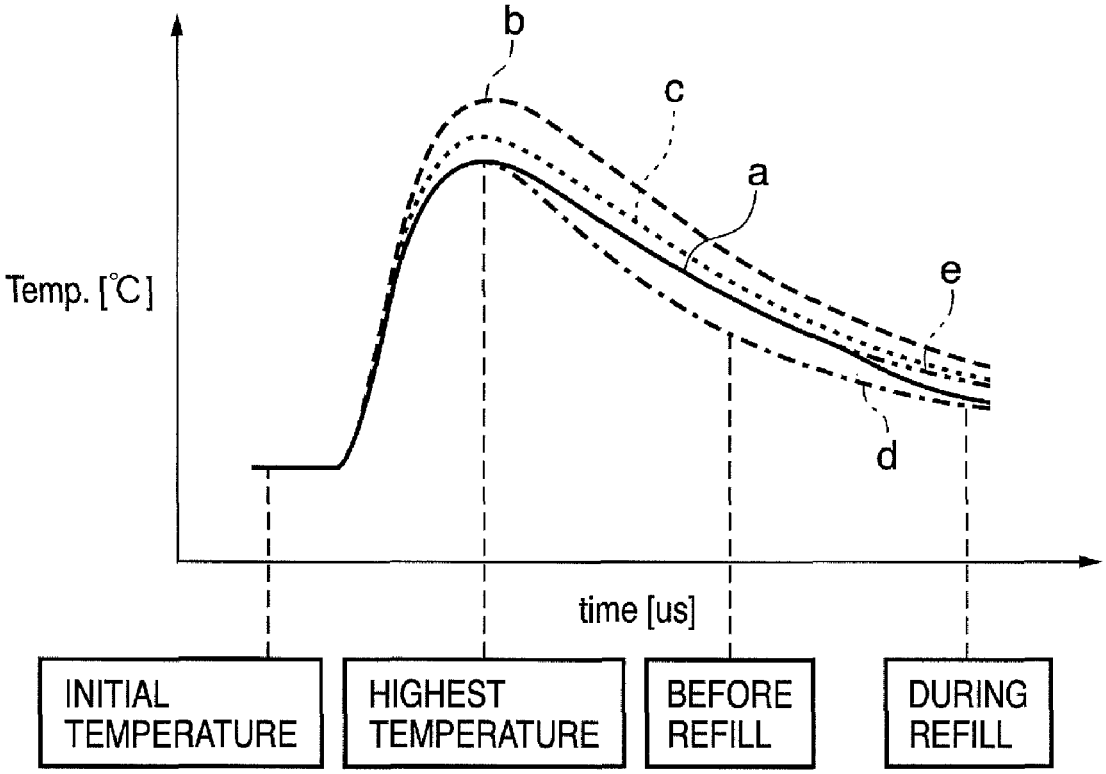
FIG. 13 is a graph showing temperature changes of the sensor temperature in respective discharge abnormality states.

FIG. 13 is a graph showing the temperature profile to explain the third embodiment, and is a graph showing sensor temperature profiles in a normal ink discharge state and respective abnormal discharge states. Note that FIG. 13 shows a temperature change upon performing the discharge operation once.

In FIG. 13, b represents a temperature profile upon occurrence of a discharge abnormality by the residual bubble in the nozzle; c represents a temperature profile upon occurrence of a discharge abnormality by an ink refill failure due to impurities deposited in the liquid channel; d represents a temperature profile upon occurrence of a discharge abnormality by ink attached to the nozzle surface; and e represents a temperature profile upon occurrence of a discharge abnormality by clogging of the discharge orifice with impurities.

As described above, the experiment and simulation result reveal that temperature changes detected by the sensor in abnormal discharge states due to various causes are different from a temperature change in normal discharge. In the third embodiment, a temperature immediately before applying a driving signal is measured to detect an initial nozzle state. The temperature is measured at least two of three measurement points: i) before refill; ii) during refill; and iii) the timing when the sensor output value reaches a maximum value upon a temperature rise by applying a current pulse. At each measurement point, the measured temperature is compared with the discharge failure determination threshold, comprehensively determining a discharge failure.

Figure 14A:
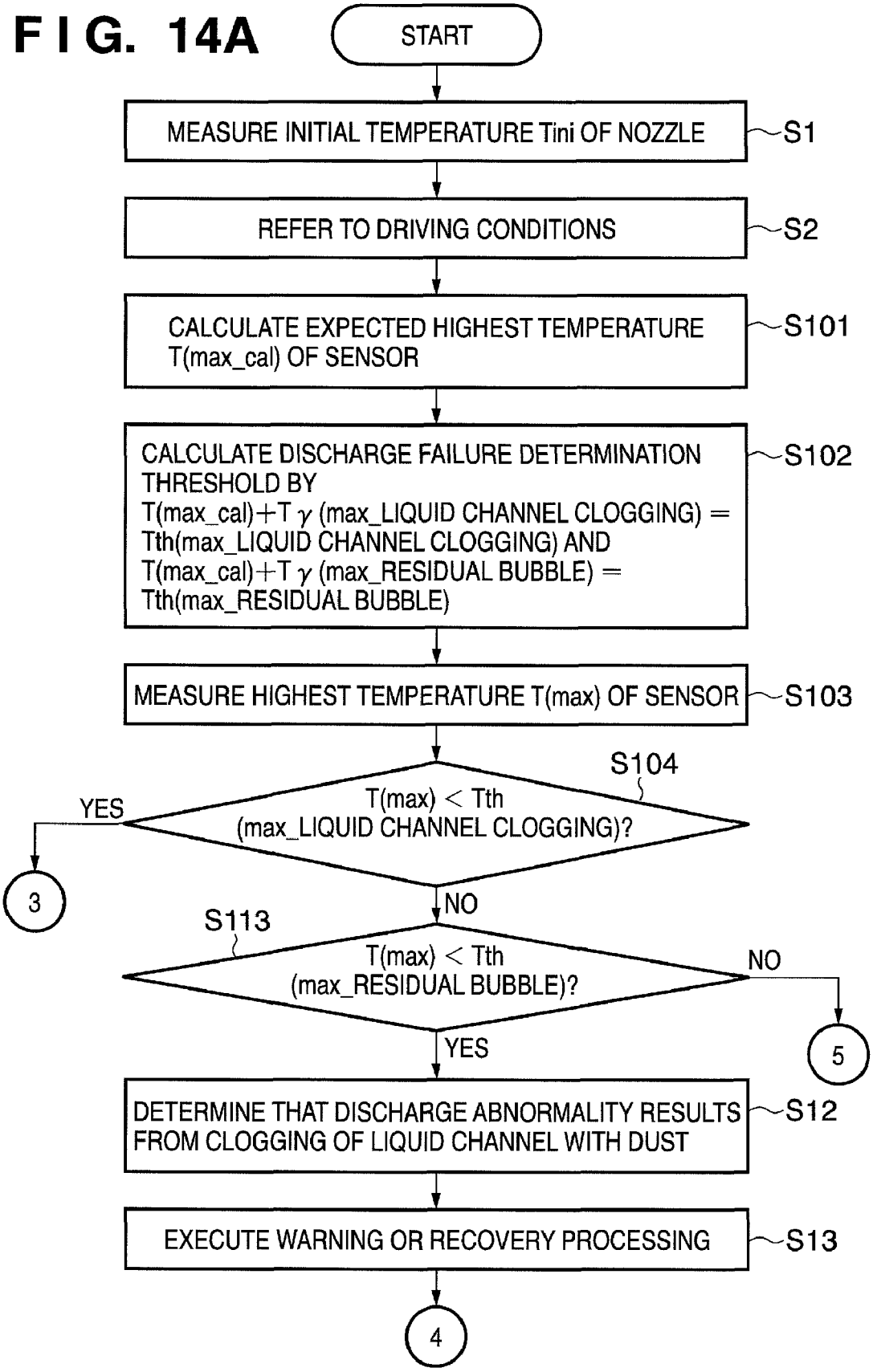
FIGS. 14A, 14B and 14C are flowcharts showing nozzle discharge failure determination processing according to the third embodiment of the present invention.
Figure 14B:
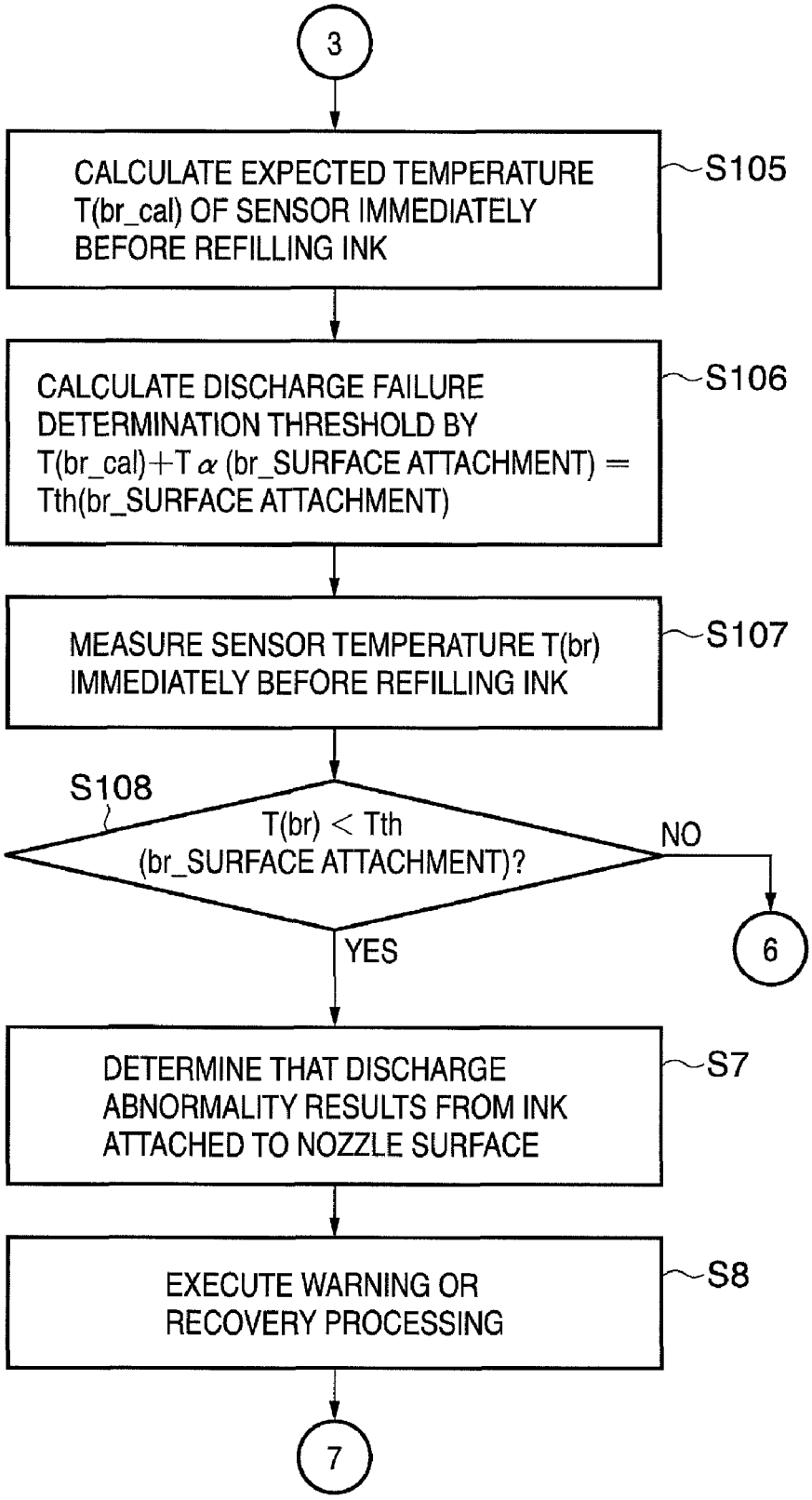
Figure 14C:
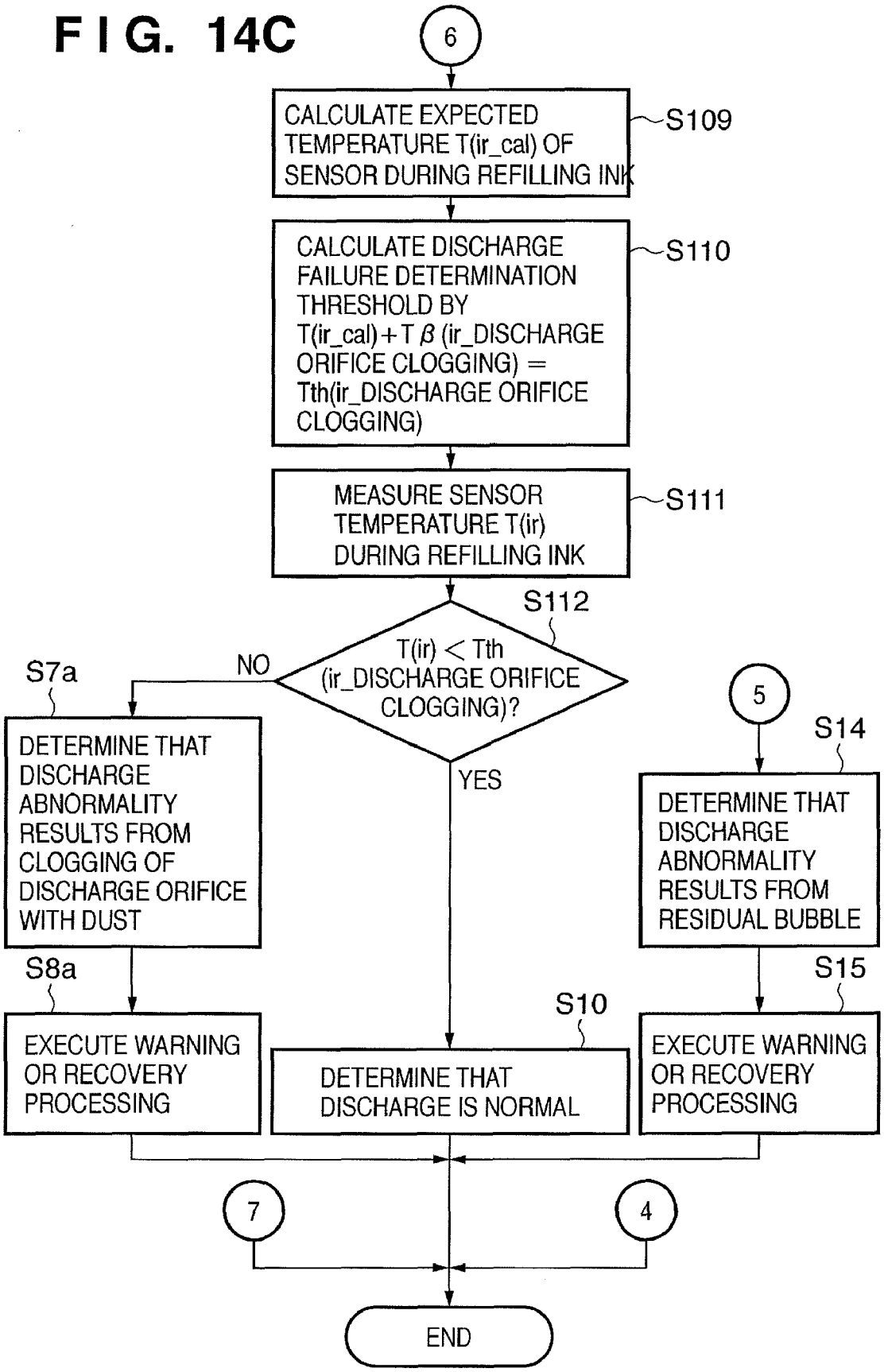

FIGS. 14A, 14B and 14C are flowcharts showing nozzle discharge failure determination processing when the temperature is measured at all the three measurement points: before refill; during refill; and the timing when the sensor output value reaches a maximum value upon a temperature rise by applying a current pulse according to the third embodiment. In FIGS. 14A, 14B and 14C, the same step reference numerals as those described in the first and second embodiments denote the same steps, and a description thereof will not be repeated.

Discharge failure determination processing will be explained with reference to FIGS. 13, 14A, 14B, and 14C. In step S101 after the processes in steps S1 and S2, the expected highest temperature T(max_cal) of the sensor is calculated using the initial temperature ($T_{ini}$) of the nozzle measured in step S1 and information on the driving conditions referred to in step S2. In step S102, the threshold adjustment factors Tγ(max_liquid channel clogging) and Tγ(max_residual bubble) are added to the expected highest temperature T(max_cal) of the sensor. The threshold adjustment factors Tγ(max_liquid channel clogging) and Tγ(max_residual bubble) are derived from the initial nozzle temperature and the information on the driving conditions, and used to determine discharge failures caused by clogging of the liquid channel with dust and the residual bubble. Using the sums, the thresholds Tth(max_liquid channel clogging) and Tth (max_residual bubble) are calculated by equation (3). The threshold Tth(max_liquid channel clogging) is used to determine a discharge abnormality caused by clogging of the liquid channel with dust at the highest sensor temperature. The threshold Tth(max_residual bubble) is used to determine a discharge abnormality caused by the residual bubble at the highest sensor temperature.

$$Tth(\text{max_liquid channel clogging})=T(\text{max_}cal)+T\gamma(\text{max_liquid channel clogging})$$

$$Tth(\text{max_residual bubble})=T(\text{max_}cal)+T\gamma(\text{max_residual bubble}) \quad (3)$$

In step S103, the highest temperature T(max) of the sensor is measured. In step S104, the highest temperature T(max) of the sensor measured in step S103 is compared with the threshold Tth(max_liquid channel clogging) calculated in step S102 to determine a discharge failure caused by clogging of the discharge orifice with dust.

If T(max)≧Tth(max_discharge orifice clogging) holds, the process advances to step S113 to compare the highest temperature T(max) of the sensor with the threshold Tth (max_residual bubble) calculated in step S102 to determine a discharge failure caused by the residual bubble. If T(max) Tth(max_residual bubble) holds, the process advances to step S14 to determine that the discharge abnormality results from the residual bubble. In step S15, warning or recovery processing corresponding to the abnormal discharge state is executed. If T(max)<Tth(max_residual bubble) holds, the process advances to step S12 to determine that the discharge abnormality results from clogging of the liquid channel with dust. In step S13, warning or recovery processing corresponding to the abnormal discharge state is executed.

If T(max)<Tth(max_liquid channel clogging) in step S104 holds, the process advances to step S105. In step S105, the expected temperature T(br_cal) of the sensor before refill is calculated using the initial temperature ($T_{ini}$) of the nozzle measured in step S1 and the information on the driving conditions referred to in step S2.

In step S106, the threshold adjustment factor Tα_surface attachment is added to the expected temperature T(br_cal) of the sensor. The threshold adjustment factor Tα_surface attachment is derived from the initial nozzle temperature and the information on the driving conditions, and used to determine a discharge abnormality caused by ink attached to the nozzle surface. Using the sum, the threshold Tth(br_surface attachment) to determine a discharge abnormality before refill is calculated, as described with reference to equation (1) in the first embodiment. In step S107, the sensor temperature T(br) immediately before refilling ink is measured. In step S108, the sensor temperature T(br) before refill measured in step S107 is compared with the threshold Tth(br_surface attachment) calculated in step S106 to determine a discharge abnormality caused by ink attached to the nozzle surface.

If T(br)<Tth(br_surface attachment) holds, the process advances to step S7 to determine that the discharge abnormality results from ink attached to the nozzle surface. In step S8, warning or recovery processing corresponding to the abnormal discharge state is executed.

If T(br)≧Tth(br_surface attachment) holds, the process advances to step S109. In step S109, the expected temperature T(ir_cal) of the sensor during refill is calculated using the initial temperature ($T_{ini}$) of the nozzle measured in step S1 and the information on the driving conditions referred to in step S2. In step S110, the threshold adjustment factor Tβ_discharge orifice clogging is added to the expected temperature T(ir_cal) of the sensor during refill. The threshold adjustment factor Tβ_discharge orifice clogging is derived from the initial nozzle temperature and the information on the driving conditions, and used to determine a discharge abnormality caused by clogging of the discharge orifice with dust. Using the sum, the threshold Tth(ir_discharge orifice clogging) to determine a discharge abnormality during refill is calculated, as described with reference to equation (2) in the second embodiment.

In step S111, the sensor temperature T(ir) during refill is measured. In step S112, the sensor temperature T(ir) during refill measured in step S111 is compared with the threshold Tth(ir_discharge orifice clogging) calculated in step S110 to determine a discharge failure caused by clogging of the discharge orifice with dust. If T(ir)<Tth(ir_discharge orifice clogging) holds, the process advances to step S10 to determine that the discharge is normal. If T(ir)≧Tth(ir_discharge orifice clogging) holds, the process advances to step S7*a* to determine that the discharge abnormality results from clogging of the discharge orifice with dust. In step S8*a*, warning or recovery processing corresponding to the abnormal discharge state is executed.

According to the above-described third embodiment, three sensor measurement values before and during refill and at the timing when the sensor output value reaches a maximum value upon a temperature rise are compared with a plurality of thresholds. The cause of an ink discharge abnormality can be comprehensively identified to execute warning or recovery processing suitable to the cause.

Appropriate discharge failure determination at each measurement point makes it possible to instantaneously determine the discharge state of each nozzle in detail. When the temperature waveform detected by the sensor exhibits a constant value regardless of input of a driving signal to the heater, it can be determined that the heater is disconnected. Thus, even if a discharge abnormality or disconnection occurs during continuous printing, an appropriate countermeasure such as complementary printing with another nozzle, a recovery operation, or the stop of printing can be taken to prevent production of many printed materials with poor quality. Accordingly, high-quality image printing is maintained. Since warning or recovery processing suitable to each discharge failure state can be executed, the ink consumption along with the recovery operation can be minimized.

Fourth Exemplary Embodiment

Figure 15A:
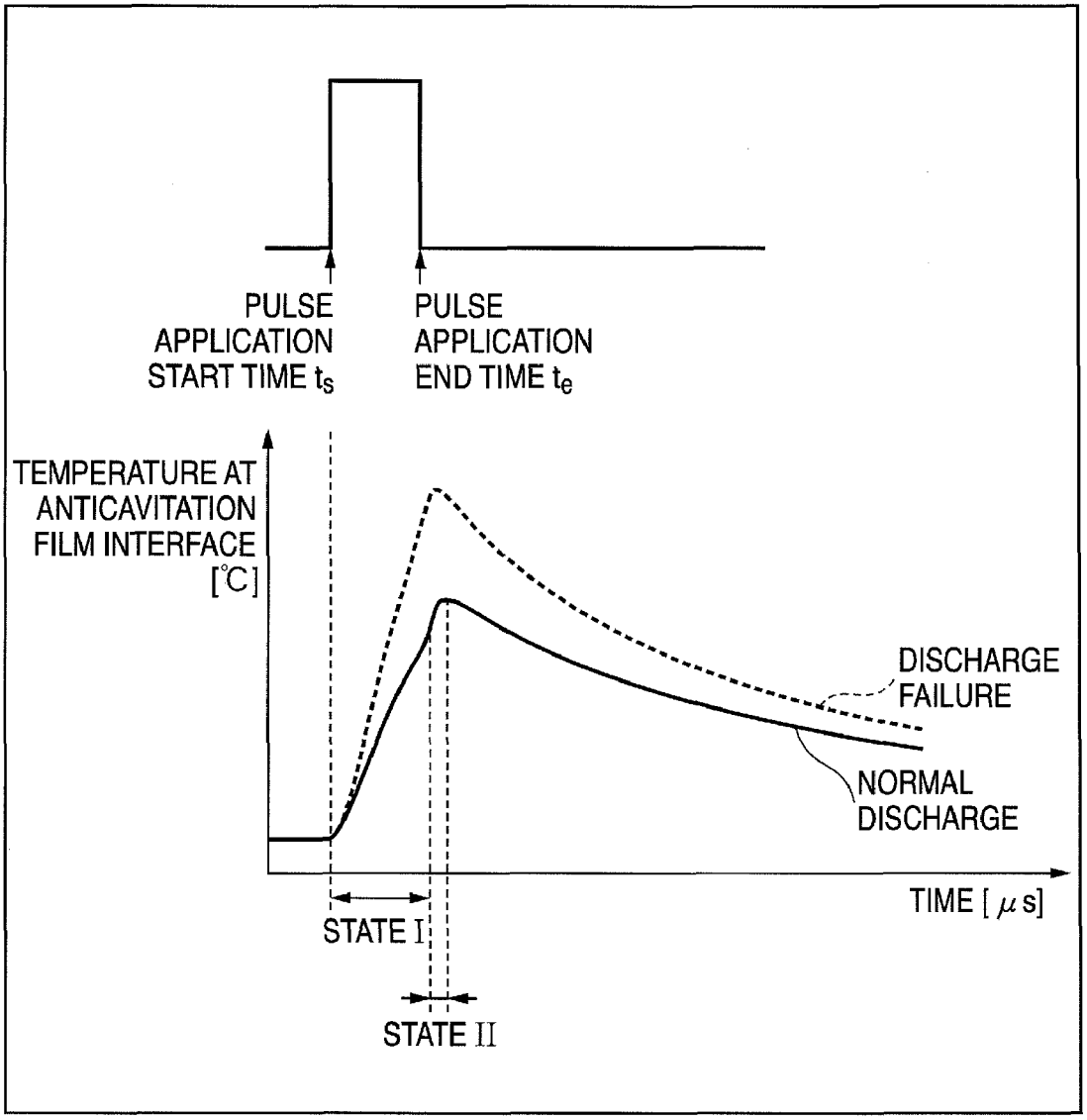
FIGS. 15A and 15B are graphs showing temperature changes of the sensor temperature when discharge failure determination is performed.

FIG. 15A is a graph showing the temperature profile to explain the fourth embodiment. In particular, FIG. 15A shows a temperature profile at the ink-anticavitation film interface when ink is discharged normally, and a temperature profile at the ink-anticavitation film when a discharge failure occurs.

In normal discharge, the temperature of a heater 3 rises abruptly upon application of a pulse to the heater 3. With a small time difference after the temperature rise, the temperature at the ink-anticavitation film interface also rises (state I). When the temperature at the ink-anticavitation film interface reaches the ink bubbling temperature, bubbles are generated and grow. Generated bubbles prevent an anticavitation film 26 from contacting ink. The thermal conductivity ($\lambda_{gas}$) of bubbles is smaller by one order of magnitude than the thermal conductivity ($\lambda_{liquid}$) of ink. While bubbles exist between ink and the anticavitation film, almost all heat generated by the heater 3 is accumulated in the heater board. As a result, the temperature at the gas-anticavitation film interface rises abruptly (state II).

The temperature rise of the heater 3 stops at the stop of pulse application upon the lapse of a predetermined time, and then the temperature rise at the gas-anticavitation film interface also stops. After that, both the temperatures at the heater and gas-anticavitation film interface decrease. Upon the lapse of a predetermined time, the anticavitation film 26 contacts ink again along with bubble shrinkage, and the temperature returns to the initial state.

As an example of a discharge failure, when the residual bubble exists above the anticavitation film 26, the temperature at the gas-anticavitation film interface abruptly rises immediately after pulse application, and decreases at the end of pulse application.

The fourth embodiment can detect the temperatures of the heater and anticavitation film 26 at high speed and high precision. The simulation and experiment show that this results from the sensor formed immediately below the heater via an interlayer insulation film 24.

Figure 15B:
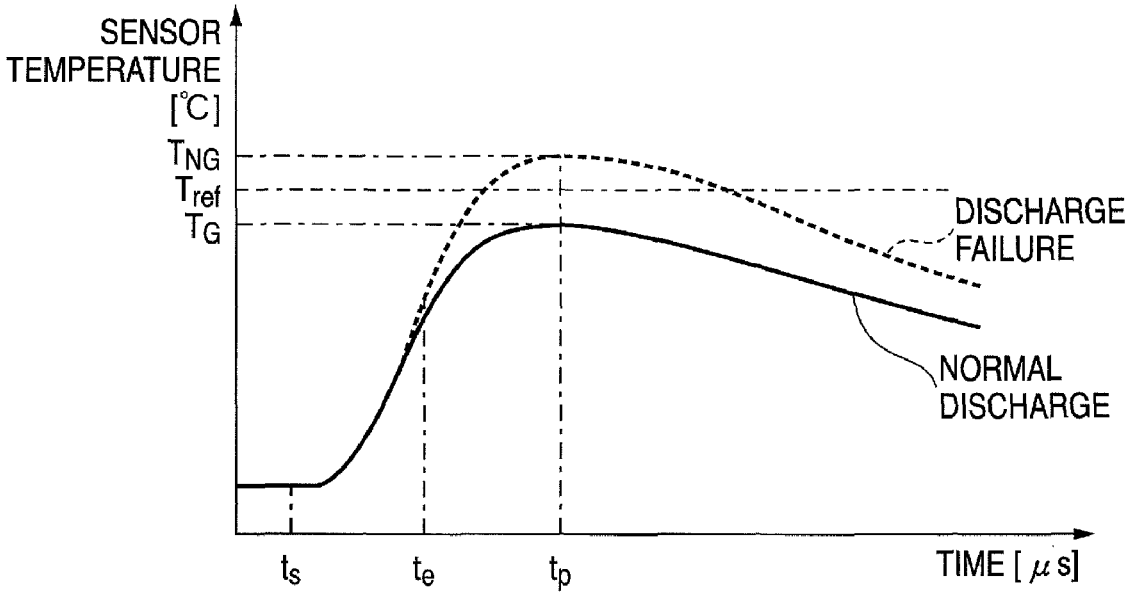

FIG. 15B is a graph showing the temperature profile to explain the experimental result and temperature simulation result. In particular, FIG. 15B shows the temperature profile of the temperature sensor in the fourth embodiment when a 20-V pulse is applied to a 360-Ω heater at an initial nozzle temperature of 45° C. for 0.75 μsec [pulse application time (from $t_s$ to $t_e$)]. In FIG. 15B, the temperature reaches the peak at time $t_p$ about 1.2 μsec after time $t_e$ in both normal discharge and abnormal discharge. The temperature was TG=182° C. in normal discharge and TNG=219° C. in abnormal discharge. This unit that normal discharge and abnormal discharge can be easily discriminated from each other by setting TG+α (arbitrary value)=Tref.

Figure 16:
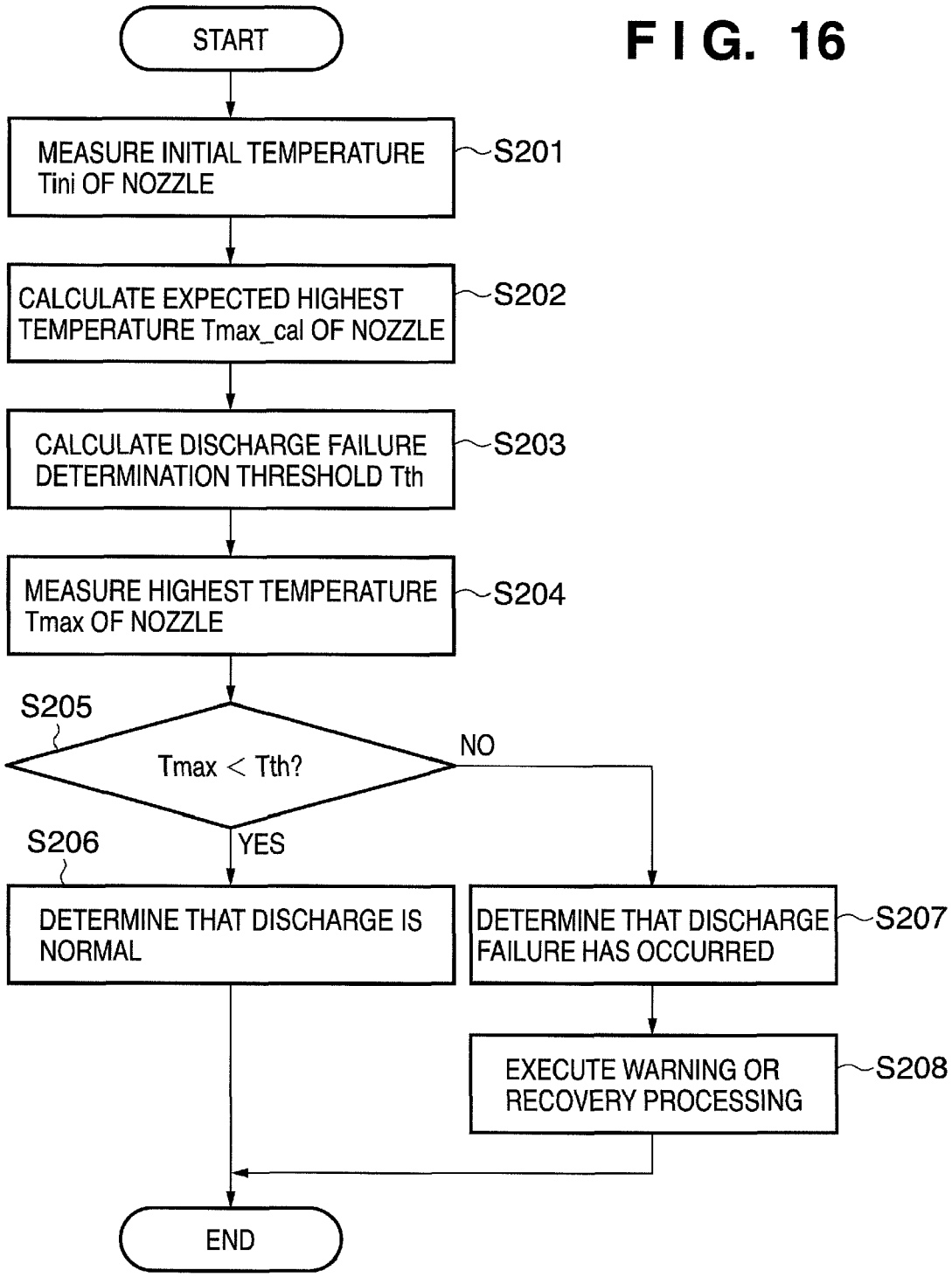
FIG. 16 is a flowchart showing nozzle discharge failure determination processing according to the fourth embodiment of the present invention.
Figure 17:
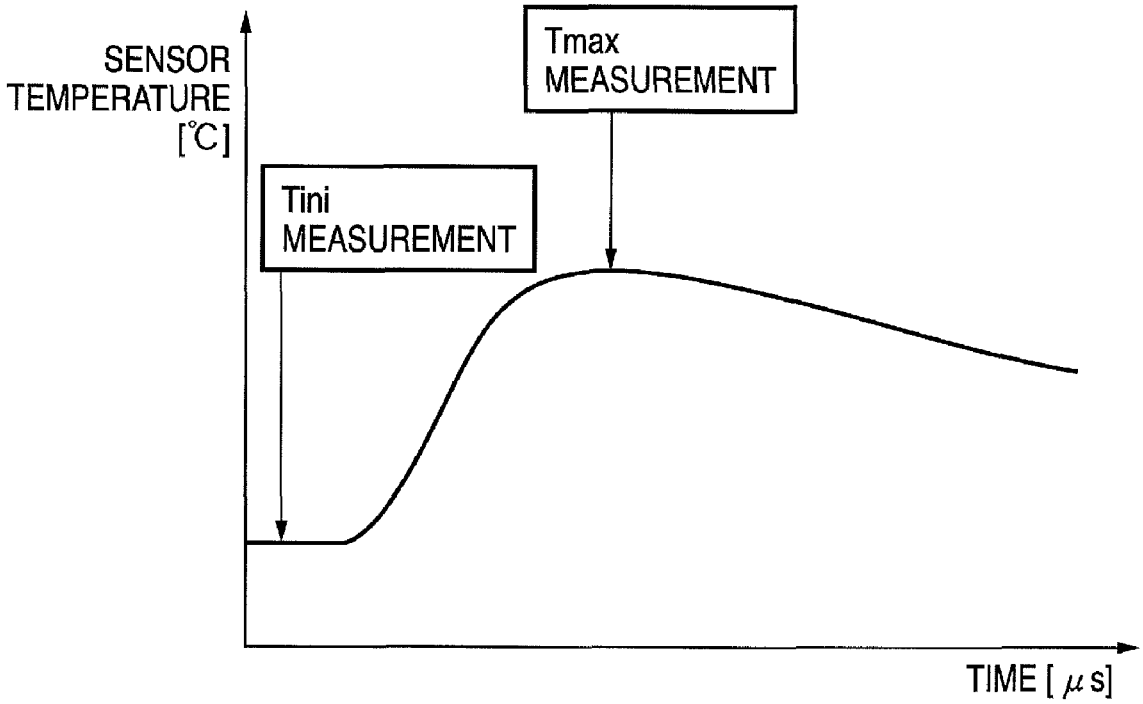
FIG. 17 is a graph showing temperature changes of the sensor temperature when discharge failure determination is performed according to the fourth embodiment of the present invention.

FIG. 16 is a flowchart showing nozzle discharge failure determination processing according to the fourth embodiment. FIG. 17 is a graph showing a change of the internal nozzle temperature over time during printing that is measured by a temperature sensor 5. Note that FIG. 17 shows a temperature change upon performing the discharge operation once.

Discharge failure determination processing will be explained with reference to FIGS. 16 and 17. In step S201, the initial temperature ($T_{ini}$) of the nozzle immediately before applying a driving signal is measured. In step S202, the expected highest temperature of the nozzle is calculated using the initial temperature ($T_{ini}$) of the nozzle from a lookup table, which is a 2D (two dimensional) matrix of the initial temperature ($T_{ini}$) of the nozzle and the expected highest temperature (Tmax_cal) of the nozzle, shown in FIG. 18. In step S203, the discharge failure determination threshold Tth which depends on the initial temperature ($T_{ini}$) of the nozzle is calculated from a lookup table shown in FIG. 19.

In step S204, the highest temperature Tmax of the nozzle immediately after the end of pulse application to the heater 3 is measured. In step S205, the highest temperature Tmax of the nozzle measured in step S204 is compared with the discharge failure determination threshold Tth calculated in step S203. If Tmax<Tth holds, the process advances to step S206 to determine that the discharge is normal. If Tmax Tth holds, the process advances to step S207 to determine that a discharge failure has occurred. The process advances to step S208 to execute warning or recovery processing.

Figure 20:
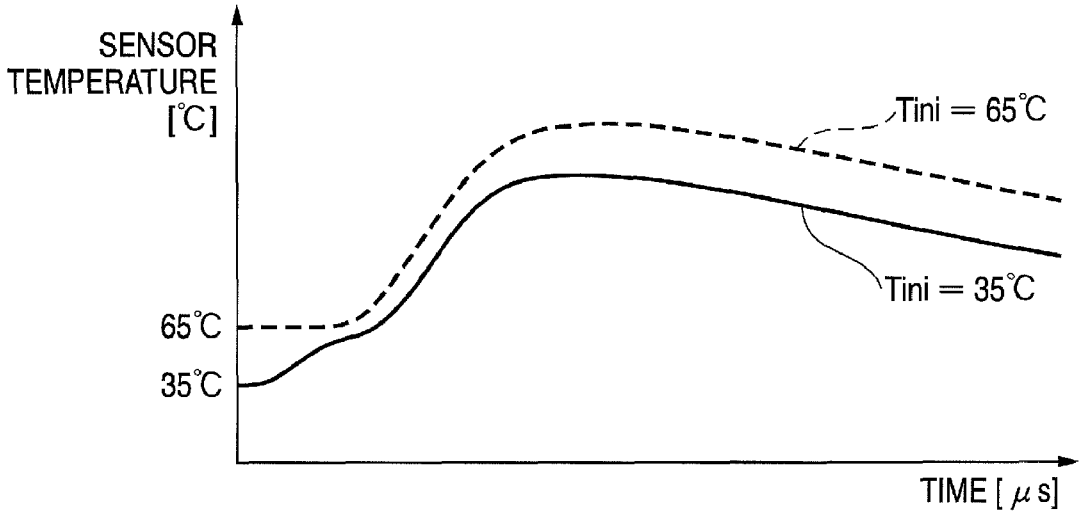
FIG. 20 is a graph for explaining a change of the highest nozzle temperature depending on the initial nozzle temperature.
Figure 21:
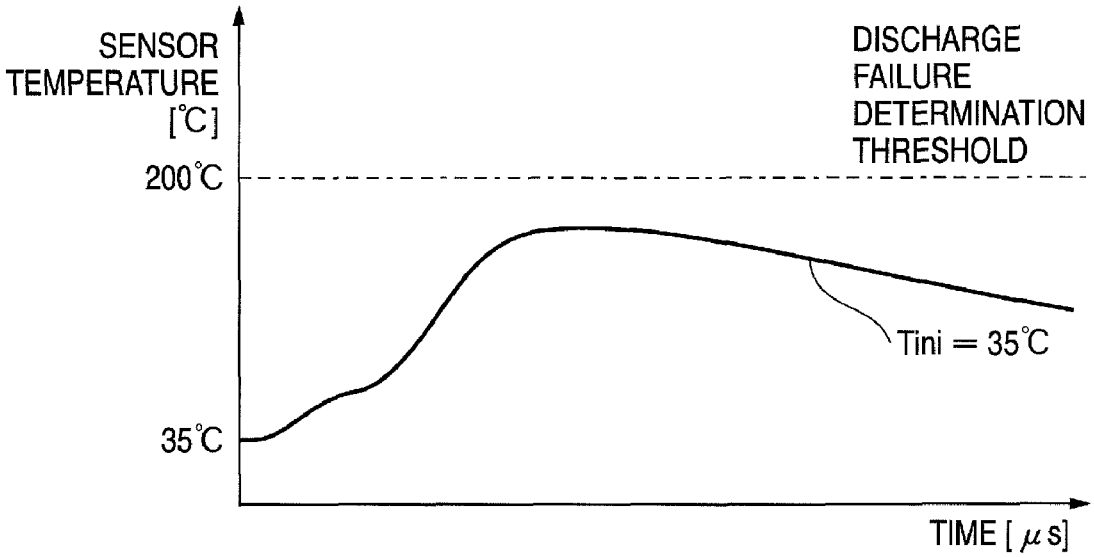
FIG. 21 is a graph for explaining a change of the discharge failure determination threshold depending on the initial nozzle temperature.
Figure 22:
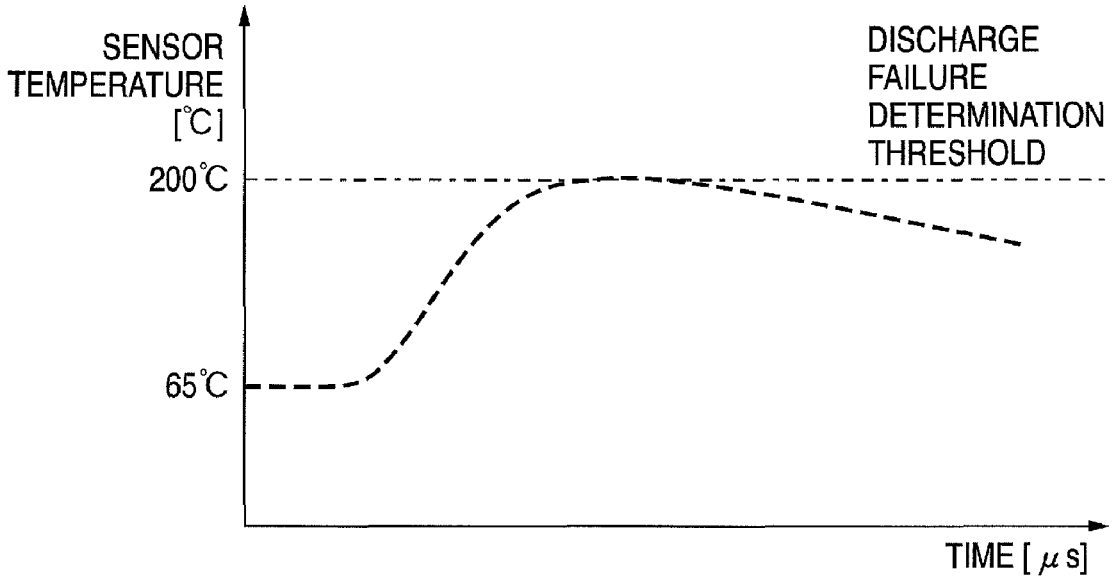
FIG. 22 is a graph for explaining a change of the discharge failure determination threshold depending on the initial nozzle temperature.

FIG. 20 shows temperature profiles at different initial nozzle temperatures. Initial nozzle temperatures shown in FIG. 20 are 35° C. and 65° C. The highest temperature is 175.3° C. at the initial nozzle temperature of 35° C., and 200.4° C. at the initial nozzle temperature of 65° C. At this case, if the discharge failure determination threshold is fixed to 200.0° C., a discharge failure is determined correctly at the initial nozzle temperature of 35° C., as shown in FIG. 21. In contrast, the discharge failure determination threshold and the highest temperature of the nozzle which discharged ink normally become almost equal to each other at the initial nozzle temperature of 65° C., and no discharge failure is determined correctly, as shown in FIG. 22. To solve this problem, the fourth embodiment measures an initial nozzle temperature and calculates the expected highest temperature of the nozzle using the lookup table shown in FIG. 18. Consequently, the discharge failure determination threshold can be calculated accurately.

The discharge failure determination threshold shown in FIG. 19 is set by adding, to the expected highest temperature Tmax_cal of the nozzle calculated from the initial temperature ($T_{ini}$) of the nozzle, an arbitrary value large enough to prevent a determination error caused by a noise signal and small enough to determine a discharge failure immediately after occurrence.

Figure 23:
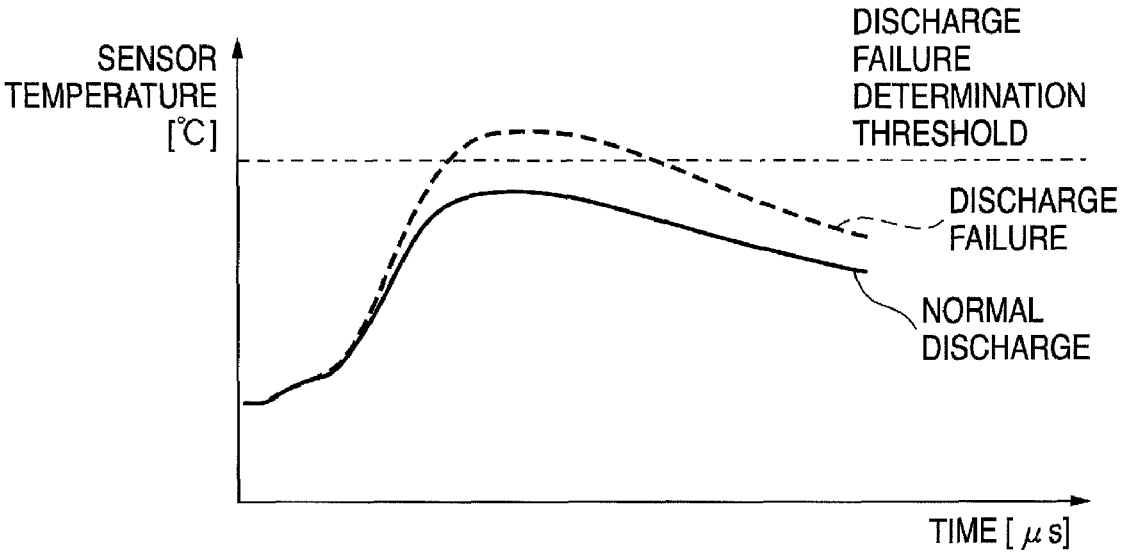
FIG. 23 is a graph for explaining discharge failure determination.

The highest temperature of the nozzle is compared with the discharge failure determination threshold set in this manner, as shown in FIG. 23. It is determined that the discharge is normal if Tmax<Tth holds, and that a discharge failure has occurred if Tmax≧Tth holds.

Note that the fourth embodiment sets the discharge failure determination threshold by adding a constant arbitrary value to the initial temperature ($T_{ini}$) of the nozzle, as described above. However, the discharge failure determination threshold may be calculated by another method because an appropriate value depends on driving conditions, the ink discharge amount, and the number of discharge orifices of the printhead.

Fifth Exemplary Embodiment

Figure 24:
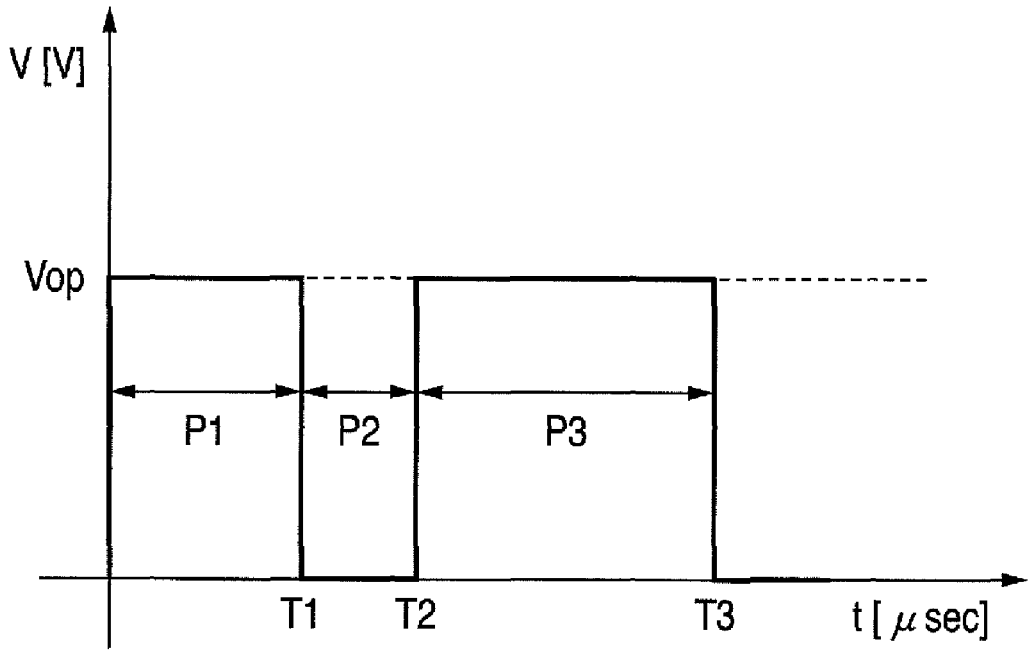
FIG. 24 is a timing chart for explaining a double pulse driving method.

FIG. 24 is a timing chart for explaining a double pulse driving method of driving a printhead. $V_{op}$ represents a driving voltage applied to a heater 3; P1, the pulse width of the first pulse (to be referred to as a pre-pulse hereinafter) of a heat pulse divided into a plurality of pulses (two pulses); P2, the interval time; and P3, the pulse width of the second pulse (to be referred to as a main pulse hereinafter). Times T1, T2, and T3 are timings to define P1, P2, and P3, respectively.

Figure 25A:
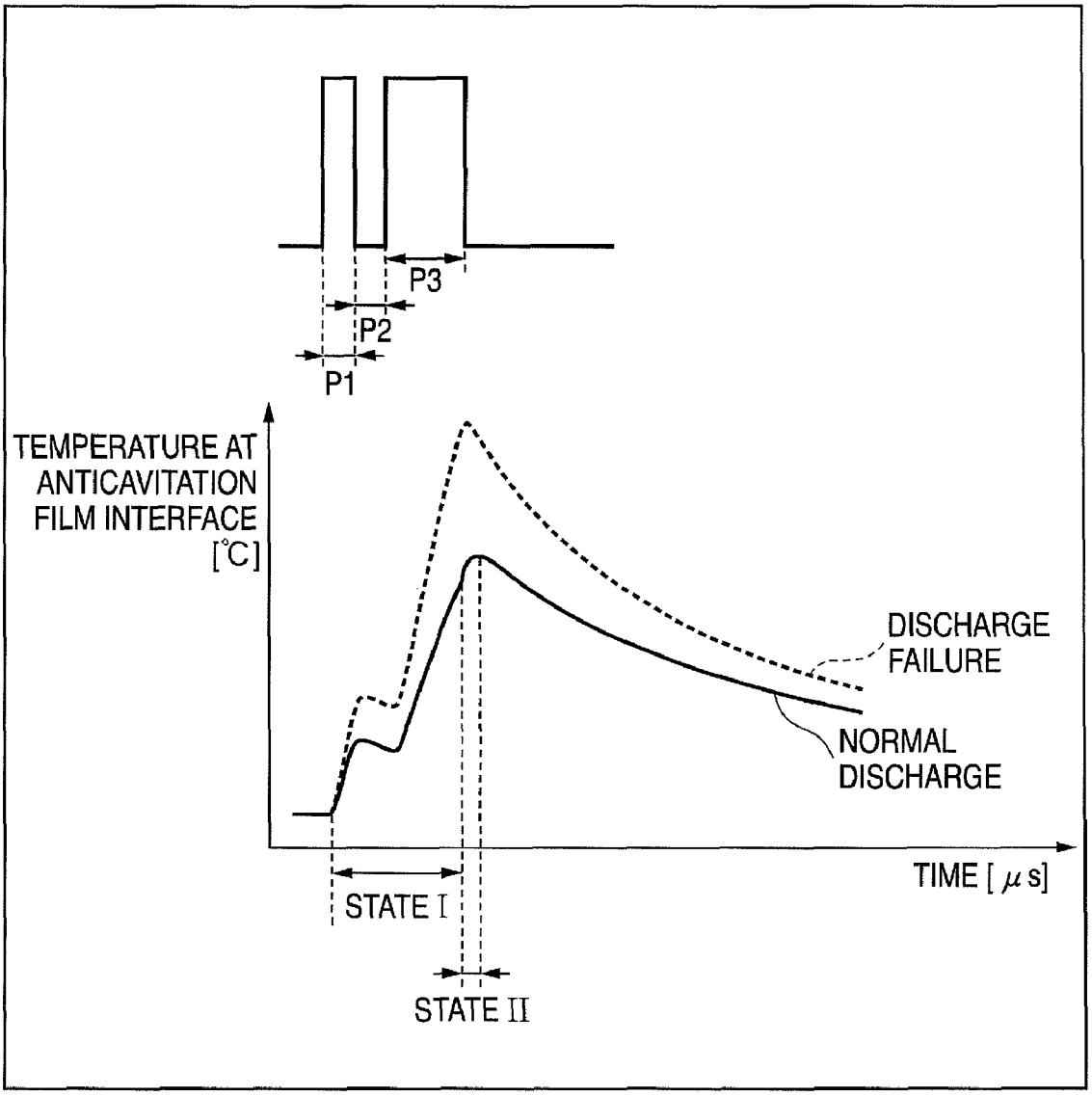
FIG. 25A is a graph showing a change of the temperature over time at the ink-anticavitation film interface when discharge failure determination is performed.

FIG. 25A is a graph showing the temperature profile of a printhead according to the fifth embodiment. FIG. 25A shows a temperature profile at the ink-anticavitation film interface when ink is discharged normally, and a temperature profile at the ink-anticavitation film when a discharge failure occurs.

In normal discharge, the temperature of the heater 3 rises abruptly upon application of a pulse to the heater 3. With a small time difference after the temperature rise, the temperature at the ink-anticavitation film interface also rises (state I). When the temperature at the ink-anticavitation film interface reaches the ink bubbling temperature, bubbles are generated and grow. Generated bubbles prevent an anticavitation film 26 from contacting ink. The thermal conductivity ($\lambda_{gas}$) of bubbles is smaller by one order of magnitude than the thermal conductivity ($\lambda_{liquid}$) of ink. While bubbles exist between ink and the anticavitation film, almost all heat generated by the heater 3 is accumulated in the heater board. As a result, the temperature at the gas-anticavitation film interface rises abruptly (state II).

The temperature rise of the heater 3 stops at the stop of pulse application upon the lapse of a predetermined time, and then the temperature rise at the gas-anticavitation film interface also stops. After that, both the temperatures at the heater and gas-anticavitation film interface decrease. Upon the lapse of a certain time, bubbles disappear, and ink is refilled accordingly. The anticavitation film 26 contacts ink again, and the temperature returns to the initial state.

As an example of a discharge failure, when the residual bubble exists above the anticavitation film 26, the temperature at the gas-anticavitation film interface abruptly rises immediately after the pulse application, and drops at the end of pulse application.

The fifth embodiment can also detect the temperatures of the heater and anticavitation film 26 at high speed and high precision. The simulation and experiment reveal that this results from the sensor formed immediately below the heater via an interlayer insulation film 24.

Figure 25B:
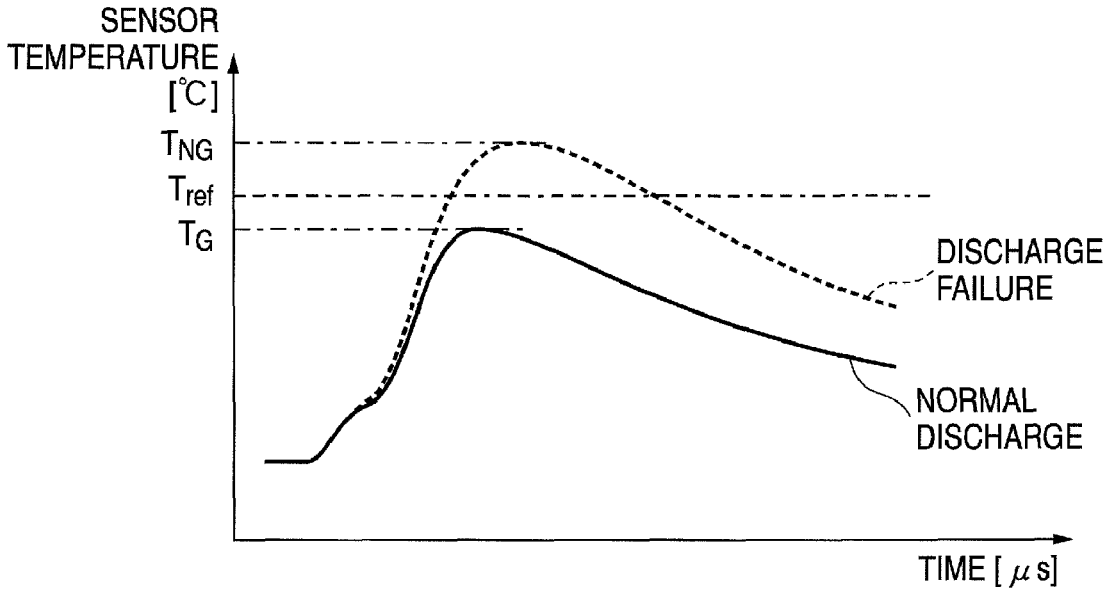
FIG. 25B is a graph showing a change of the sensor temperature over time when discharge failure determination is performed.

FIG. 25B is a graph showing a temperature profile based on the experimental results. In particular, FIG. 25B shows the temperature profile of the temperature sensor when the pre-pulse is applied to a 360-Ω heater for 0.20 μsec and the main pulse is applied for 0.60 μsec after an interval time of 0.40 μsec at an initial nozzle temperature of 25° C. In FIG. 25B, the temperature reaches the peak at time $t_p$ about 1.2 μsec after time $t_o$ in both normal discharge and abnormal discharge. The temperature was TG=167° C. in normal discharge and TNG=213° C. in abnormal discharge. This represents that normal discharge and abnormal discharge can be easily discriminated from each other by setting TG+α (arbitrary value)= Tref.

Processing to detect a discharge failure in a printhead with the above-described structure will now herein be explained.

Figure 26:
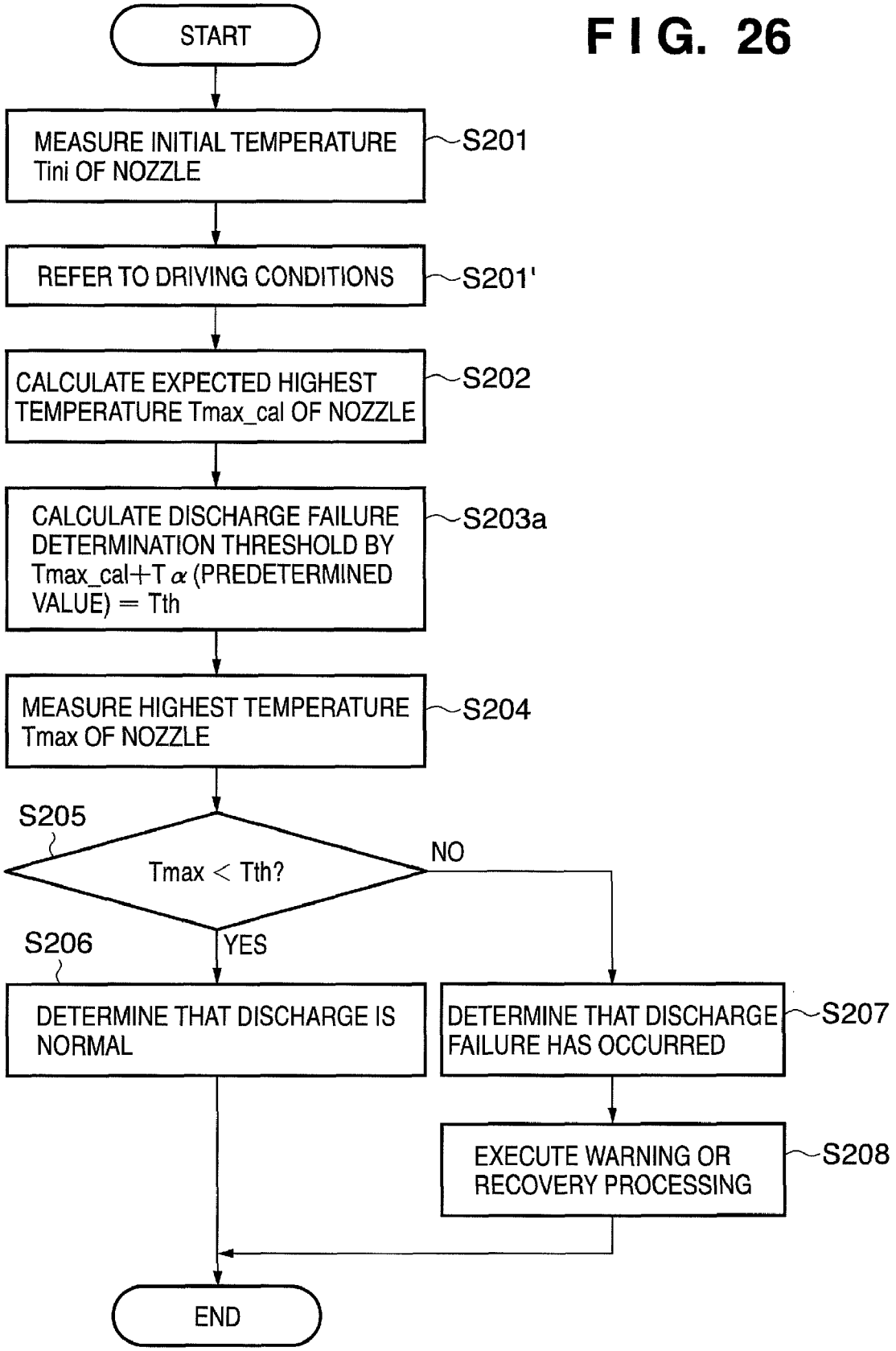
FIG. 26 is a flowchart showing nozzle discharge failure determination processing according to the fifth embodiment of the present invention.
Figure 27:
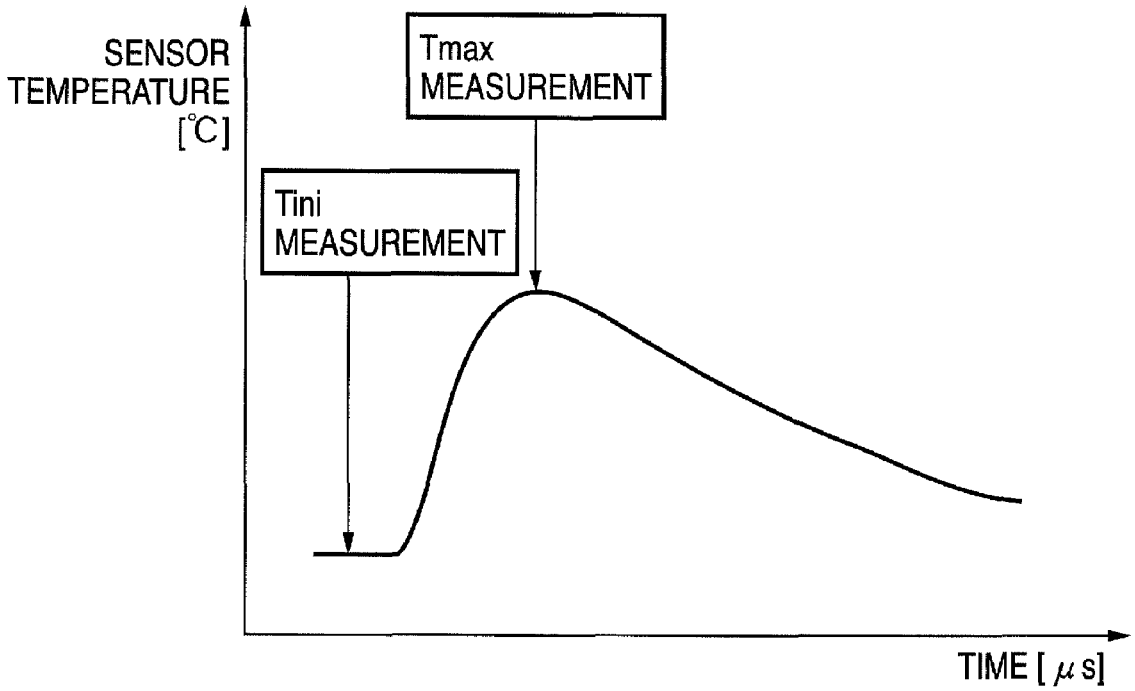
FIG. 27 is a graph showing a change of the sensor temperature over time when nozzle discharge failure determination is performed according to the fifth embodiment of the present invention.

FIG. 26 is a flowchart showing nozzle discharge failure determination processing. While, FIG. 27 is a graph showing a change of the internal nozzle temperature over time during printing that is measured by a sensor 5. Note that FIG. 27 shows a temperature change upon performing the discharge operation once.

Discharge failure determination processing will be explained with reference to FIGS. 26 and 27. In step S201, the initial temperature ($T_{ini}$) of the nozzle immediately before applying a driving signal is measured. In step S201', driving conditions (application pulse width, type of application pulse, and application voltage value) set to the nozzle are referred to.

In step S202, the expected highest temperature Tmax_cal of the nozzle is calculated using the initial temperature ($T_{ini}$) of the nozzle and information on the driving conditions referred to in step S201' on the basis of a matrix table of the initial temperature ($T_{ini}$) of the nozzle and the driving conditions shown in FIG. 28. In step S203*a*, as shown in FIG. 29, a predetermined value Tα is added to the expected highest temperature Tmax_cal of the nozzle obtained from the matrix table of the initial temperature ($T_{ini}$) of the nozzle and the driving conditions. Consequently, the nozzle discharge failure determination threshold Tth is calculated by $$Tth = T\max_cal + T\alpha \quad (4)$$

In step S204, the highest temperature Tmax of the nozzle immediately after the end of pulse application to the heater 3 is measured. In step S205, the highest temperature Tmax of the nozzle measured in step S204 is compared with the discharge failure determination threshold Tth calculated in step S203*a*. If Tmax<Tth holds, the process advances to step S206 to determine that the discharge is normal. If Tmax≧Tth holds, the process advances to step S207 to determine that a discharge failure has occurred. The process advances to step S208 to execute warning or recovery processing.

Figure 30:
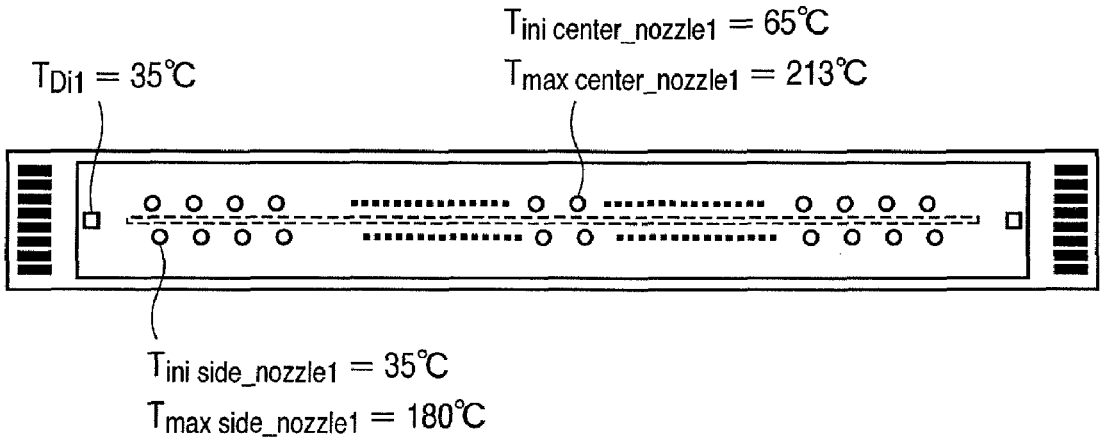
FIG. 30 is a schematic view for explaining a change of the highest temperature depending on the difference in the initial nozzle temperature according to the fifth embodiment of the present invention.

FIG. 30 is a schematic view when initial nozzle temperatures on the heater board are different. While, FIG. 31 is a graph showing nozzle temperature profiles at the end and center of the heater board when elapsed times T1, T2, and T3 from the origin of the heater-applied driving voltage shown in FIG. 24 are 0.10, 0.40, and 0.70 μsec, respectively.

Figure 31:
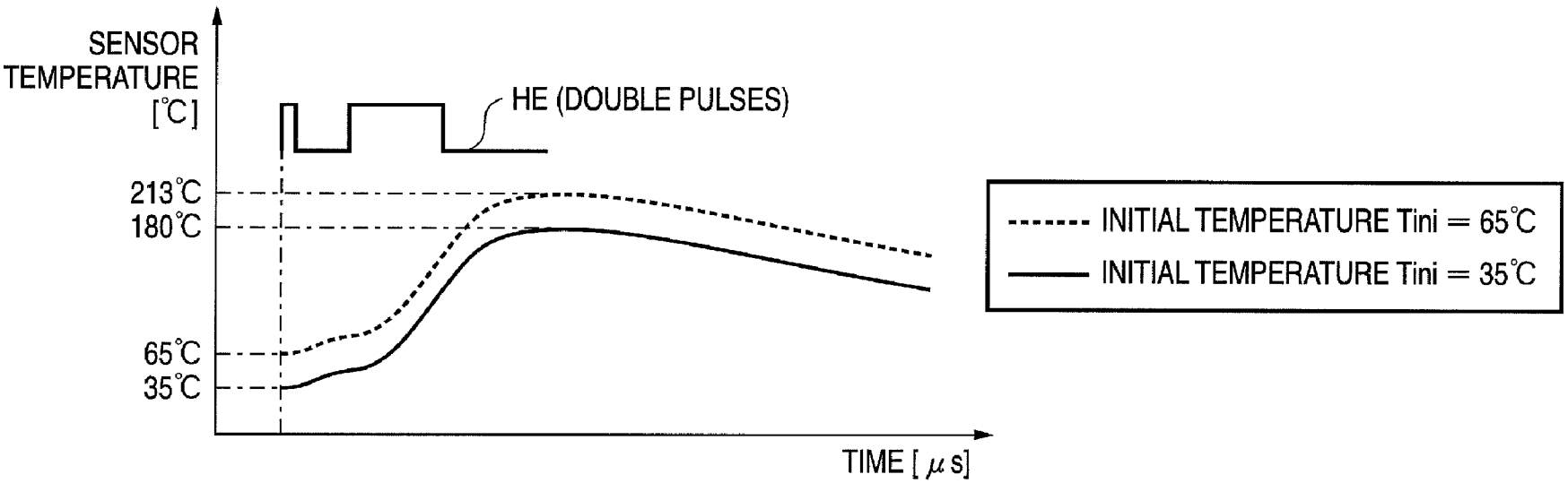
FIG. 31 is a graph for explaining a change of the internal nozzle temperature depending on the difference in the initial nozzle temperature according to the fifth embodiment of the present invention.

In FIG. 31, the temperature $T_{Di1}$ detected by a diode sensor arranged at the end of the heater board for which driving conditions are decided is 35° C., and the initial nozzle temperature $T_{ini\ side_nozzle1}$ at the end of the heater board is 35° C. The initial nozzle temperature $T_{ini\ center_nozzle1}$ at the center of the heater board is 65° C.

The highest temperature was 180° C. when the initial nozzle temperature was 35° C., and 213° C. when the initial temperature was 65° C. Even under the same driving conditions, different initial nozzle temperatures result in different heat temperature rises ΔT of 145° C. ($T_{ini}$=35° C.) and 148° C. ($T_{ini}$=65° C.) The heat temperature rise ΔT represents the difference between the highest temperature and the initial nozzle temperature.

As another example, a case in which driving conditions are different at the same initial nozzle temperature will be explained with reference to FIGS. 32A, 32B, and 33.

Figure 32A:
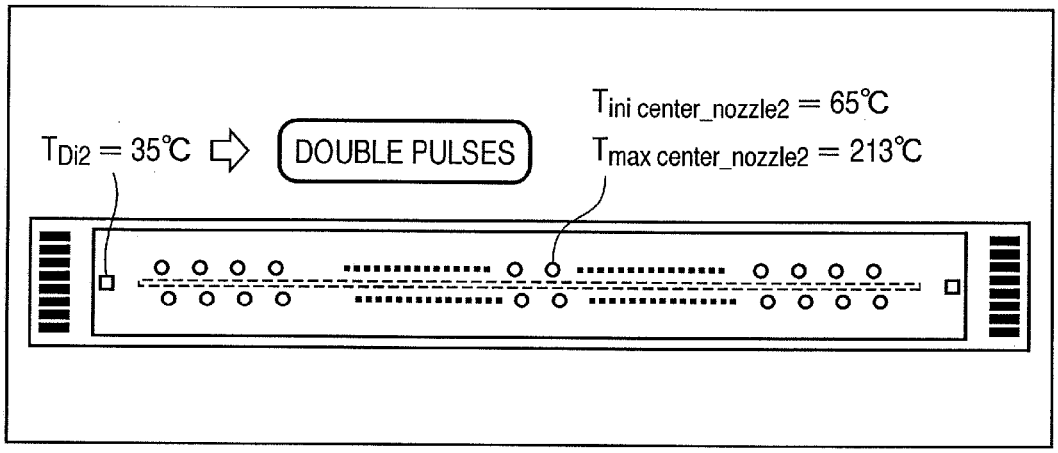
FIGS. 32A and 32B are schematic views for explaining a change of the highest temperature depending on the difference in driving conditions according to the fifth embodiment of the present invention.

As shown in FIG. 32A, the temperature $T_{Di2}$ detected by the diode sensor arranged at the end of the heater board for which driving conditions are decided is 35° C., and the initial nozzle temperature $T_{ini\ center_nozzle2}$ at the center of the heater board is 65° C. In FIG. 32B, the temperature $T_{Di3}$ detected by the diode sensor arranged at the end of the heater board for which driving conditions are decided is 65° C., and the initial nozzle temperature $T_{ini\ center_nozzle3}$ at the center of the heater board is 65° C.

Figure 32B:
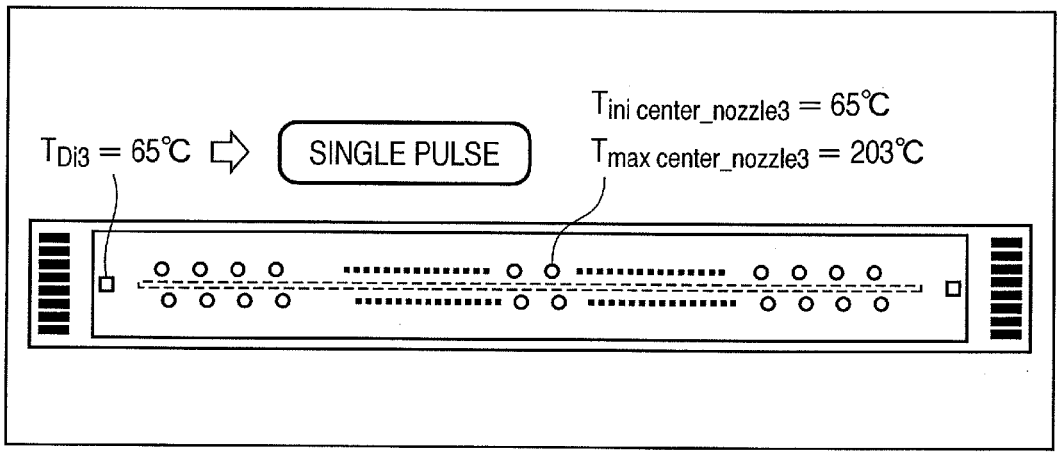
Figure 33:
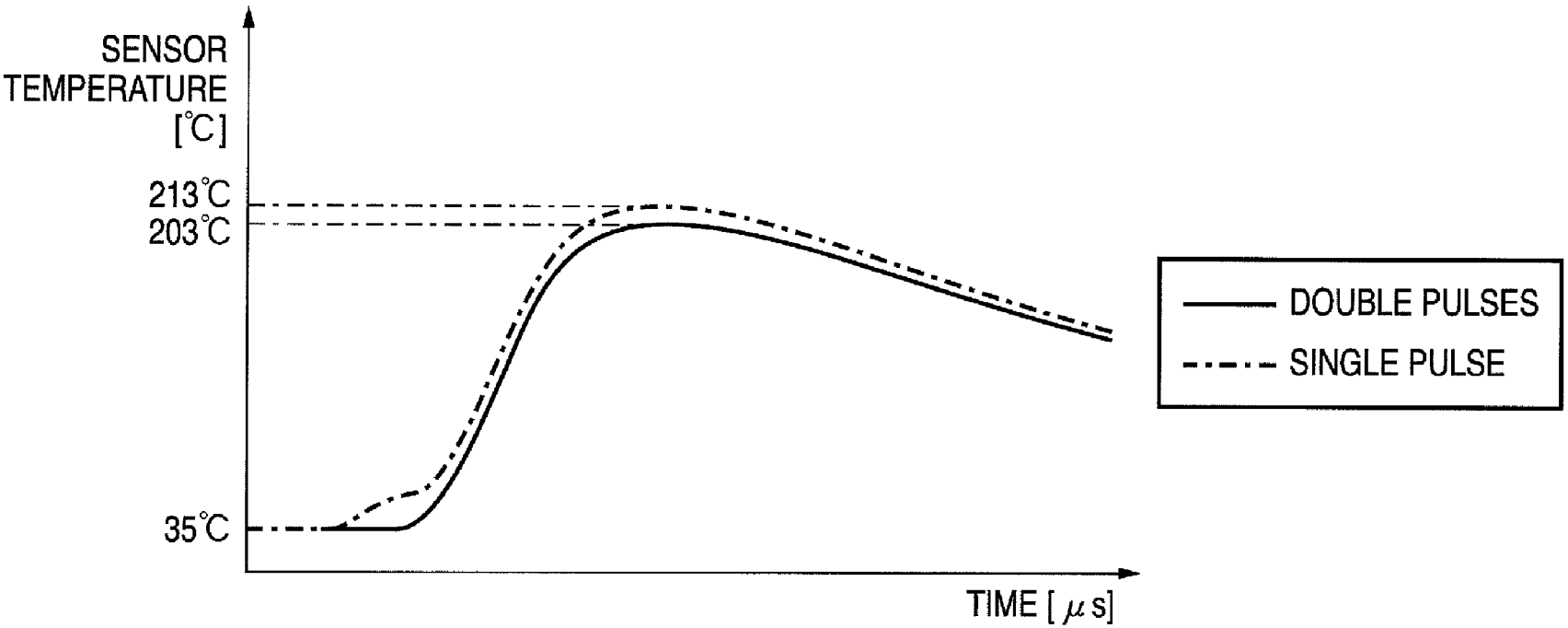
FIG. 33 is a graph for explaining a change of the internal nozzle temperature depending on the difference in driving conditions according to the fifth embodiment of the present invention.

FIG. 33 is a graph showing nozzle temperature profiles at the center of the heater board in the states shown in FIGS. 32A and 32B. When the temperature $T_{Di2}$ detected by the diode sensor is 35° C., pulses applied to the heater are double pulses including the pre-heat pulse, interval time, and main heat pulse (t1, t2, and t3=0.10, 0.40, and 0.70 μsec). The highest temperature upon inputting this signal is 213° C. When the temperature $T_{Di3}$ detected by the diode sensor is 65° C., a pulse applied to the heater is a single pulse of only the main heat pulse (t3=0.75 μsec). The highest temperature upon inputting this signal is 203° C.

Even at the same initial nozzle temperature, different driving conditions result in different heat temperature rises ΔT of 148° C. (double pulses) and 138° C. (single pulse). The heat temperature rise ΔT represents the difference between the highest temperature and the initial nozzle temperature.

The fifth embodiment accurately performs discharge failure determination by measuring an initial nozzle temperature, and calculating the expected highest temperature of the nozzle using the matrix table shown in FIG. 29 on the basis of driving conditions and the information on the initial nozzle temperature.

The discharge failure determination threshold shown in FIG. 29 is set by adding, to the expected highest temperature Tmax_cal of the nozzle calculated from the initial temperature ($T_{ini}$) of the nozzle, a predetermined value Tα large enough to prevent a determination error caused by a noise signal and small enough to determine a discharge failure immediately after occurrence.

Figure 34:
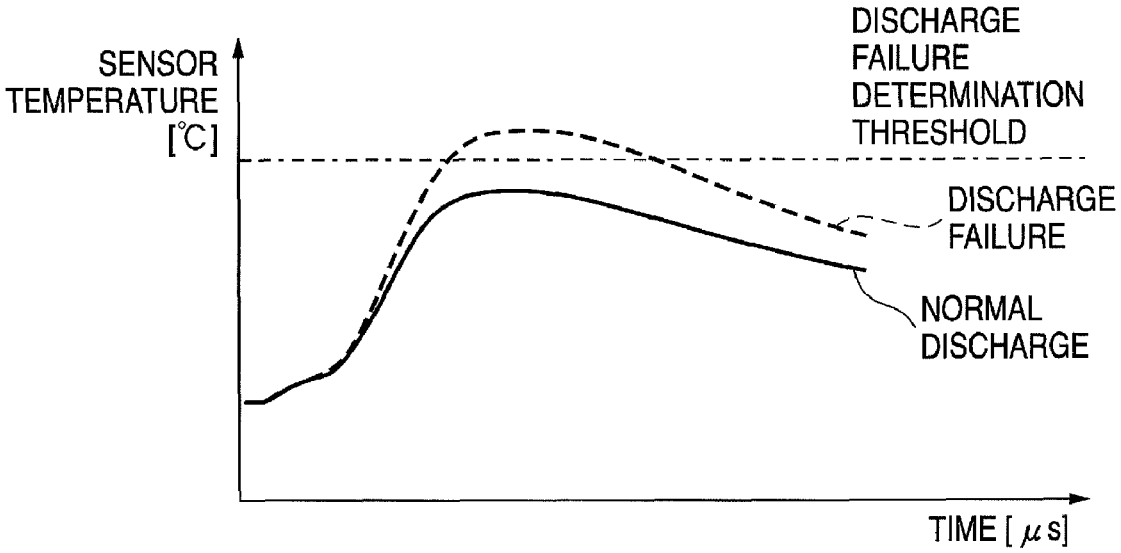
FIG. 34 is a graph for explaining discharge failure determination according to the fifth embodiment of the present invention.

The highest temperature of the nozzle is compared with the discharge failure determination threshold set in this fashion, as shown in FIG. 34. It is determined that the discharge is normal if Tmax<Tth holds, and that a discharge failure has occurred if Tmax≧Tth holds.

Sixth Exemplary Embodiment

The configuration described in the fifth embodiment sets the discharge failure determination threshold by adding a predetermined value to the expected highest temperature Tmax_cal of the nozzle. The sixth embodiment can set a higher-precision discharge failure determination threshold by adding, to the expected highest temperature Tmax_cal of the nozzle, a variable Tβ whose parameters are the initial nozzle temperature and driving conditions. The sixth embodiment can make a detailed discharge failure determination such as a discharge failure due to dust or a discharge failure due to wet.

Figure 35:
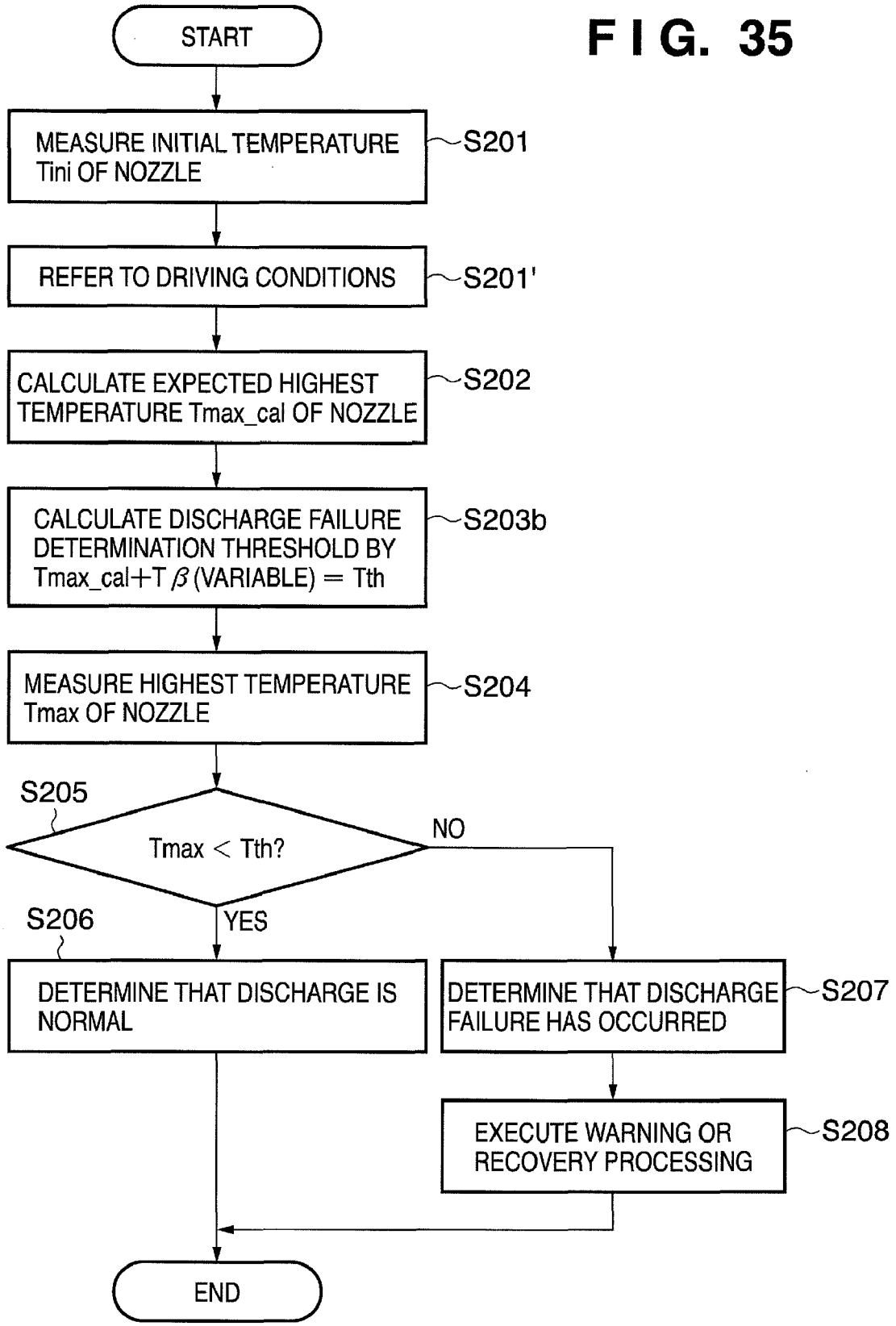
FIG. 35 is a flowchart showing nozzle discharge failure determination processing according to the sixth embodiment of the present invention.

FIG. 35 is a flowchart showing nozzle discharge failure determination processing according to the sixth embodiment.

In steps S201, S201', and 5202, the expected highest temperature of the nozzle is calculated using the initial nozzle temperature and information on driving conditions, as described in the fifth embodiment (see FIG. 26). Steps that are similar to those in FIG. 26 are identified using the same reference numbers.

In step S203*b*, the discharge failure determination threshold adjustment factor Tβ to determine a discharge failure at high precision is calculated from a matrix table of the initial temperature ($T_{ini}$) of the nozzle and the driving conditions, as shown in FIG. 36. The nozzle discharge failure determination threshold Tth is calculated by adding the discharge failure determination threshold adjustment factor Tβ to the expected highest temperature Tmax_cal of the nozzle calculated in step S202:

$$Tth = T\max_cal + T\beta \quad (5)$$

In the next and subsequent steps, the discharge failure determination threshold Tth is calculated from the initial temperature ($T_{ini}$) of the nozzle and the driving conditions, and compared with the highest temperature Tmax of the nozzle to determine a discharge failure, as described in the fifth embodiment. Since the discharge failure determination threshold can be high-precisely set, the cause of the discharge failure can also be determined.

Seventh Exemplary Embodiment

In the seventh embodiment, the reason why a plurality of discharge operations are to be considered prior to a description of discharge failure determination processing when a plurality of discharge operations are taken into consideration will be described first.

Figure 37:
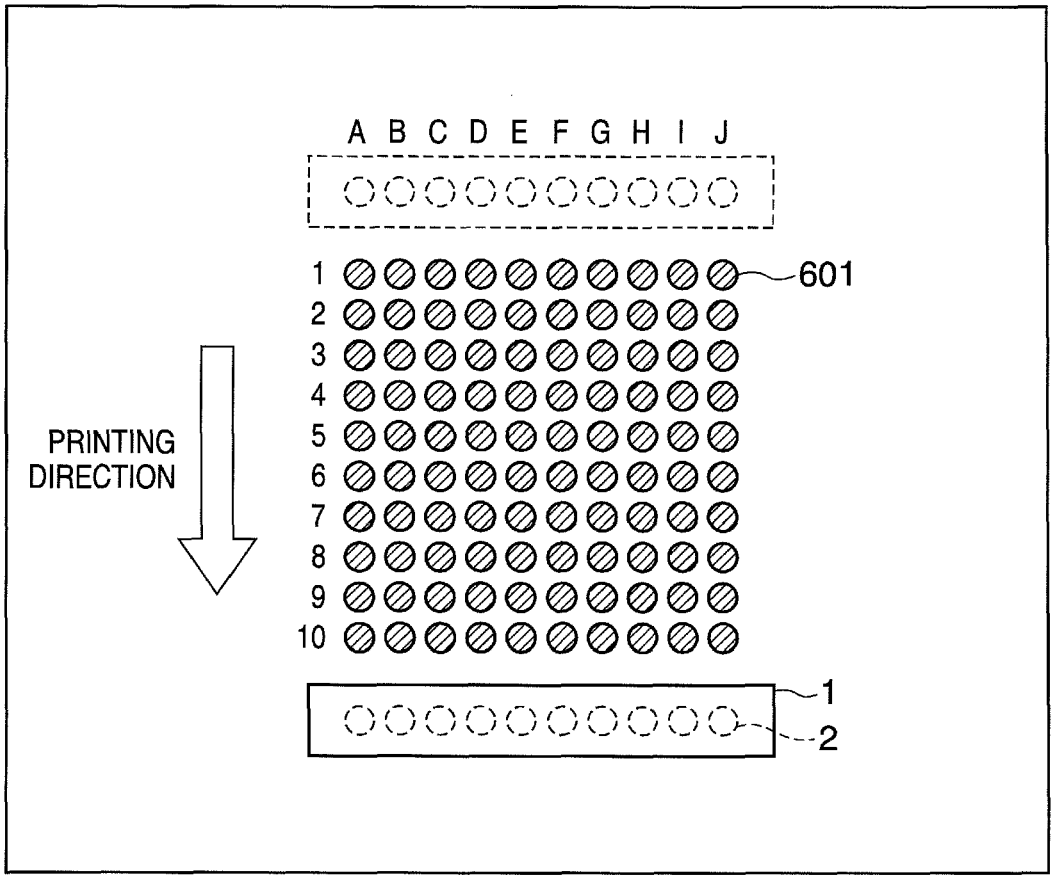
FIG. 37 is a view showing a printed image and printhead operation status according to the seventh embodiment.

FIG. 37 is a view showing a printing state. In FIG. 37, reference numeral 1 denotes a printhead; 2, nozzles; and 601, printed dots. In FIG. 37, the printhead 1 has 10 nozzles A to J. While discharging ink from the nozzles, the printhead 1 moves relatively from top to bottom in FIG. 37, forming an image. In the example shown in FIG. 37, the printing duty is 100%.

Figure 38:
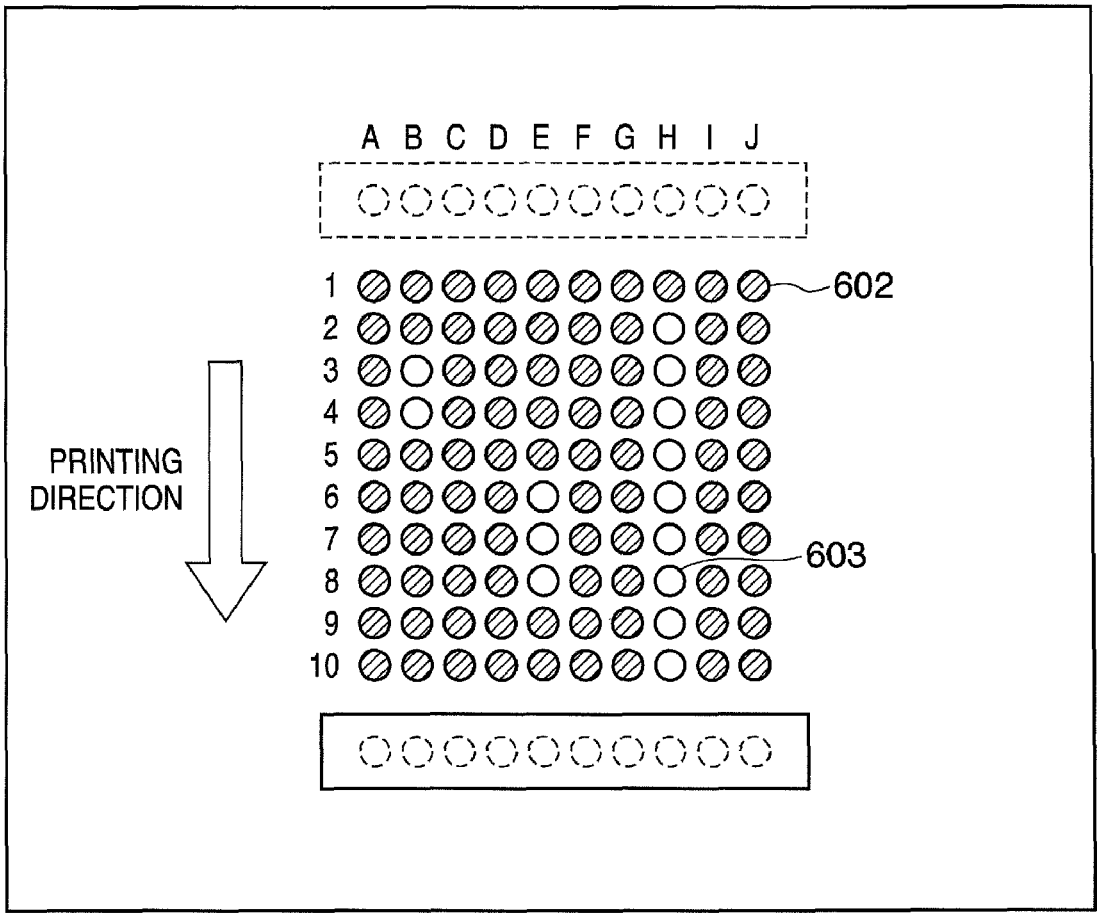
FIG. 38 is a view showing an example of a discharge failure generated in actual printing.

FIG. 38 is a view showing a state in which a discharge failure occurs. In this state, a printhead having 10 nozzles A to J, similar to FIG. 37, prints the first to 10th rows in FIG. 38. Although the printing duty of the printed image is 100%, some dots are not printed, as shown in FIG. 38. Open circles 603 represent unprinted dots, while circles with cross-hatching 602 represent printed dots. More specifically, no dot is printed on the third and fourth rows of column B, the sixth to eighth rows of column E, and the second to 10th rows of column H because no ink is discharged.

Printing states on columns B and E should be noted. In this example, nozzles recover from discharge failures after several dots, and normally discharge dots. This phenomenon occurs in actual printing because of various causes such as temporary shortage of the refill, disappearance of a bubble generated in a nozzle by some chance, and removal of dust attached once to a nozzle after several discharge operations. To the contrary, the nozzle on column H does not discharge any dot on the second and subsequent rows.

The seventh embodiment changes the determination method depending on how to treat the nozzles on columns B and E in the state shown in FIG. 38. More specifically, the seventh embodiment adopts "a case of not accepting even a single faulty dot (determination procedure A)", and "a case of accepting several faulty dots (determination procedure B)". To perform the latter case "determination procedure B", a plurality of discharge operations must be considered. "Determination procedure A" and "determination procedure B" will now be explained. Determination procedure A has already been employed in the above-described embodiments. This will be simply explained with reference to FIGS. 39 and 41.

Figure 39:
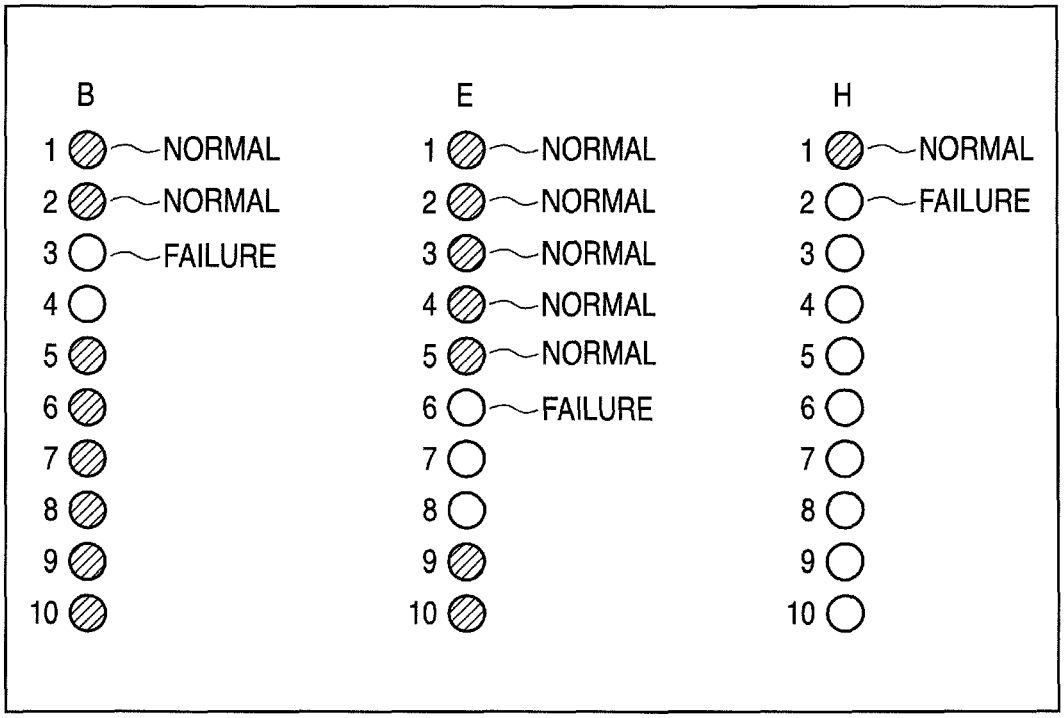
FIG. 39 is a view for explaining an application of a discharge failure determination method based on one printing operation.

FIG. 39 is a view showing columns B, E, and H extracted from FIG. 38. In FIG. 39, shaded circles represent ink-discharged dots, and open circles represent ink-undischarged dots. The flowchart of "determination procedure A" shown in FIG. 41 is applied to the printing state shown in FIG. 39.

Figure 41:
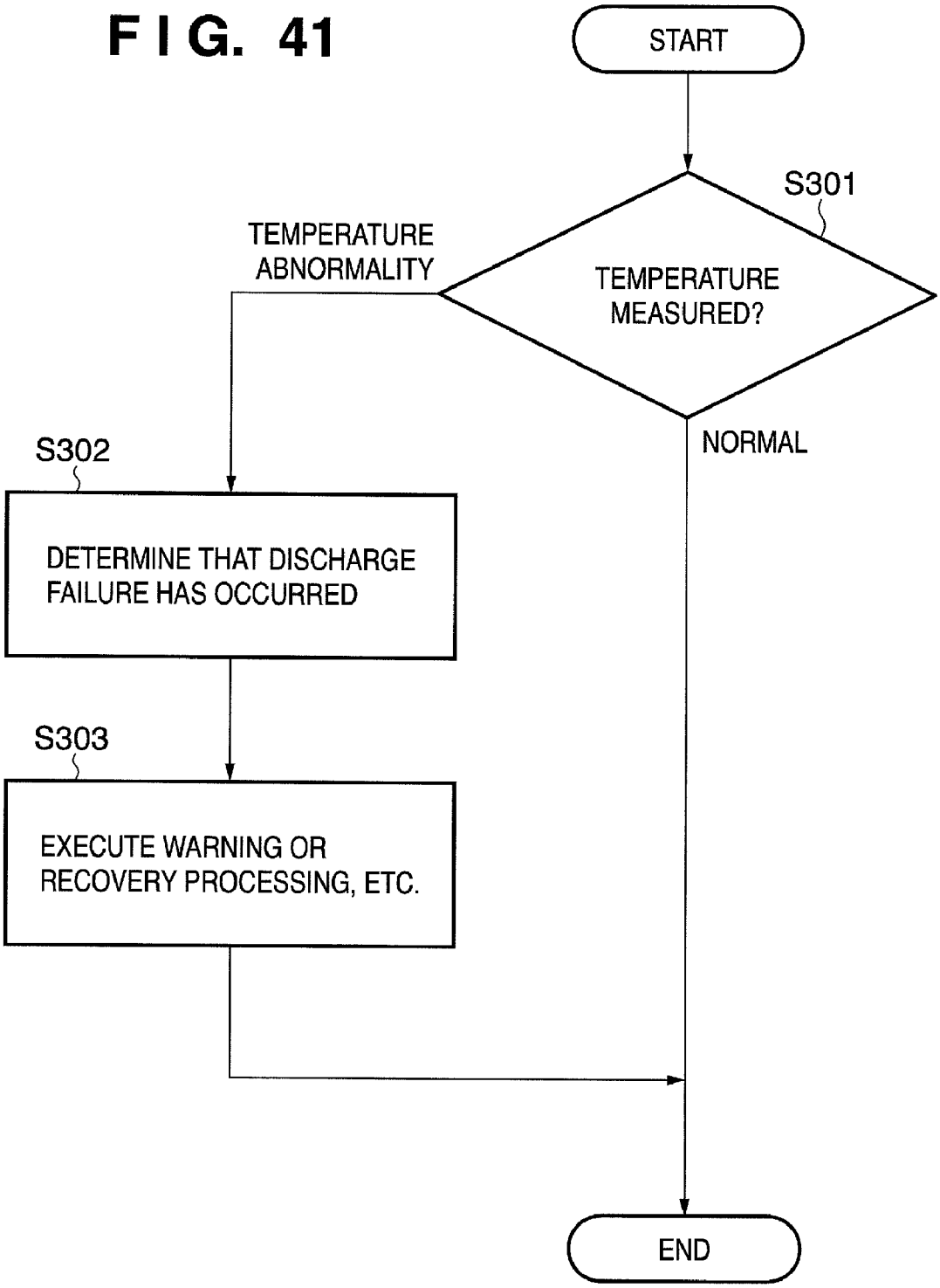
FIG. 41 is a flowchart showing discharge failure determination processing by determination procedure A.

The flowchart shown in FIG. 41 is a simplified flow obtained by summarizing the flowcharts explained in the above-mentioned embodiments. In step S301, it is determined whether the heater temperature of the printhead is "normal" or "not normal (temperature abnormality)". In step S302, "discharge failure determination" typifies various discharge abnormality determination processes. In step S303, warning and/or recovery processing, etc. is executed. Then the process ends.

Assume that determination procedure A shown in FIG. 41 is applied to the printing state shown in FIG. 39. On column B, it is determined that the discharge is normal on the first and second rows, and a temperature abnormality is detected on the third row to determine that a discharge failure has occurred. Similarly, it is determined that discharge failure has occurred on the sixth row of column E and the second row of column H.

Figure 40:
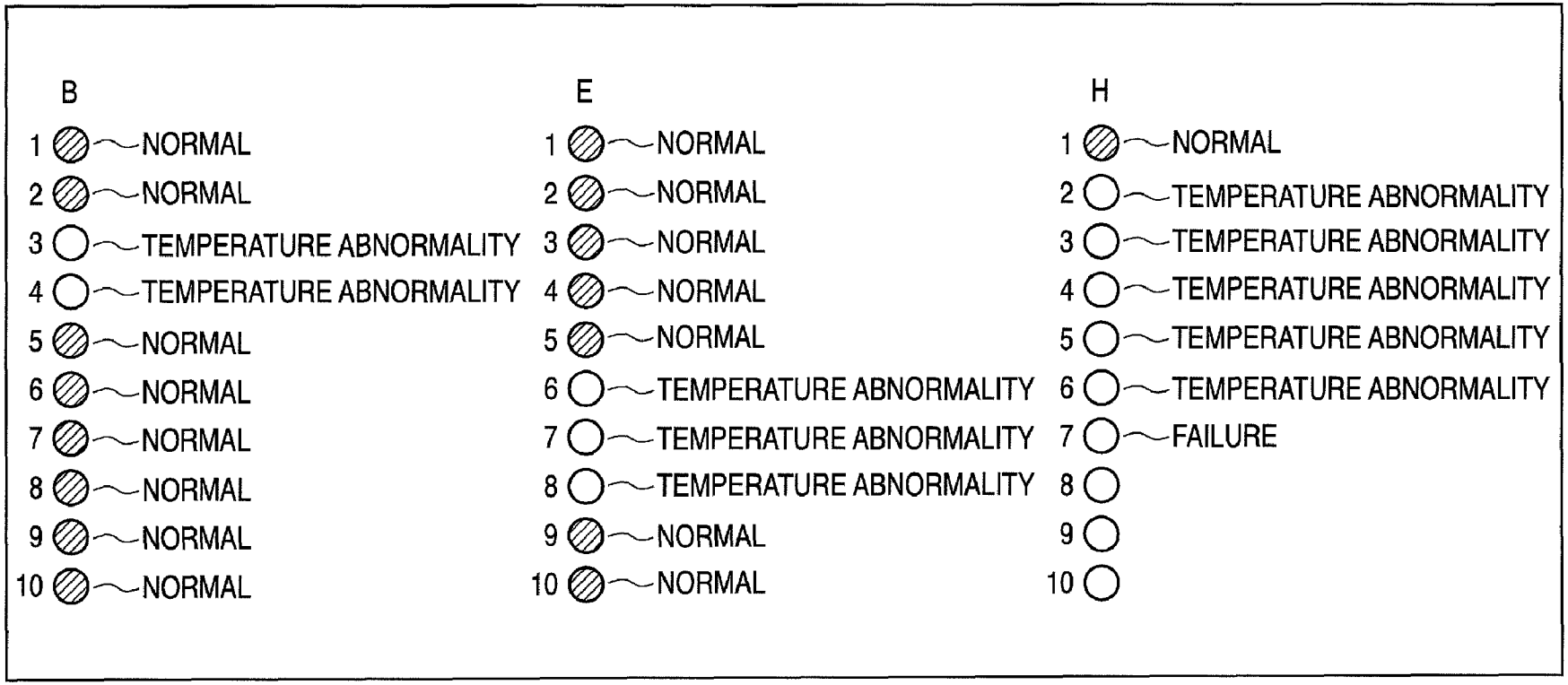
FIG. 40 is a view for explaining an application of a discharge failure determination method according to the seventh embodiment.

Determination procedure B will be explained with reference to FIGS. 40 and 42. FIG. 40 is a view showing columns B, E, and H extracted from FIG. 38. In FIG. 40, shaded circles represent ink-discharged dots, and open circles represent ink-undischarged dots. The flowchart of determination procedure B shown in FIG. 42 is applied to the printing state shown in FIG. 40.

The flowchart shown in FIG. 42 will now be explained. Steps similar to those in FIG. 41 have the same reference numbers and description will not be repeated.

In step S301, it is determined whether the heater temperature of the printhead is "normal" or "not normal (temperature abnormality)". If a temperature abnormality is detected, the temperature of the same nozzle is measured again in step S301'. If a normal temperature state is detected, it is determined that the discharge is normal. If a temperature abnormality is detected in step S301', the process determines in step S301" whether the detection has been done a plurality of times (six times in the seventh embodiment). If the number of times does not reach six, the temperature of the same nozzle is measured again in step S301'. If it is determined that the temperature state is normal, the discharge is treated as being normal. If a temperature abnormality is detected, it is checked in step S301" whether the detection has been done a predetermined number of times (six times in this case). If a temperature abnormality is detected a predetermined number of times (six times in this case), the process determines a "discharge failure" in step S302.

Figure 42:
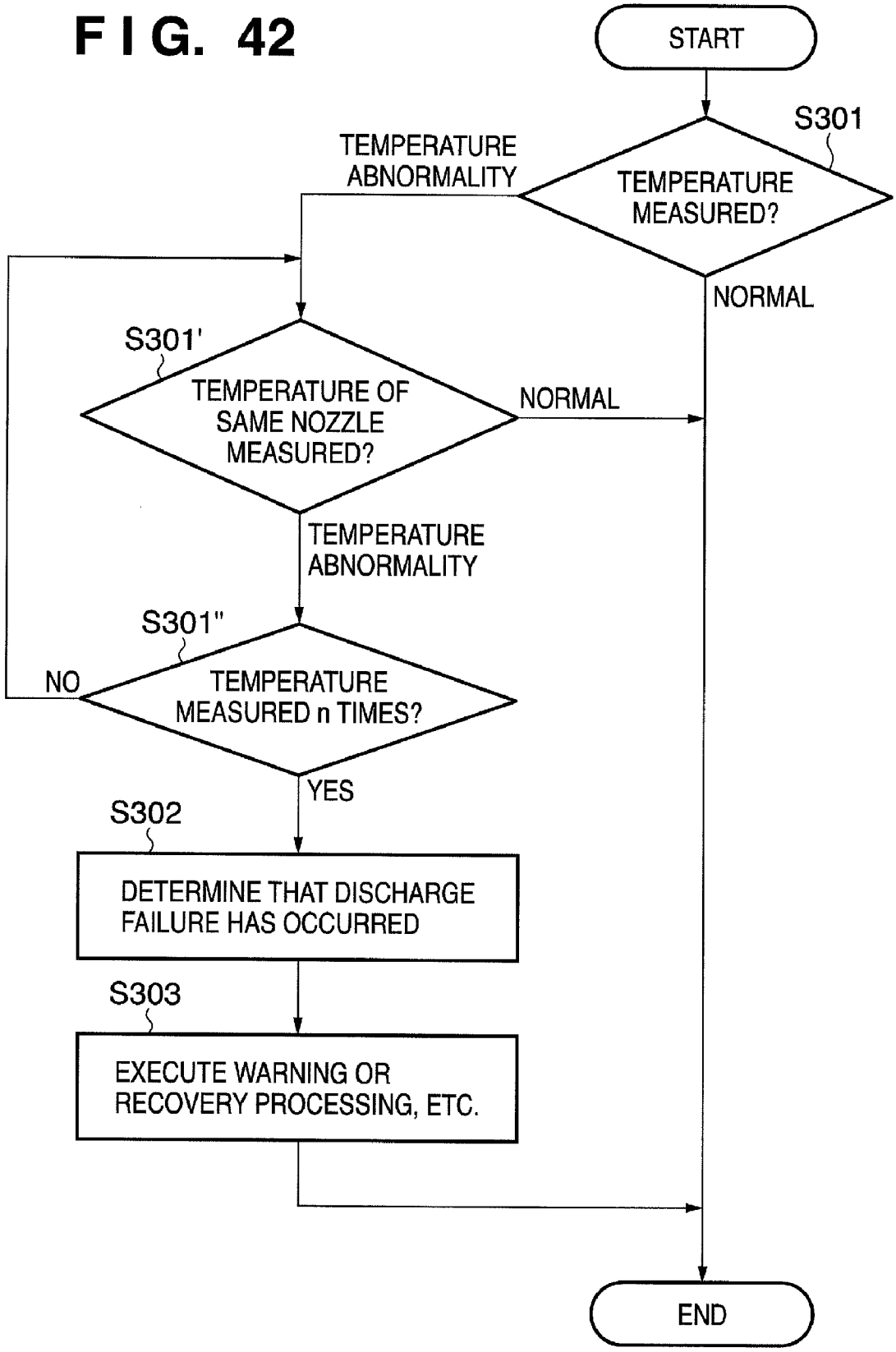
FIG. 42 is a flowchart showing discharge failure determination processing by determination procedure B.

Determination procedure B shown in FIG. 42 is applied to the printing state shown in FIG. 40. On column B, it is determined that the discharge is normal on the first and second rows. A temperature abnormality is detected on the third row (first time), and a temperature abnormality is also detected on the fourth row (second time). However, it is determined that the discharge is normal on the fifth row, and "normal" determination continues on subsequent rows.

Similarly, on column E, it is determined that the discharge is normal on the first to fifth rows. A temperature abnormality is detected on the sixth row (first time), a temperature abnormality is detected on the seventh row (second time), and a temperature abnormality is also detected on the eighth row (third time). However, it is determined that the discharge is normal on the ninth row, and "normal" determination continues on subsequent rows. On column H, however, it is determined that the discharge is normal on the first row. A temperature abnormality is detected on the second row (first time), a temperature abnormality is detected on the third row (second time), and a temperature abnormality is also detected on the fourth row (third time). Temperature abnormalities continue on the fifth row (fourth time) and sixth row (fifth time), and the sixth temperature abnormality is detected on the seventh row. Since the temperature abnormality is detected six times, the process in FIG. 42 advances from step S301" to step S302 to determine that a "discharge failure" has occurred on column H.

By applying determination procedure B shown in FIG. 42 to the printing state shown in FIG. 40, discharge failure determination processing considering a plurality of discharge failure operations is executed. Thus, it is possible to "accept several faulty dots".

Eighth Exemplary Embodiment

The above-mentioned embodiments determine a discharge failure on the basis of a single measurement value of a given nozzle. Especially a case of determining a "discharge abnormality caused by ink attached to the nozzle surface" will be examined. When a "discharge abnormality caused by ink attached to the nozzle surface" occurs at a given nozzle, the nozzle often recovers from the discharge abnormality after a while, and "discharges ink normally". The decision criteria that immediately determines by a single measurement that a nozzle in this state suffers a discharge failure may be too rigid. It is conceivable that "ink attached to the nozzle surface" may attach to the vicinity of the nozzle. Thus, if attention is paid to only the faulty nozzle, many discharge failures of surrounding nozzles may be missed.

For these reasons, the eighth embodiment provides an effective determination method for a "discharge abnormality caused by ink attached to the nozzle surface" among several types of discharge failures.

The state of a discharge failure due to a "discharge abnormality caused by ink attached to the nozzle surface" will be explained. If ink (in the form of the satellite or mist) attaches to the surface of a discharge orifice, as shown in FIG. 8, ink can be discharged not straight but obliquely as shown in FIG. 8. The resultant ink forms column E in FIG. 44 on a printing medium.

FIGS. 43 to 49 will next be explained. FIGS. 43 to 49 are views showing printing results on a printing medium (e.g., paper). In FIGS. 43 to 49, printing is done from top to bottom (from the first row to the 20th row) while discharging ink from 10 nozzles (not shown) corresponding to columns A to J. The printhead (having nozzles) may move from top to bottom, or the medium may move in the opposite direction while the printhead is fixed.

Figure 43:
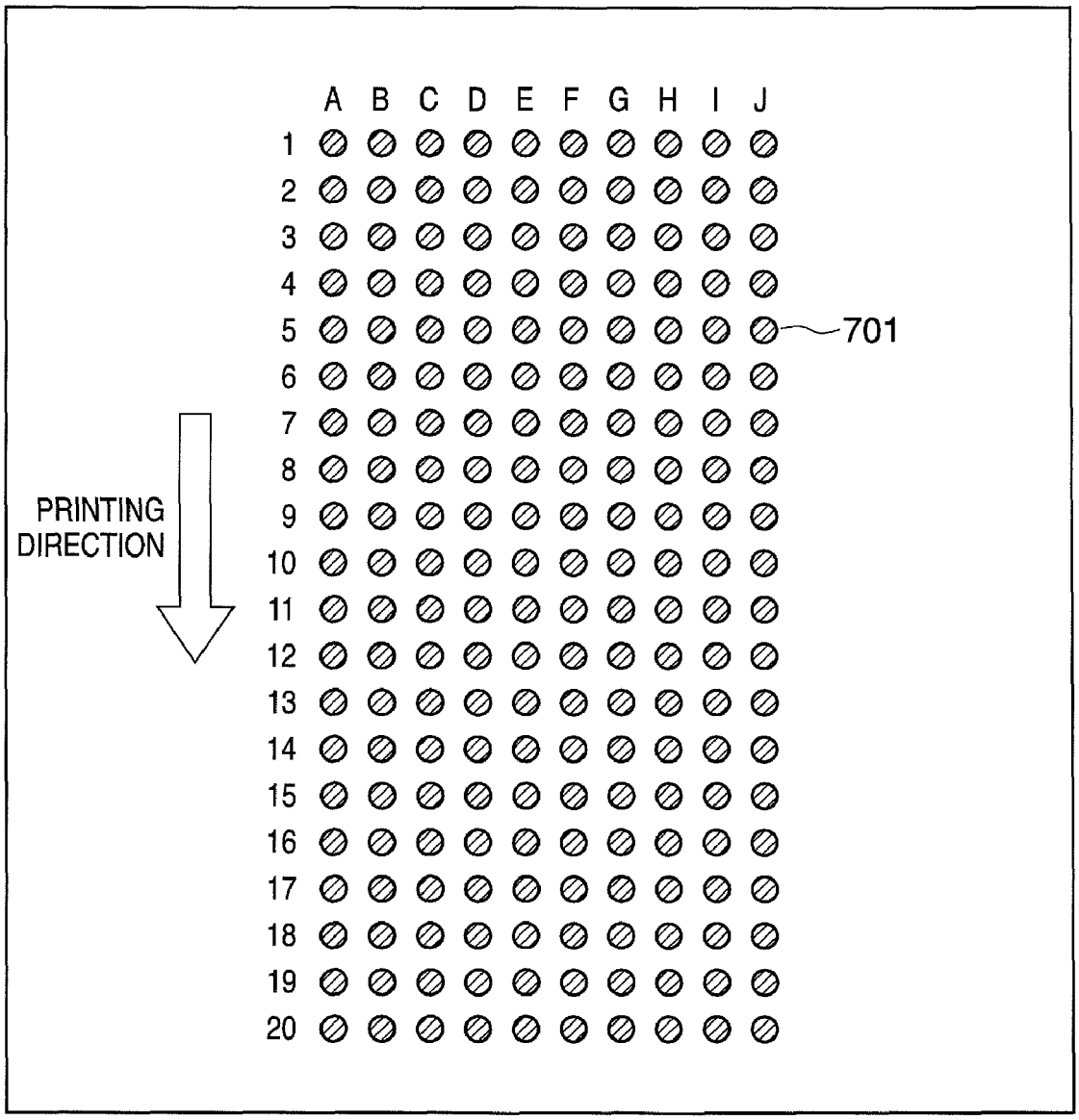
FIG. 43 is a view showing a printing result when ink is discharged normally.
Figure 44:
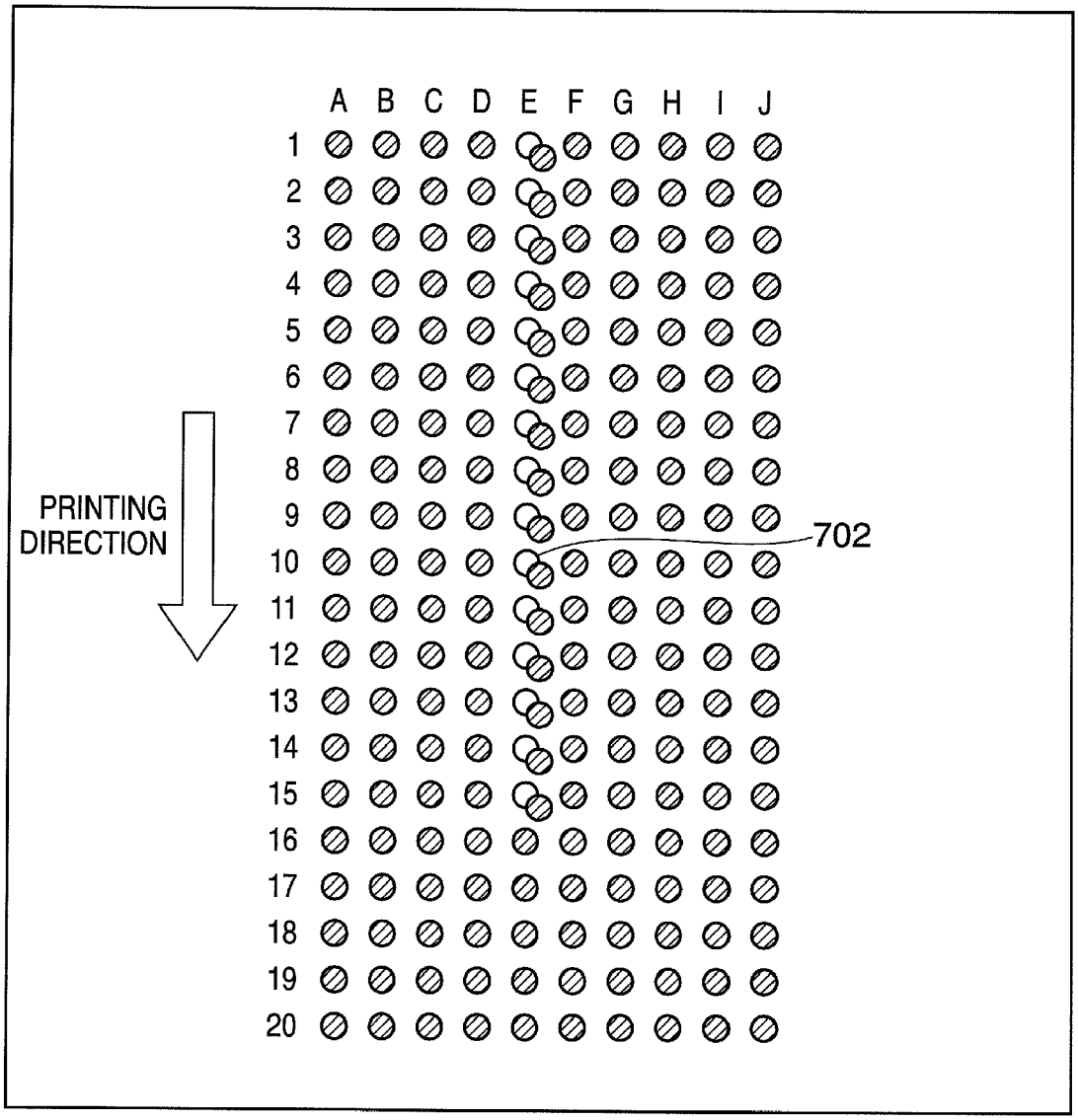
FIG. 44 is a view showing a printing result when a discharge failure occurs at one nozzle.

FIGS. 43 to 49 show that an image is printed at a printing duty of 100%. Of these drawings, FIG. 44 shows a printing in which ink shifts to lower right positions from original printing positions 702 (open circles on column E in FIG. 44) because a nozzle condition on column E becomes that shown in FIG. 8. This represents a discharge failure by a "discharge abnormality caused by ink attached to the nozzle surface".

The above-described embodiments determine a discharge failure according to the temperature profiles shown in FIGS. 5, 10, and 13 and the flowcharts shown in FIGS. 9, 12, 14A, 14B and 14C.

Figure 50:
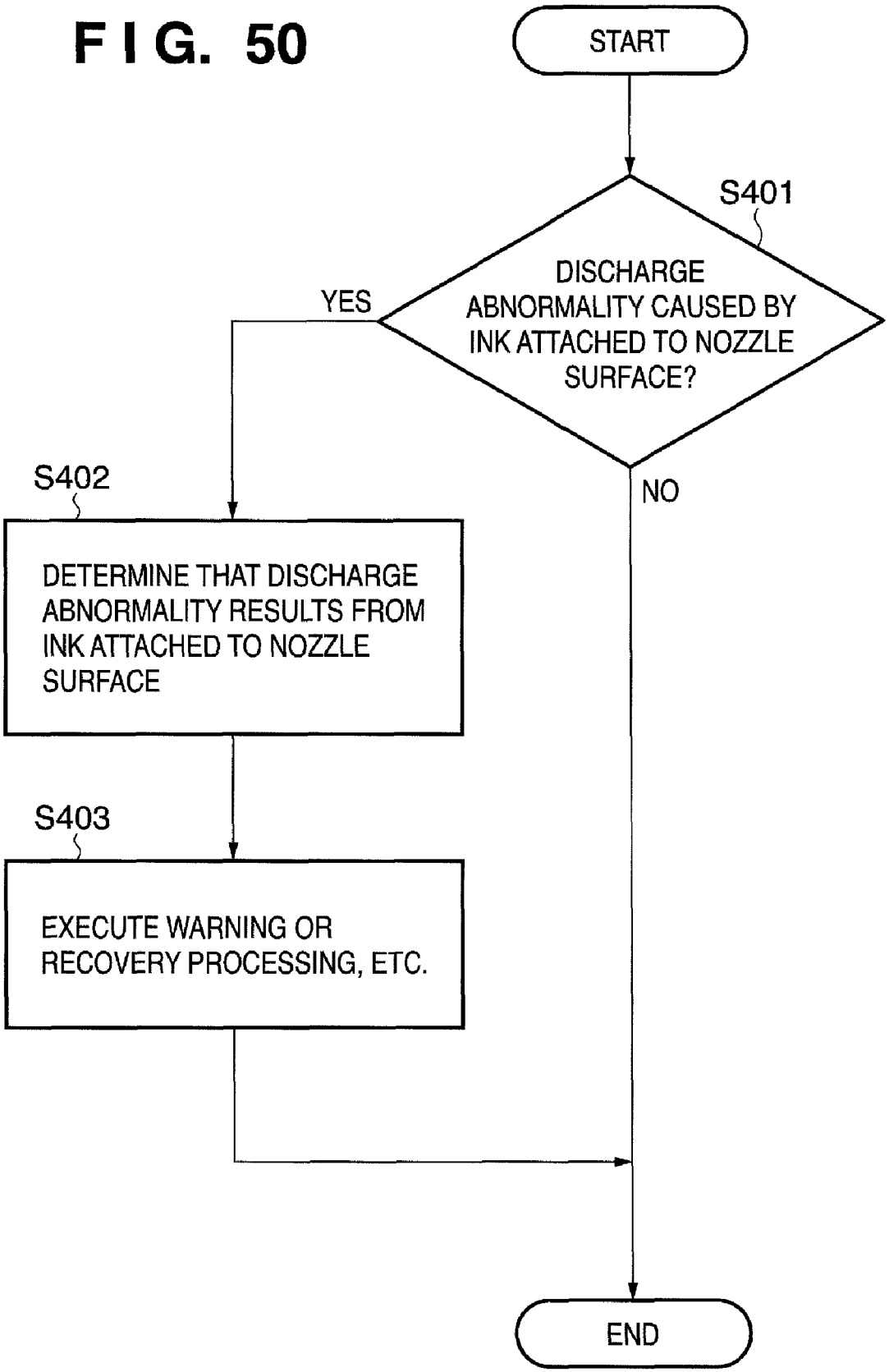
FIG. 50 is a flowchart comprehensively showing processing to determine a discharge abnormality caused by ink attached to the nozzle surface according to the first to third embodiments.

These methods can be summarized into processing as shown in FIG. 50 which pays attention to only determination of a "discharge abnormality caused by ink attached to the nozzle surface".

According to the flowchart shown in FIG. 50, the head temperature is measured, and an expected temperature is calculated to compare these temperatures with each other. In step S401, it is determined on the basis of the comparison result whether a "discharge abnormality caused by ink attached to the nozzle surface" has occurred or "another state (normal discharge, an abnormality caused by the residual bubble, an abnormality caused by clogging of the liquid channel with dust, or an abnormality caused by clogging of the discharge orifice with dust)" has occurred.

The discharge abnormality caused by ink attached to the nozzle surface has the following two particular tendencies.

(1) A discharge abnormality by ink (in the form of the satellite or mist) attached to the discharge orifice surface often occurs not at a single nozzle, but at a group of nozzles. If this discharge abnormality occurs at only a single nozzle, surrounding nozzles are possibly about to suffer the discharge abnormality by attached ink. Ink floating in air in the form of the satellite or mist attaches to the discharge orifice surface at random. For this reason, ink is less likely to concentratedly attach to only one specific nozzle.

(2) If this discharge abnormality occurs at a single nozzle (or two or three nozzles) and the ink attachment amount is small, the nozzle recovers to normal discharge upon repetitive discharge. Ink attached to the nozzle surface is drawn into the nozzle simultaneously when ink is refilled from the liquid chamber after ink discharge, as shown in FIG. 8. Accordingly, the amount of ink attached to the nozzle surface decreases and all ink on the surface at the periphery of the nozzle orifice is finally drawn into the nozzle. Through these processes, the nozzle recovers to a normal discharge state.

Figure 45:
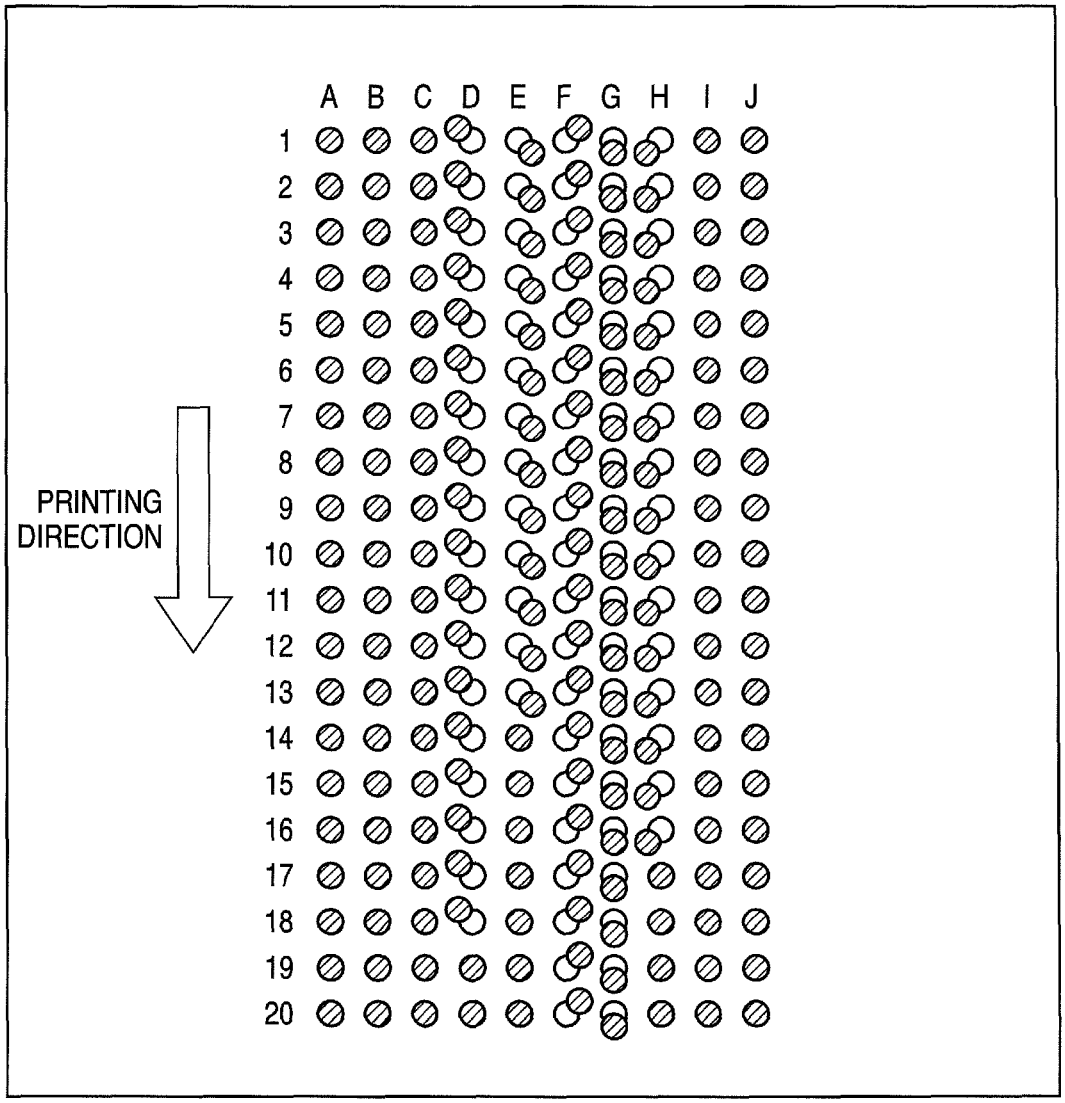
FIG. 45 is a view showing a printing result when discharge failures occur at five nozzles.

As for these two tendencies, the printing results will be described with reference to drawings. FIG. 43 is a view showing a printing result when ink is discharged normally. FIGS. 44 and 45 are views showing printing results which exhibit the above-mentioned two particular tendencies.

FIG. 44 shows that a discharge failure occurs at only a single nozzle (column E in FIG. 44) and the nozzle recovers to normal discharge during printing (between the 15th and 16th rows on column E in FIG. 44). FIG. 45 shows that a discharge failure occurs at a group of nozzles (columns D to H in FIG. 45). In FIG. 45, some nozzles on columns D, E, and H recover to normal discharge.

Figure 46:
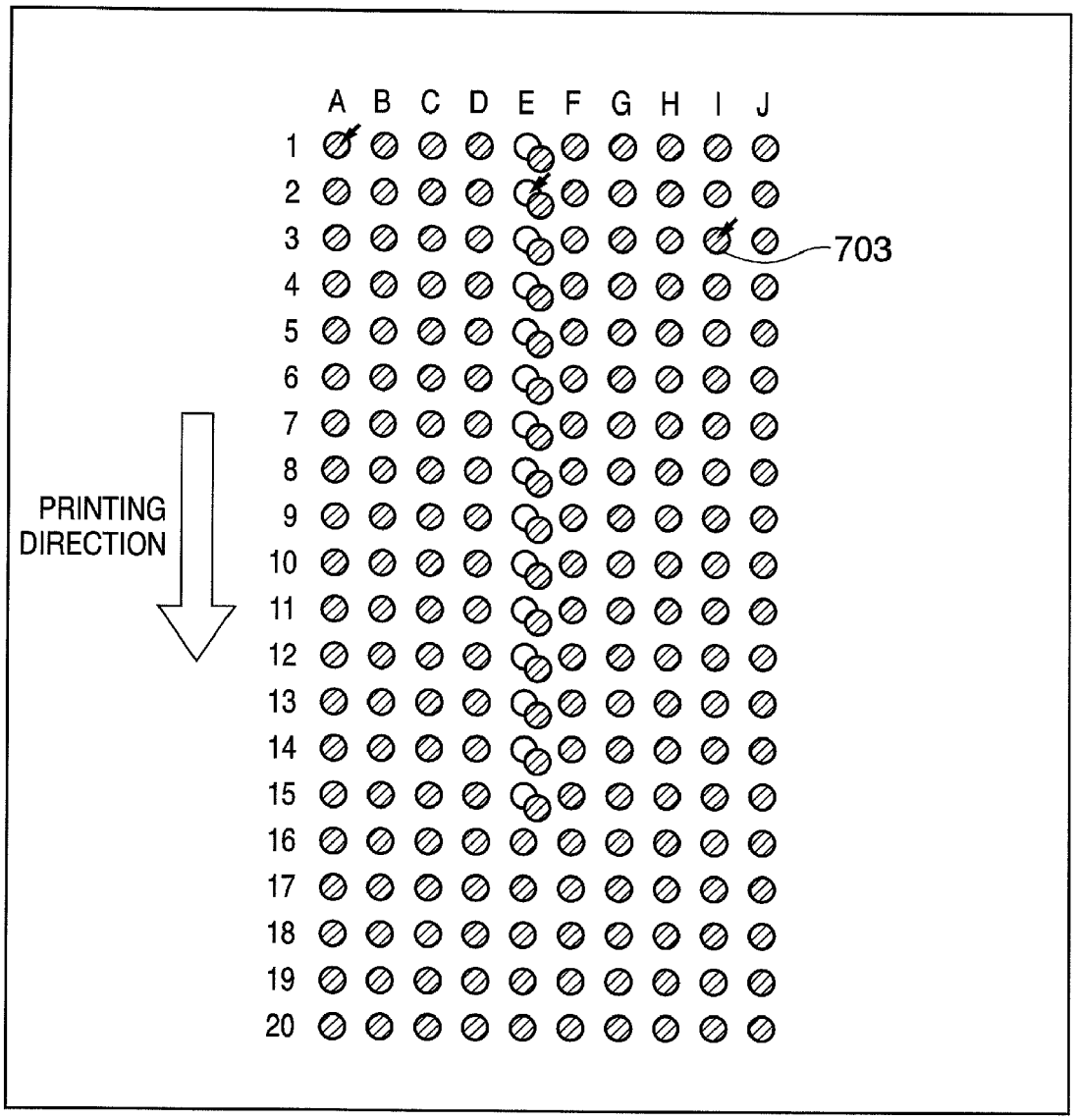
FIG. 46 is a view showing a printing result obtained by applying the determination method according to the first to third embodiments when a discharge failure occurs at one nozzle.
Figure 47:
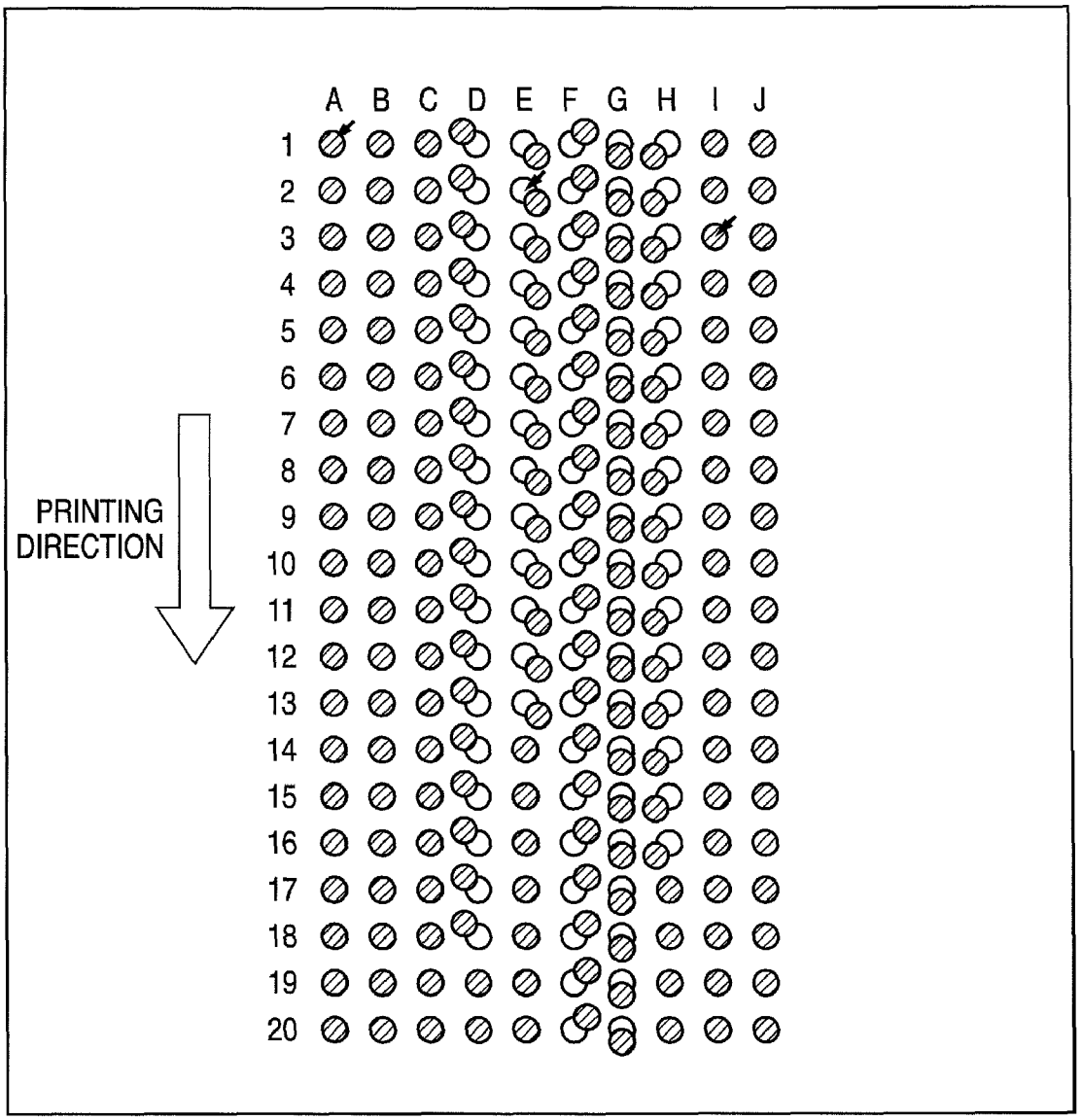
FIG. 47 is a view showing a printing result obtained by applying the determination method according to the first to third embodiments when discharge failures occur at five nozzles.

FIGS. 46 and 47 show printing results of applying processing shown in FIG. 50 to the cases shown in FIGS. 44 and 45.

In the example shown in FIG. 46, the first row on column A, the second row on column E, the third row on column I, . . . undergo discharge failure determination. Numeral 703 denotes a printed dot. On the first row of column A, it is determined that the discharge is normal. As for the second row of column E, the process advances to step S402 to "determine a discharge abnormality caused by ink attached to the nozzle surface". Then, the process advances to warning/recovery processing in step S403, and printing may be interrupted. Although the nozzle may recover to normal discharge after continuous printing, a discharge failure is determined rigidly by one determination for one nozzle.

Also in the example shown in FIG. 47, the first row on column A, the second row on column E, the third row on column I, . . . undergo discharge failure determination. On the first row of column A, it is determined that the discharge is normal. On the second row of column E, a "discharge abnormality caused by ink attached to the nozzle surface is determined". If processing after the discharge failure determination is "only warning", the process advances to determine on the third row of column I that the discharge is normal. Even after that, the determination process continues. In this case, many discharge failures on "columns D to H" are missed.

Figure 51:
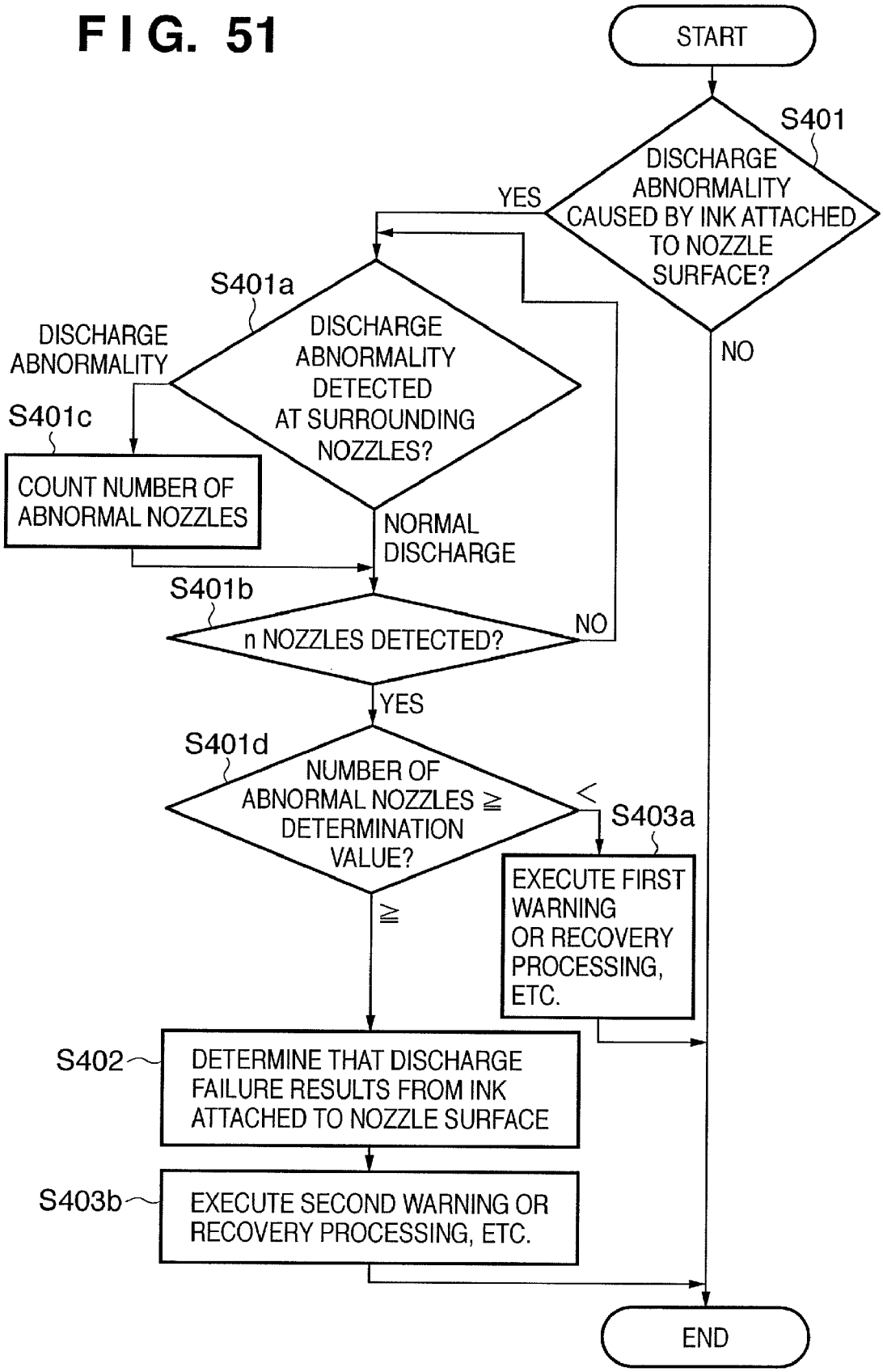
FIG. 51 is a flowchart showing processing to determine a discharge abnormality caused by ink attached to the nozzle surface according to the eighth embodiment.

To prevent this, discharge failure determination according to the eighth embodiment will be explained with reference to the flowchart shown in FIG. 51. In FIG. 51, the same step reference numerals as those described with reference to FIG. 50 denote the same steps, and a description thereof will not be repeated.

If an abnormality is detected at one nozzle in step S401, the process advances to step S401*a* to make a similar detection on one of nozzles around the detected nozzle. If a discharge abnormality is detected at the surrounding nozzle, the number of abnormal nozzles is counted in step S401*c*, and then the process advances to step S401*b*. In step S401*b*, it is checked whether the detection has been made on n surrounding nozzles (e.g., eight nozzles). If the detection has not yet been made on all the n surrounding nozzles, the process returns to step S401*a* to repeat the same processing.

After detecting all the eight surrounding nozzles, the process advances to step S401*d* to check whether the number of detected abnormal nozzles is equal to or larger than a determination value (e.g., three nozzles). If the number of detected abnormal nozzles is smaller than three nozzles, the process advances to step S403*a* to execute "first warning or recovery processing, etc." To the contrary, if the number of detected abnormal nozzles is equal to or larger than three nozzles, the process advances to step S402 to determine that a discharge failure has occurred. Then, in step S403*b*, "second warning or recovery processing, etc." is performed.

The "first warning or recovery processing, etc." is executed when the number of detected abnormal nozzles is smaller than three nozzles, and some processing including "not doing anything in particular" is performed. The "second warning or recovery processing, etc." is executed when the number of detected abnormal nozzles is equal to or larger than three nozzles and a discharge failure has occurred, and some processing (corresponding to the discharge abnormality caused by ink attached to the nozzle surface) is performed.

Figure 48:
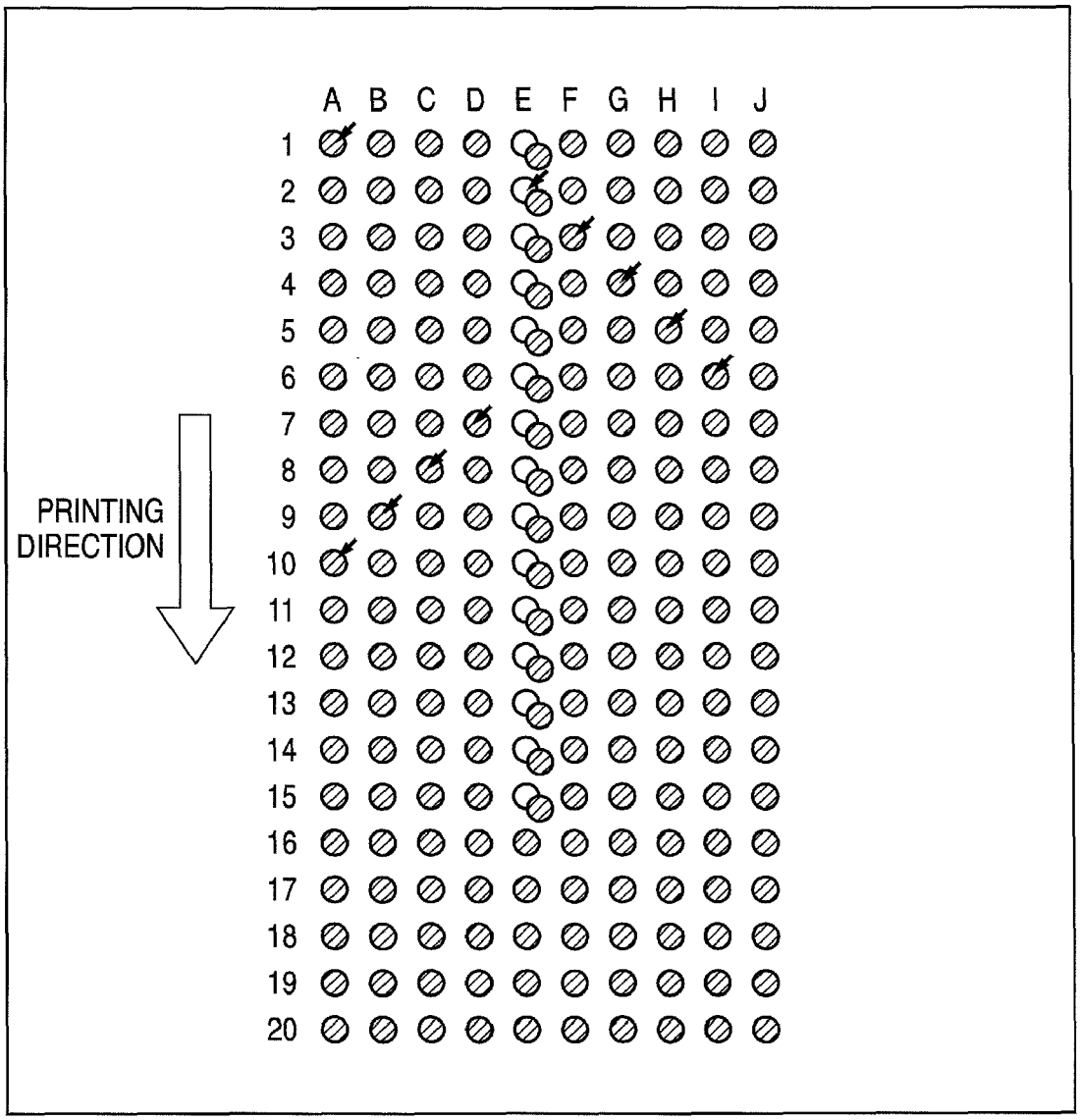
FIG. 48 is a view showing a printing result obtained by applying the determination method according to the eighth embodiment when a discharge failure occurs at one nozzle.
Figure 49:
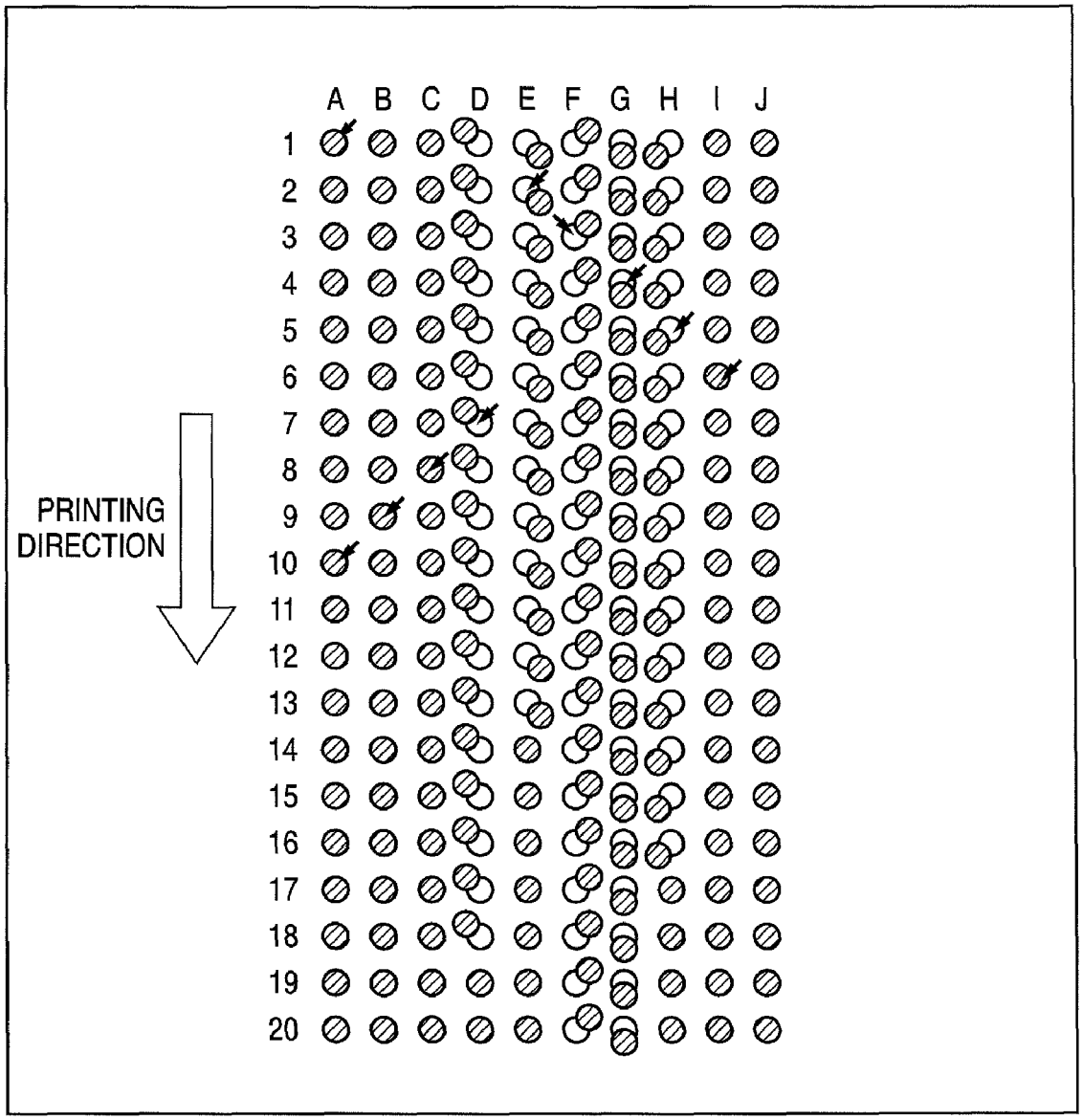
FIG. 49 is a view showing a printing result obtained by applying the determination method according to the eighth embodiment when discharge failures occur at five nozzles.

FIGS. 48 and 49 show printing results of applying processing shown in FIG. 51 to the cases shown in FIGS. 44 and 45.

In the example shown in FIG. 48, the first row on column A, the second row on column E, the third row on column I (scheduled), . . . are determined. On the first row of column A, it is determined that the discharge is normal. A "discharge abnormality caused by ink attached to the nozzle surface is determined" on the second row of column E, and the process advances to the surrounding nozzle determination process in step S401*a*. Then, it is determined on the third row on adjacent column F that the discharge is normal. It is determined on the fourth row of column G that the discharge is normal. After the fifth row on column H and the sixth row on column I are similarly determined, it is determined on the seventh row of column D on the opposite side with respect to the faulty column E that the discharge is normal. The eighth row on column C, the ninth row on column B, and the 10th row on column A are similarly determined. Consequently, determination of four nozzles on each of the left and right sides, i.e., a total of eight nozzles ends. In step S401*d*, the number of detected abnormal nozzles is counted. In the example shown in FIG. 48, the number of detected abnormal nozzles is "0" out of the eight nozzles. Thus, the "first warning or recovery processing, etc." is executed in step S403*a*, ending the sequence. In the example of FIG. 48, for example, only a warning is issued, and printing can continue without interrupting the printing operation.

In the example shown in FIG. 49, the first row on column A, the second row on column E, the third row on column I (scheduled), . . . are determined. On the first row of column A, it is determined that the discharge is normal. A "discharge abnormality caused by ink attached to the nozzle surface is determined" on the second row of column E, and the process advances to the surrounding nozzle determination process in step S401*a*. Then, it is determined on the third row of adjacent column F that an abnormality has occurred, and on the fourth row of column G that an abnormality has occurred. Similarly, it is determined on the fifth row of column H that an abnormality has occurred, and on the sixth row of column I that the discharge is normal. Then, it is determined on the seventh row of column D on the opposite side with respect to the faulty column E that an abnormality has occurred. Similarly, it is determined on the eighth row of column C, the ninth row of column B, and the 10th row of column A that the discharge are normal. In this manner, determination of four nozzles on each of the left and right sides, i.e., a total of eight nozzles ends.

In step S401*d*, the number of detected abnormal nozzles is counted. In the example shown in FIG. 49, the number of abnormal nozzles is "four" out of the eight nozzles. Thus, the process advances to steps S402 and S403*b* to execute the "second warning or recovery processing, etc.".

In the example shown in FIG. 49, a "discharge abnormality caused by ink attached to the nozzle surface is determined" at a total of five nozzles. For example, the printing operation is interrupted to perform recovery processing such as wiping of the printhead.

As described above, the eighth embodiment can tolerate a slight discharge failure (which may be recovered naturally) or detect the ink attachment range by applying a determination method considering the particular tendency on a discharge abnormality caused by ink attached to the nozzle surface. Hence, a countermeasure (e.g., to interrupt printing and execute any appropriate processing) corresponding to the degree of discharge failure can be taken, making it possible to make a proper determination according to influence on an image.

Other Exemplary Embodiments

In the above-described embodiments, droplets discharged from the printhead are ink, and a liquid contained in the ink tank is ink. The content of the ink tank is not limited to ink. For example, the ink tank may contain a process liquid to be discharged onto a printing medium in order to increase the fixing properties, water repellency, or quality of a printed image.

Of inkjet printing methods, the above-described embodiments employs a method of generating thermal energy (by e.g., an electrothermal transducer or laser beam) as energy utilized to discharge ink. The thermal energy changes the ink state to increase the printing density and resolution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus adapted to print on a printing medium by discharging ink comprising:

an inkjet printhead having the plurality of nozzles for discharging ink, a plurality of electrothermal transducers arranged in correspondence with the respective nozzles, for generating thermal energy used for discharging ink from the respective nozzles, and a plurality of sensors for detecting temperatures in correspondence with the respective electrothermal transducers; and an identifying unit configured to identify statuses of the respective nozzles by comparing the respective temperatures detected by the plurality of sensors with a plurality of threshold values indicating a plurality of nozzle statuses at a first timing after a predetermined period of time from a start of applying a voltage pulse to the respective electrothermal transducers, wherein the plurality of threshold values are determined based on an initial temperature of the ink printhead at a second timing before applying the voltage pulse and a driving condition of the inkjet printhead.

2. The apparatus according to claim 1, further comprising a recovery unit configured to perform recovery processing of the printing apparatus based on the state of the nozzles identified by the identifying unit.

3. The apparatus according to claim 1, further comprising a warning unit configured to issue a warning to a user based on the state of the nozzles identified by the identifying unit.

4. The apparatus according to claim 1, wherein the first timing includes a period of time when the temperature reaches a highest temperature in a temperature profile by the plurality of sensors.

5. An ink discharge failure detection method for an inkjet printhead configured to print on a printing medium by discharging ink from a plurality of nozzles, the inkjet printhead including the plurality of nozzles for discharging ink, a plurality of electrothermal transducers arranged in correspondence with the respective nozzles, for generating thermal energy used for discharging ink from the respective nozzles, and a plurality of sensors for detecting temperatures in correspondence with the respective electrothermal transducers, the method comprising:

measuring temperatures of the respective electrothermal transducers based on outputs from the plurality of sensors at a first timing after a predetermined period of time from a start of applying a voltage pulse to the respective electrothermal transducers; and identifying statuses of the respective nozzles by comparing the respective temperatures detected by the plurality of sensors with a plurality of threshold values indicating a plurality of nozzle statuses, the plurality of threshold values are determined based on an initial temperature of the ink printhead at a second timing before applying the voltage pulse and a driving condition of the inkjet printhead.

6. The apparatus according to claim 1, wherein the state of the nozzle includes a state in which a bubble remains in the nozzle, a state in which the nozzle is clogged with a foreign substance, a state in which ink attaches to a surface of the nozzle, or a state in which ink can be discharged normally from the nozzle.

7. The apparatus according to claim 1, wherein the first timing after the predetermined period of time is a timing immediately before refilling ink into the nozzle.

* * * * *